US012661560B2

(12) United States Patent
Ura Hernandez et al.

(10) Patent No.: US 12,661,560 B2
(45) Date of Patent: Jun. 23, 2026

(54) GOLF CLUB FACE WITH ROUGHNESS CHARACTERISTICS FOR MORE CONSISTENT PERFORMANCE IN WET AND DRY CONDITIONS

(71) Applicant: KARSTEN MANUFACTURING CORPORATION, Phoenix, AZ (US)

(72) Inventors: Daniel Ura Hernandez, Phoenix, AZ (US); Erik M. Henrikson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 107 days.

(21) Appl. No.: 18/676,442

(22) Filed: May 28, 2024

(65) Prior Publication Data

US 2024/0390743 A1 Nov. 28, 2024

Related U.S. Application Data

(60) Provisional application No. 63/504,420, filed on May 25, 2023.

(51) Int. Cl.
*A63B 53/04* (2015.01)

(52) U.S. Cl.
CPC ..... *A63B 53/0445* (2020.08); *A63B 53/0408* (2020.08); *A63B 53/047* (2013.01); *A63B 2053/0479* (2013.01)

(58) Field of Classification Search
CPC ..... A63B 53/0445; A63B 2053/0479
See application file for complete search history.

(56) References Cited

U.S. PATENT DOCUMENTS

| | | | |
|---|---|---|---|
| 4,768,787 | A | 9/1988 | Shira |
| 7,179,175 | B2 | 2/2007 | Kennedy, III |
| 7,285,057 | B2 | 10/2007 | Mann, Jr. |
| 8,012,036 | B2 | 9/2011 | Nakamura |
| 8,105,180 | B1 | 1/2012 | Cackett |
| 8,337,324 | B2 | 12/2012 | Sander |
| 8,468,679 | B2 | 6/2013 | Cackett |
| 8,579,723 | B2 | 11/2013 | Nakamura |
| 8,696,490 | B2 | 4/2014 | Ban |
| 8,827,830 | B2 | 9/2014 | Beaulieu |
| 8,968,115 | B2 | 3/2015 | Park |
| 9,216,329 | B2 | 12/2015 | Gilbert |
| 9,636,757 | B1 | 5/2017 | Rice |

(Continued)

FOREIGN PATENT DOCUMENTS

| | | |
|---|---|---|
| JP | 3901788 | 4/2007 |
| JP | 6297380 | 3/2018 |
| WO | 1997020961 | 6/1997 |

*Primary Examiner* — Raeann Gorden

(57) ABSTRACT

A wedge-type golf club head comprises unique surface roughness structures that improve spin in wet conditions by providing a system of peaks and valleys that grip the ball and relocate water from the hitting surface. The hitting surface can be characterized by statistical measurements such as average surface roughness (Sa), skewness (Ssk), root mean square gradient (Sdq), and developed interface area (Sdr) at different wavelengths including a composite band, a milling band, and a surface band. The surface roughness structure provides increased spin retention in wet conditions, while remaining durable.

20 Claims, 33 Drawing Sheets
(13 of 33 Drawing Sheet(s) Filed in Color)

(56) References Cited

U.S. PATENT DOCUMENTS

| | | | | |
|---|---|---|---|---|
| 9,821,202 | B2 | 11/2017 | Hettinger | |
| 9,975,015 | B2 | 5/2018 | Ripp | |
| 10,661,129 | B2 | 5/2020 | Seagram | |
| 11,554,297 | B2 | 1/2023 | Sizemore, Jr. | |
| 11,857,849 | B2 | 1/2024 | Ripp | |
| 2011/0294596 | A1 | 12/2011 | Ban | |
| 2014/0274452 | A1 | 9/2014 | Oldknow | |
| 2015/0045142 | A1* | 2/2015 | Moreira | A63B 53/047 473/330 |
| 2019/0175998 | A1 | 6/2019 | Kitagawa | |
| 2020/0353324 | A1* | 11/2020 | Henrikson | A63B 53/0466 |
| 2022/0118326 | A1 | 4/2022 | Halberg | |

* cited by examiner

GOLF CLUB FACE WITH ROUGHNESS CHARACTERISTICS FOR MORE CONSISTENT PERFORMANCE IN WET AND DRY CONDITIONS

TECHNICAL FIELD

This disclosure relates generally to wedge-type golf club heads and, more particularly, relates to roughness characteristics of a wedge-type golf club head face.

BACKGROUND

Course and environmental conditions can greatly alter the performance of a player's clubs. For example, in wet conditions water is trapped between the ball and strike face at impact, resulting in significantly lower spin rates than an impact in dry conditions. Moisture present on the strike face further affects carry distance, which can make it difficult for a player to gauge how far the ball will travel. Consequently, conventional golf clubs perform significantly differently in wet and dry conditions.

BRIEF DESCRIPTION OF THE DRAWINGS

The patent or application file contains at least one drawing executed in color. Copies of this patent or patent application publication with color drawing(s) will be provided by the Patent Office upon request and payment of the necessary fee.

To facilitate further description of the embodiments, the following drawings are provided in which:

FIGS. 5A, 6A, 7A, 11A, 12A, 13A, 14A, 15A, 16A, 17A, 18A, 19A, and 20A are described in color or grayscale. The color versions of these drawings depict features above a mean plane as light green, yellow, red, and pink, depending on the magnitude of deviation from the mean plane. Features below the mean plane are depicted in green, blue, or purple. In the grayscale versions of these drawings, features above the mean plane are shown as lighter grays (near white) that progressively get darker as the magnitude of deviation from the mean plane increases. Features below the mean plane are shown in a slightly darker gray that gets progressively more dark as the magnitude of deviation from the mean plane increases. The grayscale versions will show peaks as a standard gray to dark gray or white. Valleys are shown as darker grays. Both the height of the peaks and depth of the valleys are shades of gray/white and are described below.

DETAILED DESCRIPTION

Figure 1:
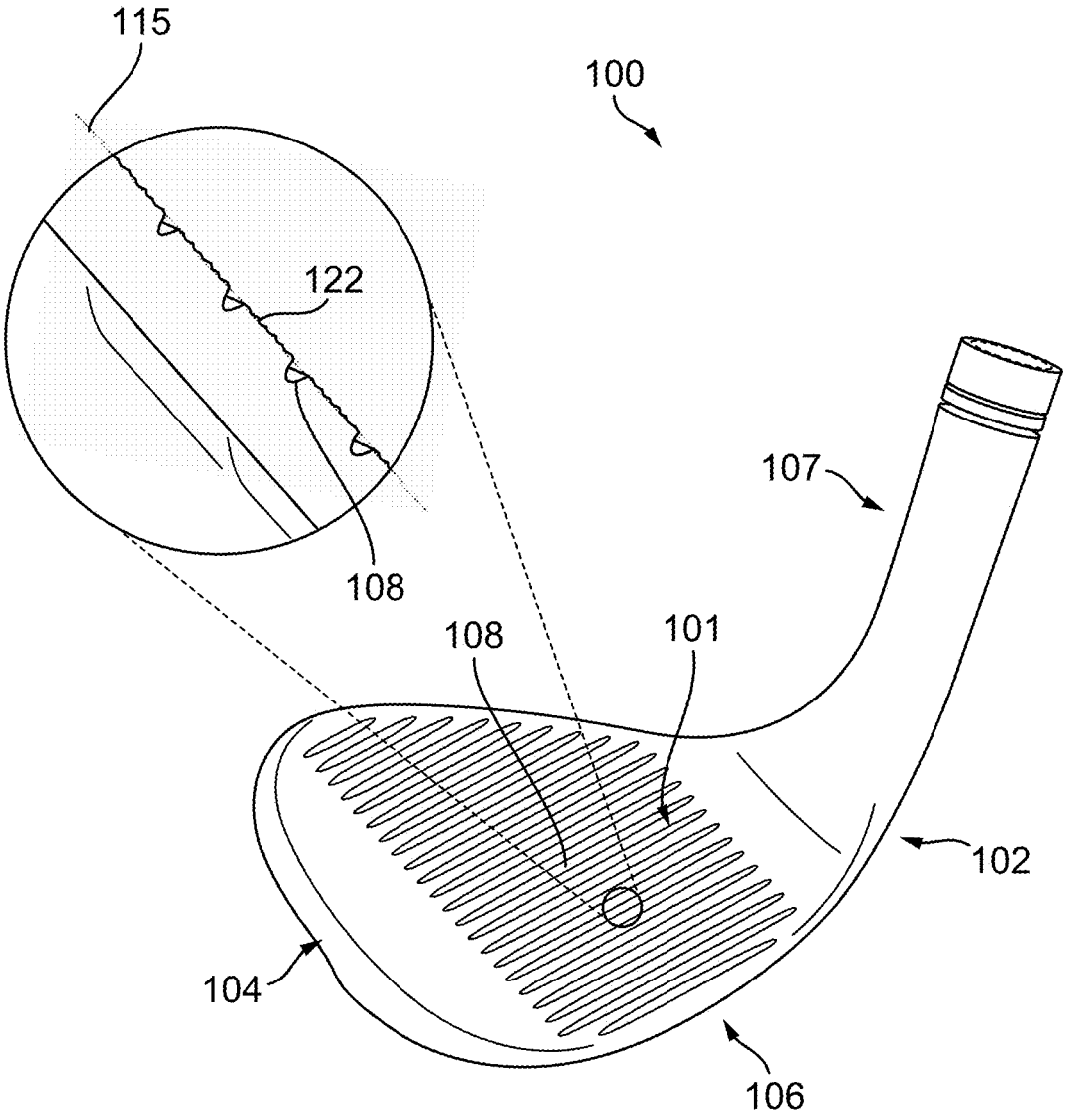
FIG. 1 illustrates a perspective view of a wedge-type golf club head with an enlarged detail view of the strike face surface, according to the present disclosure.

Wedge-type golf club heads described herein have strike faces with surface roughness characteristics that improve performance in wet conditions and create consistency in spin between wet and dry playing conditions. The overall surface roughness of the strike face includes grooves, which are deep channels cut into a golf club strike face, a milling band roughness, primarily associated with surface treatments such as milling, and a surface band roughness, primarily associated with surface treatments such as blasting. The overall surface roughness, milling band roughness, and surface band roughness further can be characterized by structural parameters such as average surface roughness (Sa), skewness (Ssk), root mean square gradient (Sdq), and developed interface area (Sdr). According to the embodiments described below, the wedge-type golf club heads described herein have a surface structure, as measured in the surface band, with one or more of the surface roughness (Sa), skewness (Ssk), root mean square gradient (Sdq), and developed interface area (Sdr) within ranges defined below that impart more consistent golf club performance in wet and dry conditions.

Definitions

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The term "strike face," as used herein, refers to a club head front surface that is configured to strike a golf ball. The term strike face can be used interchangeably with the "face."

The term "strike face perimeter," as used herein, can refer to an edge of the strike face. The strike face perimeter can be located along an outer edge of the strike face where the curvature deviates from a bulge and/or roll of the strike face.

The term "geometric centerpoint," or "geometric center" of the strike face, as used herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA).

The term "ground plane," as used herein, can refer to a reference plane associated with the surface on which a golf ball is placed. The ground plane can be a horizontal plane tangent to the sole at an address position.

The term "loft plane," as used herein, can refer to a reference plane that is tangent to the geometric centerpoint of the strike face.

The term "loft angle," as used herein, can refer to an angle measured between the loft plane and the XY plane (defined below).

The term "face height," as used herein, can refer to a distance measured parallel to loft plane between a top end of the strikeface perimeter and a bottom end of the strikeface perimeter.

The "depth" of the wedge-type golf club head, as described herein, can be defined as a front-to-rear dimension of the golf club head.

The "height" of the g wedge-type golf club head, as described herein, can be defined as a crown-to-sole or top rail-to sole dimension of the golf club head. In many embodiments, the height of the club head can be measured according to a golf governing body such as the United States Golf Association (USGA).

The "length" of the wedge-type golf club head, as described herein, can be defined as a heel-to-toe dimension of the wedge-type golf club head. In many embodiments, the length of the club head can be measured according to a golf governing body such as the United States Golf Association (USGA).

The "face height" of the wedge-type golf club head, as described herein, can be defined as a height measured parallel to loft plane between a top end of the strike face perimeter near the top rail and a bottom end of the strike face perimeter near the sole.

The "geometric center height" of the wedge-type golf club head, as described herein, is a height measured perpendicular from the ground plane to the geometric centerpoint of the wedge-type golf club head.

An "XYZ" coordinate system of the wedge-type golf club head, as described herein, is based upon the geometric center of the strike face. The wedge-type golf club head dimensions as described herein can be measured based on a coordinate system as defined below. The geometric center of the strike face defines a coordinate system having an origin located at the geometric center of the strike face. The coordinate system defines an X axis, a Y axis, and a Z axis. The X axis extends through the geometric center of the strike face in a direction from the heel to the toe of the club head. The Y axis extends through the geometric center of the strike face in a direction from the top rail to the sole of wedge-type golf club head. The Y axis is perpendicular to the X axis. The Z axis extends through the geometric center of the strike face in a direction from the front end to the rear end of the wedge-type golf club head. The Z axis is perpendicular to both the X axis and the Y axis.

The term "wedge," as used herein, can, in some embodiments, refer to an iron-type golf club head having a loft angle that is greater than approximately 40 degrees, greater than approximately 42 degrees, greater than approximately 44 degrees, greater than approximately 46 degrees, greater than approximately 48 degrees, greater than approximately 50 degrees, greater than approximately 52 degrees, greater than approximately 54 degrees, greater than approximately 56 degrees, greater than approximately 58 degrees, greater than approximately 60 degrees, greater than approximately 62 degrees, or greater than approximately 64 degrees.

DESCRIPTION

Presented below is a wedge-type golf club head with a particular milling band roughness, surface band roughness, and an overall surface roughness to enable shots with similar spin in wet and dry conditions. The strike face, imparting similar spin to wet and dry conditions, can include a composite band wavelength of 300 μin to 100,000 μin over the entirety of the strike face surface. The average surface roughness (Sa) of the composite band can be less than 180 μin. A skewness (Ssk) of the composite band can be between 0 and −0.5. A root mean square gradient (Sdq) of the composite band can be between 14 degrees and 30 degrees. The developed interface area (Sdr) of the composite band can be between 5% and 15%. If milling is applied to the wedge-type golf club head, a milling band surface roughness wavelength is between 2,000 μin and 100,000 μin. The Sa of the milling band is between 60 μin and 180 μin. The Ssk of the milling band is between 0.2 and 0.7. The Sdq of the milling band is between 5 degrees and 9 degrees. The Sdr of the milling band is between 0.5% and 1.5%. Blasting is applied to the wedge-type, creating a surface band surface roughness wavelength between 300 μin and 2,000 μin. The Sa of the surface band is between 35 μin and 120 μin. The Ssk of the surface band is between −5.0 and −1.0. The Sdq of the surface band is between 14 degrees and 30 degrees. The Sdr of the surface band is between 5% and 15%. This strike face also balances the roughness values with grooves, such that the wedge-type golf club head is USGA conforming.

An exemplary wedge-type golf club head 100 having a surface roughness that imparts more consistent performance in wet and dry conditions is illustrated at FIG. 1. The wedge-type golf club head 100 for the embodiments below can comprise a strike face 101, a heel 102, a toe 104, a sole 106, a hosel 107, and a groove 108. As shown in the enlarged detail of FIG. 1, the strike face 101 further has a surface with relatively larger grooves 108 and relatively smaller surface deviations 122. Surface deviations 122 are any irregularities 744 in the surface that create discrete areas where the actual surface deviates from a mean plane 115. The surface deviations 122 can be characterized as a roughness of the strike face 101. The magnitude of the roughness influences the degree to which the strike face 101 grips a golf ball at impact to impart spin. The larger grooves 108 primarily channel debris and water away from the surface during impact. The smaller surface deviations 122 create additional small pockets and channels to further remove water and debris from the striking surface. The smaller surface deviations 122 have an associated roughness that can improve performance in wet conditions.

Surface roughness can be measured to quantify surface deviations. An overall surface roughness can be formed by larger-scale macro-surface treatments and smaller-scale micro-surface treatments. In golf, club faces may be treated to increase surface roughness and improve friction between the golf club and ball during impact. Increasing friction corresponds to increased spin imparted on the ball, which provides a golfer more control on where a shot will come to rest. Golf governing bodies (such as the USGA or R&A) regulate surface roughness by establishing an average of 180 μin as a limit.

Figure 2:
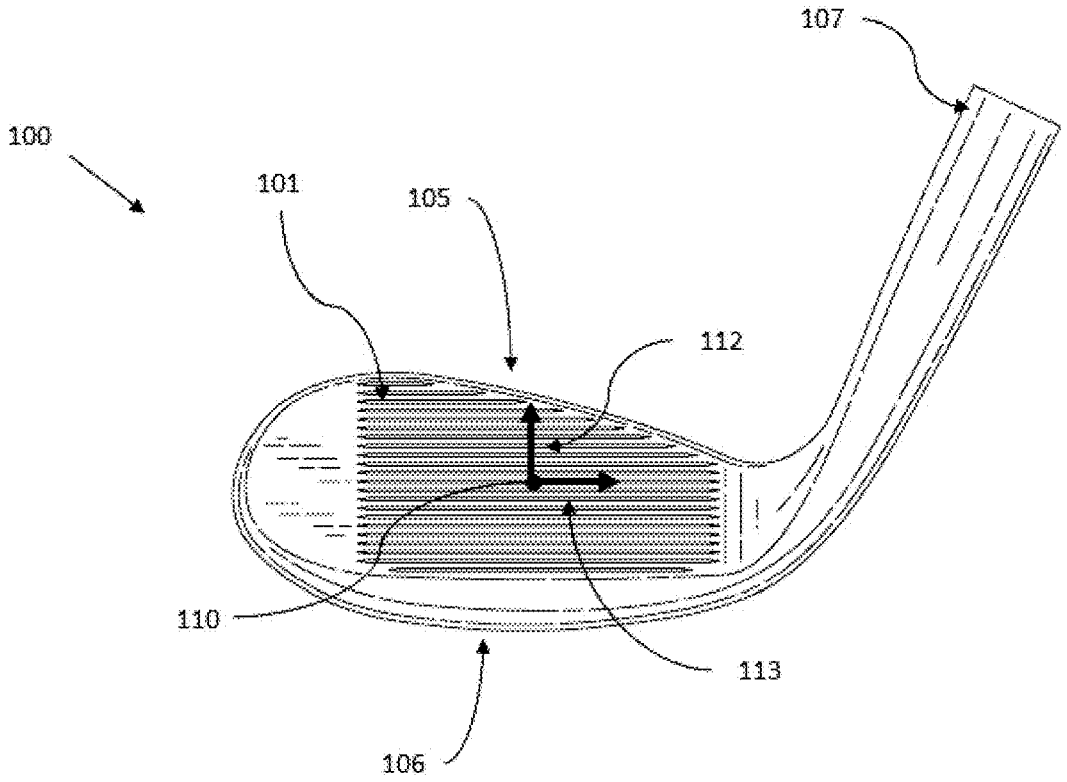
FIG. 2 illustrates a front view of the wedge-type golf club head of FIG. 1.
Figure 3:
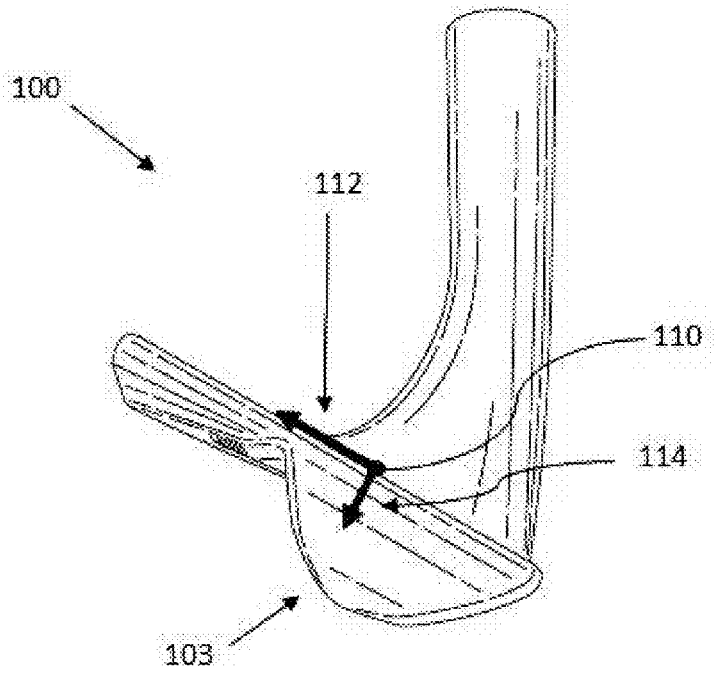
FIG. 3 illustrates a toe-side view of the wedge-type golf club head of FIG. 1.

A coordinate system can be used to describe features and relative locations of the wedge-type golf club head 100. For example, as best shown in FIGS. 2 and 3, the Y-direction extends from the geometric center 110, parallel to the loft plane in the sole 106 to top rail 105 direction. The X-direction 113 is defined as being in the heel 102 to toe 104 direction, with an origin at the geometric center 110. The Z-direction extends from the geometric center 110, perpendicular to the loft angle, towards the rear 103. Surface deviations 122 are measured as having a height or depth in the Z-direction.01. The X-direction and the Y-direction are used to establish where on the strike face 101 the surface deviation 122 occurs.

Surface treatments, such as blasting and milling, impart an overall surface roughness to the strike face 101. Surfaces with similar average surface roughness values, however, may have entirely unique surface structures. For instance, larger/deeper surface deviations 122, such as grooves 108, have a greater impact on the measured average surface roughness than smaller surface deviations 122. Additionally, milling may create a wavy microgroove structure between the large grooves 108, and blasting may further create a rough, sandpaper-like structure. Generally, grooves 108 comprise the deepest surface deviations 122, followed by the wavy microgroove structure caused by milling, and the shallowest surface deviations 122 are formed by blasting.

Figure 4:
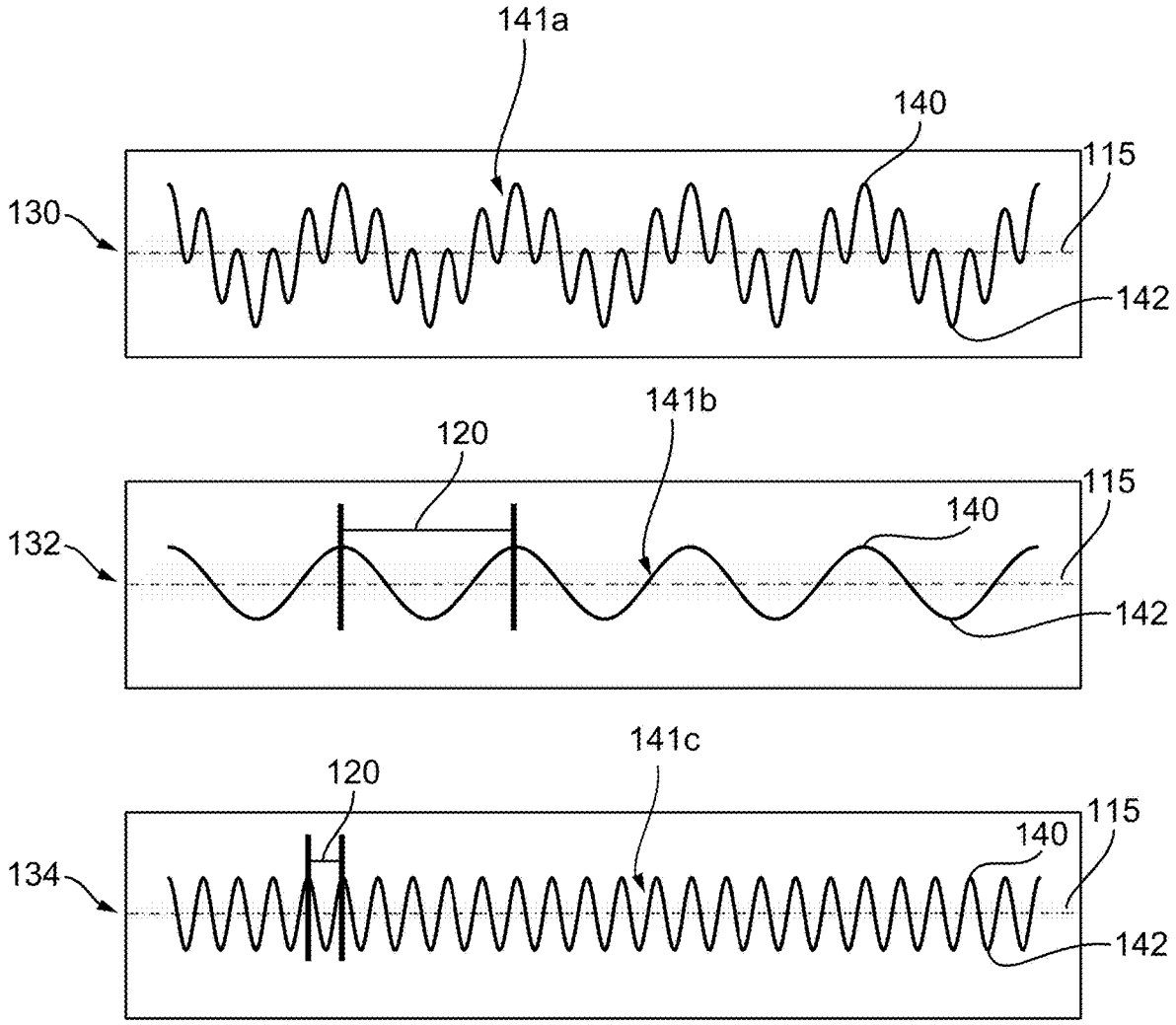
FIG. 4 illustrates graphical depictions of exemplary roughness waves measured in a composite band, a milling band, and a surface band, that are indicative of roughness characteristics of the strike face of the wedge-type golf club head of FIG. 1.

While blasting may comprise the shallowest surface deviations 122, it has the largest effect on retaining spin in wet conditions. As best shown at FIG. 4, which shows graphical representations of roughness in composite 130, milling 132, and surface bands 134, blasting creates many high points (peaks) 140 and low points (valleys) 142, which more effectively move water/debris from the ball impact zone of the strike face 101 surface. The valleys 142 capture the water/debris, to reduce the amount of water/debris coming in contact between the ball and striking surface. Further, the peaks 140 stay dry and thus directly contact the ball, imparting spin. The deeper, wavy milling structure may provide larger channels to remove water, however the relative lack of peaks 140 reduces the surface area of the strike face 101 contacting the ball.

I. Surface Roughness Decomposition

Surface roughness can be represented graphically as a wave shape, comprising peaks 140 (high points), valleys 142 (low points), and wavelengths 120. The wavelength 120 describes the distance between consecutive peaks 140. The various wavelengths 120, coupled with the amplitude of the peaks 140 and valleys 142, provides a unique and distinct surface. Since surface roughness is generally measured as an average over the entire surface, two surfaces may have an equivalent surface roughness with very different structures. These structures can be better understood by isolating roughness in a desired wavelength band by filtering out roughness in wavelengths outside the desired wavelength band. For example, surface roughness wavelengths between 300 μin and 100,000 μin is a composite band 130. Additionally, the composite band 130 may be broken into two components; (1) surface roughness wavelengths 120 between 2,000 μin and 100,000 μin is a milling band 132, and (2) surface roughness wavelengths 120 between 300 μin and 2,000 μin is a surface band 134.

A first line 141*a* in FIG. 4 graphically represents overall surface roughness of the strike face 101 as measured in the composite band 130 wavelengths 120. In some embodiments, the composite band 130 encompasses 300-100,000 μin. A second line 141*b*, representing a milling roughness, as measured in the milling band 132, can be derived from the first line 141*a*. More specifically, wavelengths 120 of 300-2,000 μin may be filtered to arrive at a milling band 132 of 2,000-100,000 μin. Additionally, a third line 141*c*, representing a surface roughness, as measured in the surface band 134, can be derived from the first line 141*a*. The third line 141*c* may be derived by filtering wavelengths 120 of 2,000-100,000 μin to arrive at a surface band 134 of 300-2,000 μin.

Figure 5A:
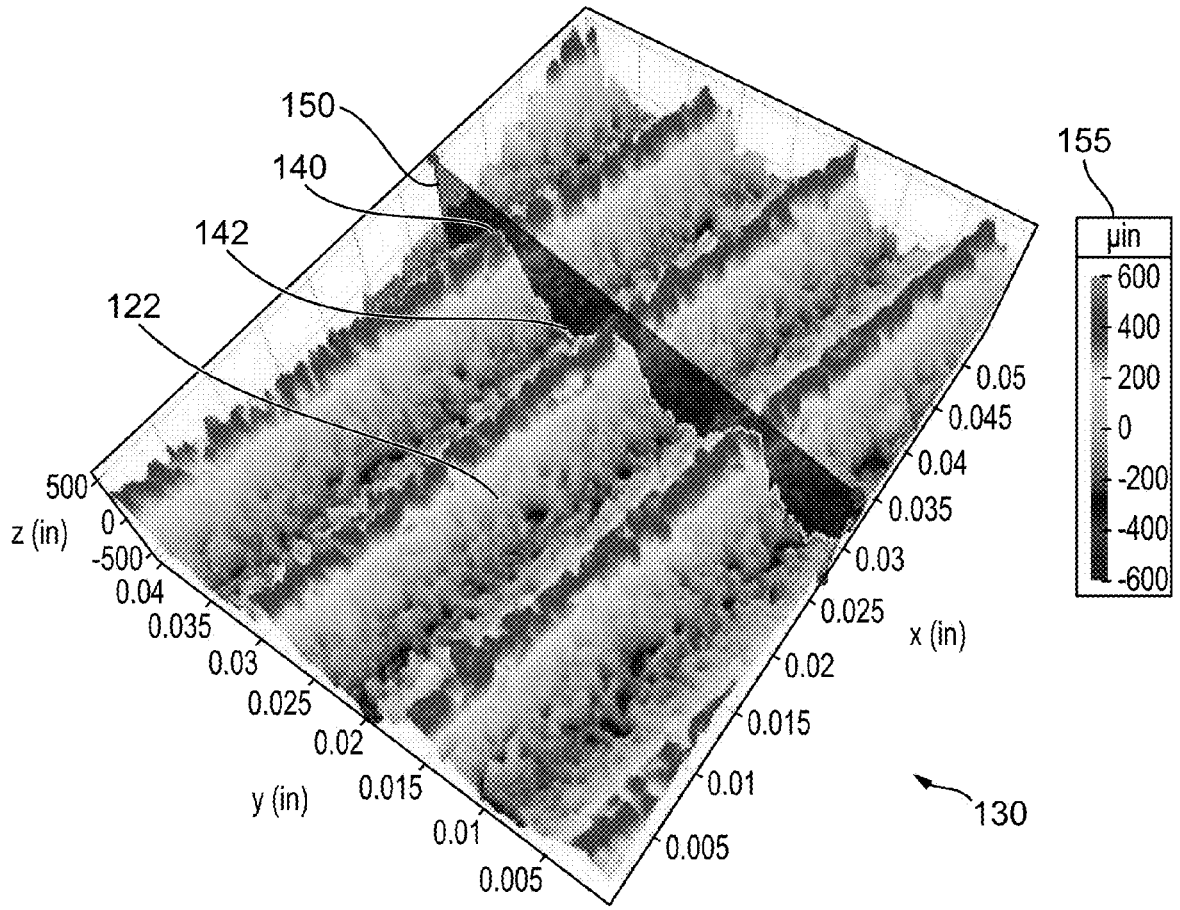
FIG. 5A illustrates a color 3D surface scan of the composite band of the strike face of the wedge-type golf club head of FIG. 1.
Figure 5B:
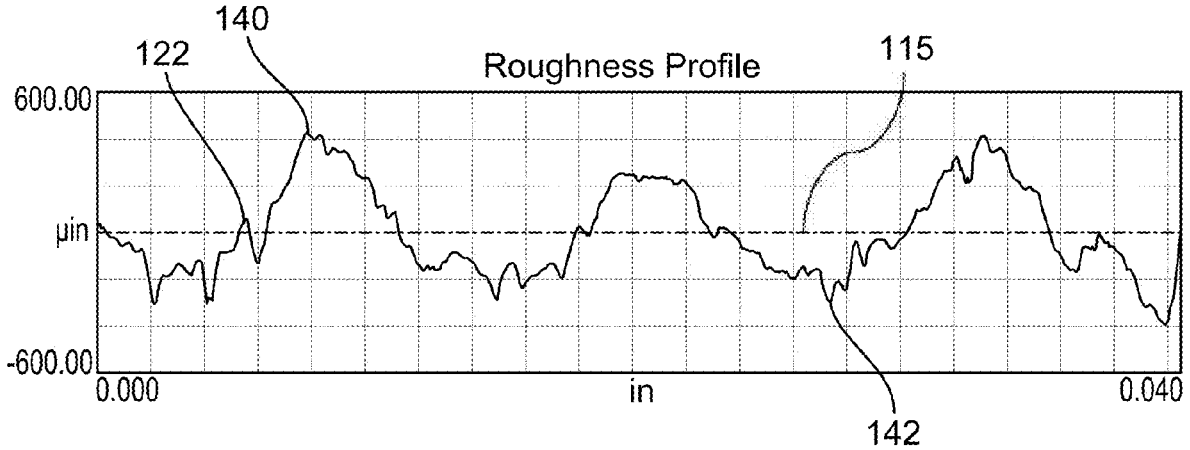
FIG. 5B illustrates a 2D cross-section of the composite band of FIG. 5A.

The composite band 130, captured via a laser scan, is shown in FIGS. 5A and 5B. FIGS. 5A and 5B show the topography of the composite band 130, which includes surface roughness wavelengths between 300 μin and 100,000 μin, and is presented as a three-dimensional image. FIG. 5B is a two-dimensional plot of the composite band 130 taken along a transverse plane 150.

The structure of the composite band 130 is made up of global and local peaks 140 and valleys 142. The strike face can be described in a global and local structure, wherein the milling pattern creates a structure of larger, wavy topography surface topography. The global structure may then comprise smaller surface deviations 122 that contribute roughness to the milling pattern. The global peaks 140*a* and global valleys 142*a* follow the milling pattern, and generally have the greatest influence on average surface roughness. In general, these global peaks 140*a* may be between approximately 300 μin and 500 μin above a mean plane 115, while the global valleys 142*a* may be between approximately 100 μin and 300 μin below a mean plane 115. The mean plane 115 is best shown in FIG. 5B, as the origin of the graph, which is calculated as an average height across the entire strike face 101 surface. The global peak 140*a* and global valley 142*a* structure corresponds to the milling band 132.

At a local level, a plurality of local peaks 140*b* and local valleys 142*b* may be present as roughness along the milling pattern. This creates higher frequency local peaks 140*b* and local valleys 142*b* with less predictable depths. In conjunction with the wavy structure caused by milling, the local peaks 140*b* and valleys 142*b* create the singular highest peaks 140 and the deepest valleys 142. This is attributed to a local peak 140*b* occurring on a global peak 140*a* or a local valley 142*b* occurring on a global valley 142*a*. The local peaks 140*b* and local valleys 142*b* structure corresponds to the surface band 134.

The composite band 130 peak 140 and valley 142 structure improves wedge spin in wet conditions. The peaks 140 provide roughness that grips the ball while the valleys 142 provide recesses for water to be relocated to, away from the striking surface. Upon impact, water will be moved to the many valleys 142, thus having less of an effect on the ball, and resulting in a golf ball strike (i.e. hitting the golf ball) that is similar to a golf ball strike in dry conditions.

Figure 6A:
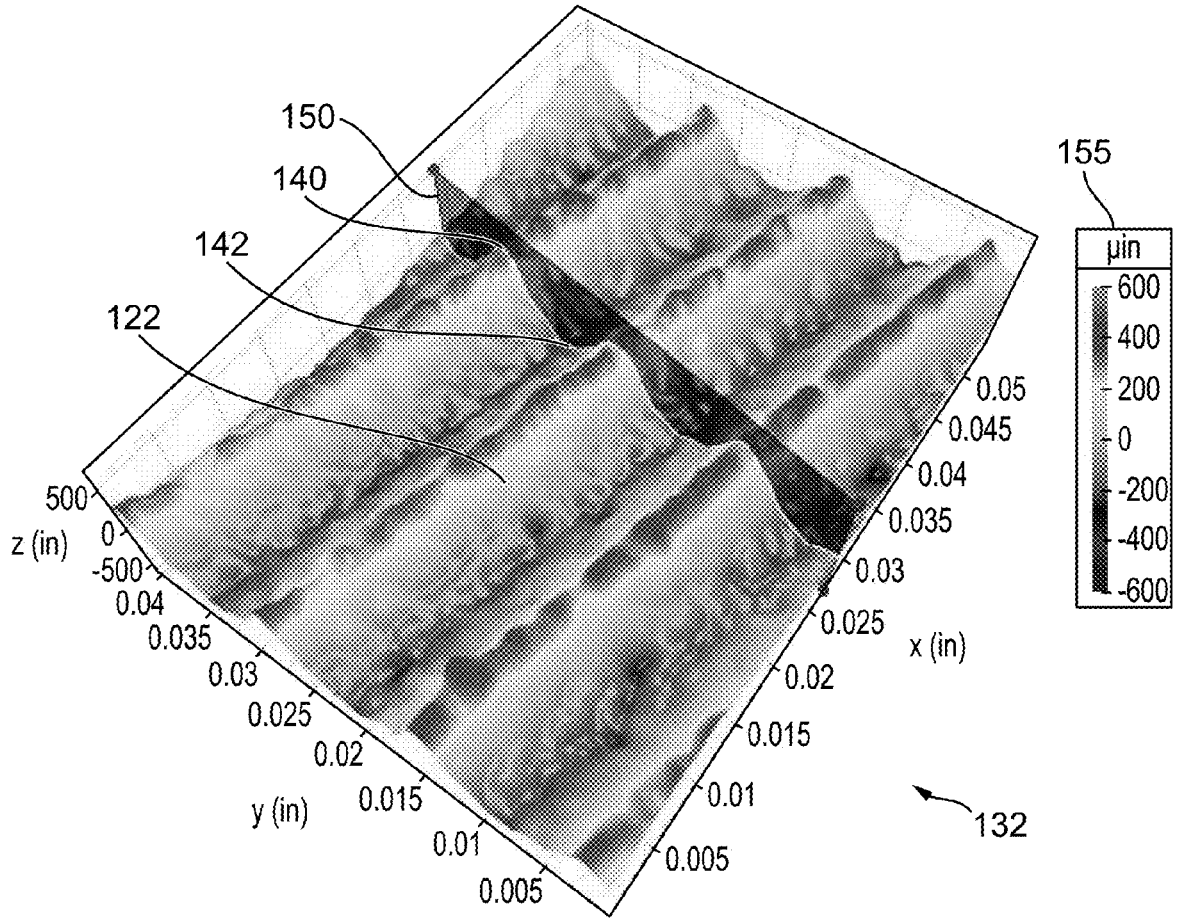
FIG. 6A illustrates a color 3D model of a milling band, after filtering out a surface band from the composite band of FIG. 5A.
Figure 6B:
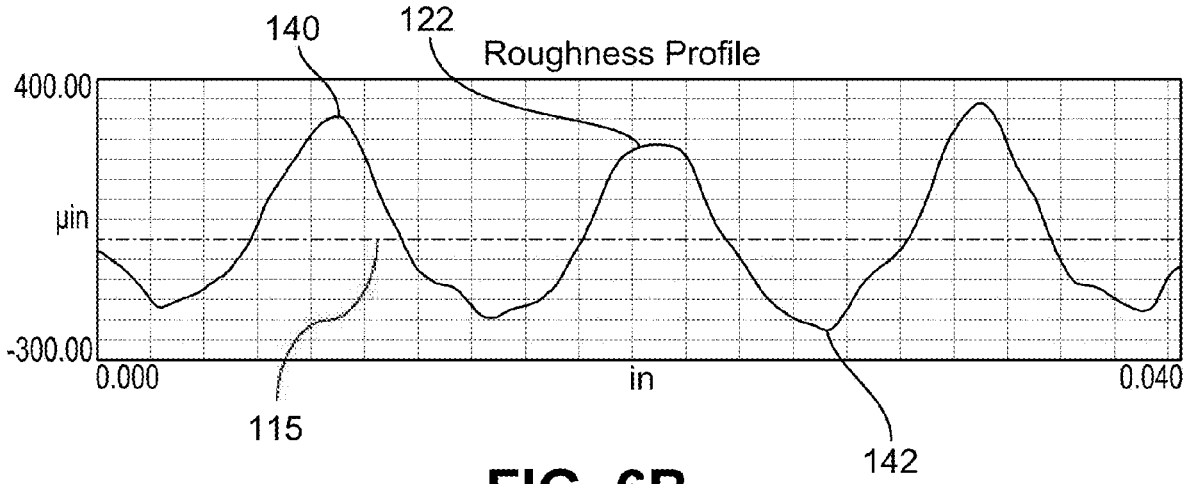
FIG. 6B illustrates a 2D cross-section of the milling band of FIG. 6A.

FIGS. 6A and 6B illustrate a filtered view of FIGS. 5A and 5B, respectively. FIGS. 6A and 6B represent the milling band 132, by removing (i.e. filtering) the surface band 134 from the composite band 130. The composite band 130 is filtered to remove surface roughness waves 125 with wavelengths 120 between 300 μin and 2,000 μin. Filtering out the surface band 134 results in the milling band 132. The milling band 132 is a wavy structure with surface roughness wavelengths 120 between 2,000 μin and 100,000 μin.

The lower frequency, longer wavelength 120 surface deviations 122 of the milling band 132 create a wavy structure illustrated in FIG. 6A. The peaks 140 are easily seen through the lighter colors and dark gray or white peaks 140 (yellow and red sections) of the three-dimensional plot, denoted by the depth key 155. The valleys 142 are also apparent through the darker gray colors (darker green and blue regions) on the plot. The wave-like structure is best shown by taking a cross-section 150 of FIG. 6A. The cross-section 150 produces a two-dimensional view, shown in FIG. 6B, wherein the peaks 140 and valleys 142 structure is more visible. Comparatively, the milling band 134 profile of FIG. 6A is much smoother than the composite band 130 profile in FIG. 5B and the surface band 134 profile in FIG. 7B (described later).

The milling band 132 comprises generally larger scale surface deviations 122, over the surface band 134. The milling band 132 surface deviations 122 are generally formed by milling the face. These designated depth cuts create a generally smooth, wavy structure. Milling the face may create microgrooves with peaks 140 and valleys 142 in a wave shape to aid in removing water/debris from the hitting surface. The presence of water and/or debris gets between the golf ball and the face, limiting the energy transfer and spin rate, as the ball will slip on the face when struck. The milling band 132 may be cut at a depth between 0 μin and 1,000 μin. In some embodiments, the depth of the milling band may be between 0 μin and 100 μin, between 100 μin and 200 μin, between 200 μin and 300 μin, between 300 μin and 400 μin, between 400 μin and 500 μin, between 500 μin and 600 μin, between 600 μin and 700 μin, between 700 μin and 800 μin, between 800 μin and 900 μin, or between 900 μin and 1,000 μin.

Figure 7A:
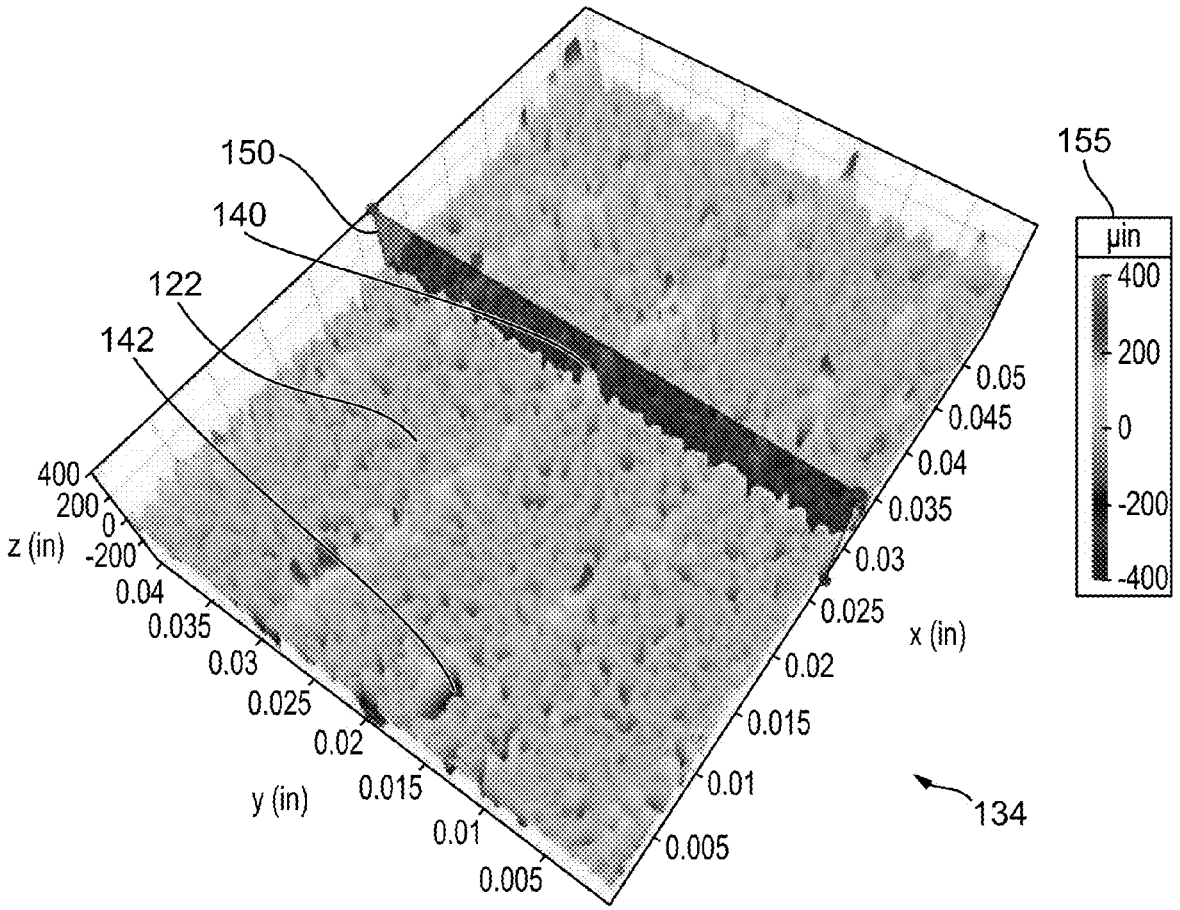
FIG. 7A illustrates a color 3D model of a surface band, after filtering out the milling band from the composite band of FIG. 5A.
Figure 7B:
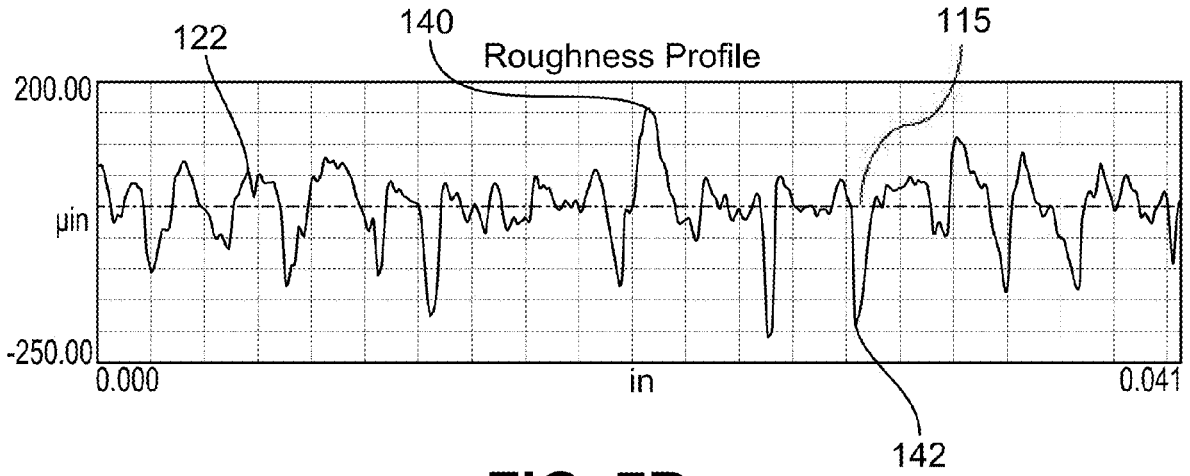
FIG. 7B illustrates a 2D cross-section of the surface band of FIG. 7A.

FIGS. 7A and 7B (surface band 134) illustrates a filtered view of FIGS. 5A and 5B (composite band 130), respectively. FIGS. 7A and 7B represent the surface band 134, following removing (i.e. filtering) the milling band 132 from the composite band 130. The composite band 130 is filtered to remove surface roughness waves 125 having wavelengths 120 between 2,000 μin and 100,000 μin, which is the milling band 132. Filtering out the milling band 132 results in the surface band 134, which is a rough surface structure made up of surface roughness waves 125 with wavelengths 120 between 300 μin and 2,000 μin.

The higher frequency, shorter wavelength 120 surface deviations 122 create a rough structure illustrated in FIG. 7A. Many peaks 140 are visible through the green, yellow, and red points (lighter colors with several dark colored points) of the 3-dimenional plot, denoted by the depth key 155. Due to the large number of peaks 140, the valley 142 structure is more difficult to see within FIG. 7A. The valleys 142 are more easily shown by taking a cross-section 150 of FIG. 7A. The cross-section 150 produces a 2-dimensional view, shown in FIG. 7B, wherein the peaks 140 and valleys 142 are more visible.

The surface band 134 comprises generally smaller scale surface deviations 122, relative to the milling band 132. The surface band 134 surface deviations 122 are generally formed through a blasting process, which creates localized peaks 140 and valleys 142 within the club face surface due to the materials and pressure of the blast. The peaks 140 increase friction, while the valleys 142 move water/debris from the strike face 101 surface. Due to the generally smaller size of the surface band 134 peaks 140 and valleys, relative to the milling band 132, the surface band 132 does not affect the overall average surface roughness measurement as significantly as the milling band 132. This allows for the ability to increase roughness within the surface band 134, yet stay at or below the golf's conforming surface roughness value. In some instances, the milling depth may be lowered, making the milling band 132 have a smaller amplitude surface roughness wave 125. Lowering the milling depth can then result in a strike face where the surface band 134 surface deviations 122 comprise higher peaks 140 and deeper valleys 142 than the milling band 132.

Increasing the roughness of the surface band 134 has desirable effects on the spin in wet conditions. Wet conditions result in a loss of spin when compared to dry conditions. This loss of spin is due to the ball slipping on the strike face. By increasing the roughness of the surface band 134, a higher spin retention rate is attained, reducing the gap between dry spin numbers and wet spin numbers. Having similar values allows for a more predictable shot. While increased roughness promotes more spin, the surface band 134 has a greater effect on wet conditions spin retention, compared to the milling band 132, because the surface band 134 has sharper peaks 140 and valleys 142. The sharpness of the peaks (higher Sdq) combined with predominantly deeper valleys 142 (Lower Ssk) in the surface band 134 makes the water settle to the lowest point. Additionally, the surface tension of the water is overcome, and the water moves down into the valleys 142, away from the hitting surface. The more gradual sloping (lower Sdq) and lack of deep valleys (Ssk near zero) of the milling band 132 allows water to stay relatively near the surface, instead of moving it away. The milling band 132 contributes more to the overall surface roughness measurement, but the surface band 134 roughness has a greater influence on spin in wet conditions. This allows for the surface band 134 roughness to be increased, without greatly affecting the overall surface roughness, thereby allowing a golf club to have better spin in wet conditions while conforming to the rules of golf.

II. Ideal Surface Characteristics

Due to the random distributions of peaks 140 and valleys 142 forming the surface of the strike face 101, the physical structure of the surface is expressed in statistical averages. For instance, statistical quantities such as the average surface roughness, skewness, root mean square gradient, and developed interface area are different ways of quantifying physical features of the surface roughness. These statistical quantities, described below, may characterize an average of a pre-determined area, rather than a discrete, specific location. While certain aspects of creating the desired strike face 101 surface structure may be exactly repeatable, such as the milling band 132, the surface band 134 aims to achieve an average quantity across the strike face 101, despite a randomness of the surface band 134 peaks 140 and valleys 142. One or a combination of multiple statistical quantities characterizes the unique structure of the strike face 101 surface. Further, the statistical quantities may be used to characterize the composite band 130, milling band 132, and surface band 134 either together or individually.

1) Average Surface Roughness (Sa)

Average surface roughness (Sa) is the roughness measurement used to determine whether a club conforms to USGA rules. Sa represents average of the absolute value of all surface height deviations from a mean plane 115, and is calculated with the following equation:

$$Sa = \frac{1}{A}\int\int_A |Z(x, y)|dxdy$$

wherein A is the total area the surface roughness is being evaluated and Z(x,y) is a function corresponding to the surface height deviation on the surface.

Sa may be separately calculated in the composite band 130, milling band 132, and surface band 134. Overall Sa is limited by the rules of golf to less than 180 μin in the composite band 130. Wedge-type golf club heads according to the present invention can have an overall Sa between 100 μin and 180 μin. In other embodiments, the overall Sa may be between 100 μin and 110 μin, between 110 μin and 120 μin, between 120 μin and 130 μin, between 130 μin and 140 μin, between 140 μin and 150 μin, between 150 μin and 160 μin, between 160 μin and 170 μin, or between 170 μin and 180 μin. Furthermore, while not necessarily conforming to current rules, overall Sa may exceed 180 μin. If the rules of golf were to change to allow an overall Sa of greater than 180 μin, the strike face could be manipulated through blasting and milling to achieve an Sa of greater than 180 μin, with a similar structure as described herein.

The Sa of the milling band 132 is calculated by filtering out the surface band 134 from the composite band 130. Wedge-type golf club heads according to the present invention can have a milling band Sa between 60 μin and 180 μin. In other embodiments, the milling band Sa may be between 60 μin and 70 μin, between 70 μin and 80 μin, between 80 μin and 90 μin, between 90 μin and 100 μin, between 100 μin and 110 μin, between 110 μin and 120 μin, between 120 μin and 130 μin, between 130 μin and 140 μin, between 140 μin and 150 μin, between 150 μin and 160 μin, between 160 μin and 170 μin, or between 170 μin and 180 μin.

The Sa of the surface band 134 is calculated by filtering out the milling band 132 from the composite band 130. Wedge-type golf club heads according to the present invention can have a surface band Sa between 35 μin and 120 μin. In other embodiments, the surface band Sa may be between 35 μin and 40 μin, between 40 μin and 45 μin, between 45 μin and 50 μin, between 50 μin and 55 μin, between 55 μin and 60 μin, between 60 μin and 65 μin, between 65 μin and 70 μin, between 70 μin and 75 μin, between 75 μin and 80 μin, between 80 μin and 85 μin, between 85 μin and 90 μin, between 90 μin and 95 μin, between 95 μin and 100 μin, between 100 μin and 105 μin, between 105 μin and 110 μin, between 110 μin and 115 μin, or between 115 μin and 120 μin.

Significantly, the overall Sa value is not simply the sum of the individual band Sa values. For instance, the milling band Sa contributes more to the overall Sa than the surface band Sa. Accordingly, the surface band Sa of the golf clubs according to the present invention is increased significantly, while still maintaining a conforming overall Sa value. This is related to the surface band 134 having generally smaller surface deviations 122 compared to the milling band 132.

2) Skewness (Ssk)

Figure 8A:
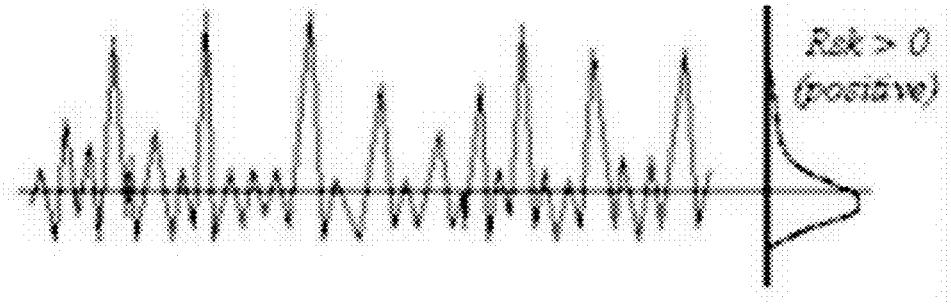
FIG. 8A illustrates a general plot of a surface with a positive skewness in two-dimensions.
Figure 8B:
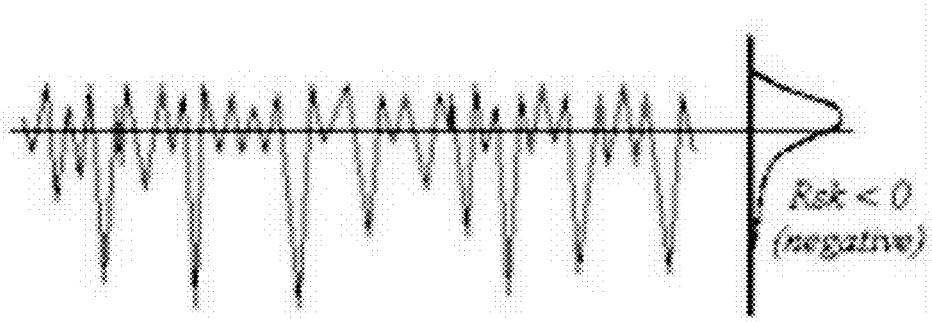
FIG. 8B illustrates a general plot for a surface with a negative skewness in two-dimensions.
Figure 8C:
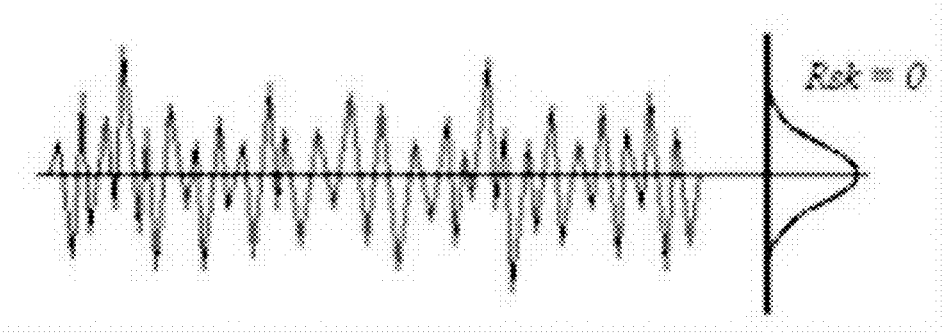
FIG. 8C illustrates a general plot for a surface with a neutral skewness in two-dimensions.

Skewness (Ssk) is a three-dimensional measurement of the degree of surface height symmetry about a mean plane 115. This tells whether a surface comprises predominantly larger peaks 140 or valleys 142 relative to the mean plane 115 (i.e. is there more valley depth overall or peak height overall). This is graphically illustrated in FIGS. 8A-8C. These figures show generic positive, neutral, and negative Rsk plots. Rsk is simply a two-dimensional quantity of Ssk. Two-dimensional plots more easily show how the peak 140 and valley 142 structures affect Ssk values. For instance, positive Ssk values correspond to a surface with larger peak 140 heights than valley 142 depths, relative to the mean plane 115, best shown in FIG. 8A. Contrarily, negative Ssk values correspond to a surface with deeper valley 142 depths than peak 140 heights, relative to a mean plane 115, best shown in FIG. 8B. A neutral Ssk will comprise an even distribution of higher peaks 140 and deeper valleys 142, relative to the mean plane 115, as best shown in FIG. 8C. Ssk is calculated using the following equation:

$$Ssk = \frac{1}{S_q^3}\left[\frac{1}{A}\int\int_A (Z(x, y)^3)dxdy\right]$$

wherein Sq represents the root mean square roughness over the surface, A is the total area of the surface being evaluated, and Z(x,y) is a function corresponding to the surface height deviation on the surface.

Ssk may be calculated for the composite band 130, milling band 132, and/or surface band 134 individually. Wedge-type golf club heads according to the present invention will generally have positive Ssk in the composite band 130 and the milling band 132, and negative Ssk in the surface band 134. A negative surface band 134 Ssk indicates a strike face 101 roughness structure having larger valleys 142 at a more local level (i.e. the surface band 134). This increases available space to harbor water and debris, thereby increasing the amount of direct contact between the strike face 101 (including the grooves 108 and milling) and the ball. A positive Ssk creates more prominent peaks 140, which adds roughness, but lacks durability in the surface band 134. The surface band 134 comprises smaller scale deviations relative to the milling band 132, thus creating more fragile peaks 140. These peaks 140 formed in the surface band 134 may have larger Sdq values (described below) that easily break following impact with a golf ball, while the valleys 142 tend to hold their geometry better through repeated use. Due to the structure of the milling band 132, which is a larger, wavy profile, the peaks 140 are more rounded and thus, sturdier (lower Sdq value). The milling band 132 durability is not as troublesome, so a positive Ssk is acceptable.

The composite band 130 Ssk is more greatly influenced by the structure of the milling band 132, and therefore has a neutral to positive Ssk. The Ssk of the composite band 130 may be between 0.0 and 0.5. In some embodiments, the Ssk of the composite band 130 may between 0.0 and 0.05, between 0.05 and 0.10, between 0.10 and 0.15, between 0.15 and 0.20, between 0.20 and 0.25, between 0.25 and 0.30, between 0.30 and 0.35, between 0.35 and 0.40, between 0.40 and 0.45, or between 0.45 and 0.50.

The milling band 132 will generally have a positive Ssk value due to the peaks 140 having better durability than the surface band 134. The Ssk of the milling band 132 may be between 0.2 and 0.7. In some embodiments, the Ssk of the milling band 132 may between 0.2 and 0.25, between 0.25 and 0.30, between 0.30 and 0.35, between 0.35 and 0.40, between 0.40 and 0.45, between 0.45 and 0.50, between 0.50 and 0.55, between 0.55 and 0.60, between 0.60 and 0.65, or between 0.65 and 0.70.

The surface band 134 will have a negative Ssk value due to having a surface structure with larger valleys 142 than peaks 140. This improves spin in wet conditions, while also being more durable. The Ssk of the surface band 134 may be between −1.0 and −5.0. In some embodiments, the Ssk of the surface band 134 may between −1.0 and −1.2, between −1.2 and −1.4, between −1.4 and −1.6, between −1.6 and −1.8, between −1.8 and −2.0, between −2.0 and −2.2, between −2.2 and −2.4, between −2.4 and −2.6, between −2.6 and −2.8, between −2.8 and −3.0, between −3.0 and −3.2, between −3.2 and −3.4, between −3.4 and −3.6, between −3.6 and −3.8, between −3.8 and −4.0, between −4.0 and −4.2, between −4.2 and −4.4, between −4.4 and −4.6, between −4.6 and −4.8, or between −4.8 and −5.0.

3) Root Mean Square Gradient (Sdq)

Figure 9:
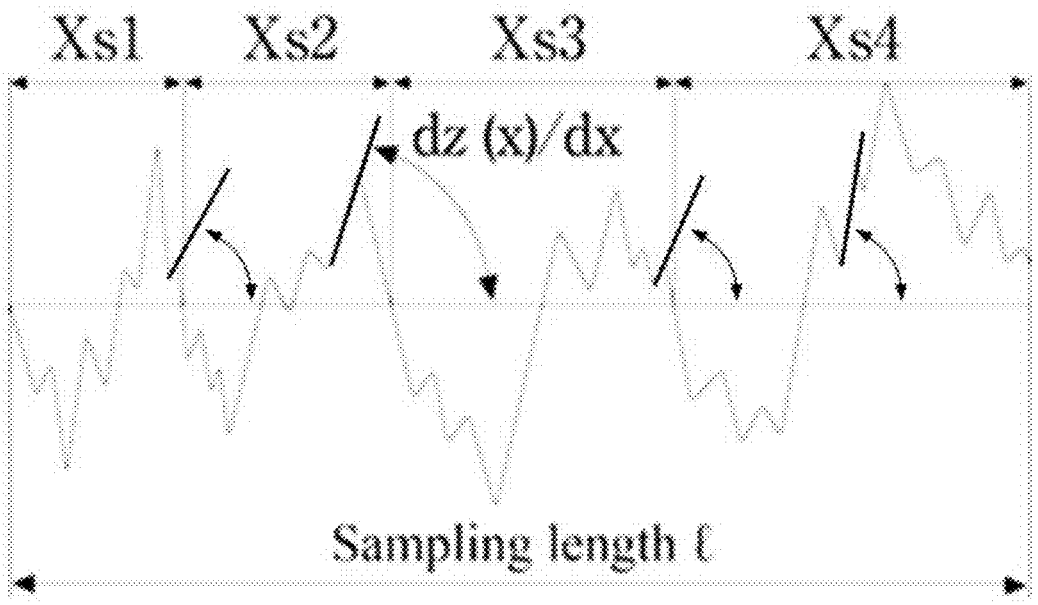
FIG. 9 illustrates a general plot depicting the root mean square gradient in two-dimensions.

Root mean square gradient (Sdq) is a three-dimensional quantity that is indicative of the angles of slopes forming the peaks 140 and valleys 142 of the roughness structure. Sdq changes based on amplitude and spacing of surface deviations 122. For example, two surfaces may have the same Sa value, but if one surface has greater spacing between surface deviations 122, it will have a lower Sdq than the other surface with more closely spaced surface deviations 122. Sdq can be more easily visualized in two-dimensions. The two-dimensional measurement of Sdq is Rdq and a general example is shown in FIG. 9. FIG. 9 has three slopes peaks 140, respectfully, to demonstrate the angle the slope creates with the mean plane 115. The overall Rdq is calculated as an average over the entire sampling length. In three-dimensions, the average slope of the peaks 140 and valleys 142 are evaluated over the entire surface. Sdq is calculated using the following equation:

$$Sdq = \sqrt{\frac{1}{A}\int\int_A\left[\left(\frac{\partial Z(x, y)}{\partial x}\right)^2 + \left(\frac{\partial Z(x, y)}{\partial y}\right)^2\right]dxdy}$$

wherein A is the total area of the surface being evaluated and Z(x,y) is a function corresponding to the surface height deviation on the surface.

The Sdq for the composite band 130 is more influenced by the surface band 134 than the milling band 132. This is due to the wavy milling band 132 having a smaller gradient, compared to the rougher surface band 134. The surface band 134 provides more finely spaced texture, which accounts for a larger Sdq value. This is because larger values of Sdq correspond to sharper peaks 140 and valleys 142. Deeper valleys 142 with steeper slopes allow water to overcome surface tension and fall into the bottom of the valley 140, away from the hitting surface of the strike face 101. and allow more regions for water to rest in. This removes water from the striking surface so it does not interfere with a golf ball strike. Wedge-type golf club heads according to the present invention can have an Sdq in the composite band 130 between 14 degrees and 30 degrees. In other embodiments, the Sdq may be between 14 degrees and 16 degrees, between 16 degrees and 18 degrees, between 18 degrees and 20 degrees, between 20 degrees and 22 degrees, between 22 degrees and 24 degrees, between 24 degrees and 26 degrees, between 26 degrees and 28 degrees, or between 28 degrees and 30 degrees.

The milling band 132 can have a lower Sdq value due to the surface deviations 122 being spaced further apart, thus the peaks 140 and valleys 142 have less angled inclines or declines, respectively. This is seen in the longer, wavy profile of the milling band 132. Wedge-type golf club heads according to the present invention can have an Sdq in the milling band 132 between 5 degrees and 9 degrees. In other embodiments, the milling band 132 Sdq may be between 5.0 degrees and 5.5 degrees, between 5.5 degrees, and 6.0 degrees, between 6.0 degrees and 6.5 degrees, between 6.5 degrees and 7.0 degrees, between 7.0 degrees and 7.5 degrees, between 7.5 degrees and 8.0 degrees, between 8.0 degrees and 8.5 degrees, or between 8.5 degrees and 9.0 degrees.

The surface band 134 contributes more to the overall Sdq of the strike face 101. The texture provided by the surface band 134 represents a higher Sdq value because of sharp, closely spaced surface deviations 122 (sharp inclination angles), which is noticeable on the composite band 130 as well. Wedge-type golf club heads according to the present invention can have an Sdq in the surface band 134 between 14 degrees and 30 degrees. In other embodiments, the Sdq may be between 14 degrees and 16 degrees, between 16 degrees and 18 degrees, between 18 degrees and 20 degrees, between 20 degrees and 22 degrees, between 22 degrees and 24 degrees, between 24 degrees and 26 degrees, between 26 degrees and 28 degrees, or between 28 degrees and 30 degrees.

4) Developed Interface Area (Sdr)

Developed interface area (Sdr) is a measurement that expresses the percentage of additional surface area created by the surface roughness. Surface deviations 122 from a perfectly smooth, flat surface increase the surface area. Similar to Sdq, Sdr in the surface band 134 has a larger influence on the composite band 130 Sdr than Sdr in the milling band 132. This can be attributed to the shorter wavelength 120, high frequency surface roughness waves 125 in the surface band 134, which add more surface deviations 122 and texture. Additional surface area provides more contact area for a golf ball strike. Further, the additional area created by the surface roughness waves 125 channels water and debris away from the contact area on the strike face 101, which increases ball interaction to the strike face 101 (i.e. friction), and reduces the ability of the ball slipping. Less slipping results in a higher spin retention in wet conditions. Sdq may be calculated using the following equation:

$$Sdq = \frac{1}{A}\left[\int\int_A\left(\sqrt{\left[1+\left(\frac{\partial Z(x,y)}{\partial x}\right)^2+\left(\frac{\partial Z(x,y)}{\partial y}\right)^2\right]}-1\right)dxdy\right]$$

wherein A is the total area of the surface being evaluated and Z(x,y) is a function corresponding to the surface height deviation on the surface.

Wedge-type golf club heads according to the present invention can have an Sdr in the composite band 130 between 5% and 15%. In other embodiments, the composite band Sdr may be between 5% and 6%, between 6% and 7%, between 7% and 8%, between 8% and 9%, between 9% and 10%, between 10% and 11%, between 11% and 12%, between 12% and 13%, between 13% and 14%, or between 14% and 15%.

The milling band 132 will typically have a lower Sdr value than Sdr values in the composite band 130 and the surface band 134. This is because of the frequency of the sharp peaks 140 and valleys 142, wherein there are many more surface deviations 122 for a designated area, thereby increasing the surface area. Milling has a lower frequency of peaks 140 and valleys 140, so less area is added. Wedge-type golf club heads according to the present invention can have Sdr in the milling band 132 between 0.5% and 1.5%. In other embodiments, the milling band 132 Sdr may be between 0.5% and 0.6%, between 0.6% and 0.7%, between 0.7% and 0.8%, between 0.8% and 0.9%, between 0.9% and 1.0%, between 1.0% and 1.1%, between 1.1% and 1.2%, between 1.2% and 1.3%, between 1.3% and 1.4%, or between 1.4% and 1.5%.

The Sdr value in the surface band 134 is similar to the Sdr value in the composite band 130. Wedge-type golf club heads according to the present invention can have an Sdr in the surface band 134 between 5% and 15%. In other embodiments, the surface band 134 Sdr may be between 5% and 6%, between 6% and 7%, between 7% and 8%, between 8% and 9%, between 9% and 10%, between 10% and 11%, between 11% and 12%, between 12% and 13%, between 13% and 14%, or between 14% and 15%.

5) Surface Roughness Ratios

The relationship between different statistical quantities may also further describe the strike face 101 surface roughness characteristics. For instance, relating the Sdq and the Ssk describes the overall peaks 140 and valleys 142 structure. As described above, the Sdq corresponds to the inclination angle of the peaks 140 and valleys 142 present on the strike face 101, while the Ssk describes the predominance of peaks 140 or valleys 142. Therefore, larger values of Sdq describe steeper, sharper peaks 140 and valleys 142 and a negative Ssk corresponds deeper valleys 142 being present on the strike face 101. Steep peaks 140 with deep valleys 142 provide larger pockets for water to reside in during a strike, thus removing it from the hitting surface so it does not interfere with the ball. Limiting water from contacting the ball during a strike is critical to retaining spin in wet conditions.

The relationship of Sdq and Ssk may be described through a ratio. For instance, Sdq:Ssk in the surface band 134 may be any value between −30 degrees and −2 degrees. In some embodiments, the Sdq:Ssk ratio of the surface band 134 may be between −30 degrees and −28 degrees, between −28 degrees and −26 degrees, between −26 degrees and −24 degrees, between −24 degrees and −22 degrees, between −22 degrees and −20 degrees, between −20 degrees and −18 degrees, between −18 degrees and −16 degrees, between −16 degrees and −14 degrees, between −14 degrees and −12 degrees, between −12 degrees and −10 degrees, between −10 degrees and −8 degrees, between −8 degrees and −6 degrees, between −6 degrees and −4 degrees, or between −4 degrees and −2 degrees.

III. Methods of Producing Surface

The methods described below, as applied to a wedge-type golf club head, combine multiple methods of surface alteration to maintain overall average surface roughness, Sa, below a maximum value of 180 μin, while maximizing Ssk, Sdq, and Sdr. Some methods of altering the surface to achieve these desired characteristics include milling and blasting, which are described in detail below.

A. Club Head Material

A wedge-type golf club head 100 according to the present invention may be manufactured from a metallic material. Specifically, the golf club may comprise 8620 alloy steel, 431 stainless steel, or another metallic material. Additionally, the wedge-type golf club head 100 may comprise one or more materials. These materials may include any suitable metallic material mentioned above or a composite. Further, the wedge-type golf club head 100 may comprise a chrome, QPQ, PVD, or other suitable finishes to protect the surface of the wedge-type golf club head. In other embodiments, no finish may be used.

B. Milling

Milling is one method to alter the surface roughness of the strike face 101. Milling creates the Sa, Ssk, Sdq, and Sdr values (as described above) for the milling band 132. A cutting tool is used to remove a portion of the strike face surface. The milling produces micro grooves on the strike face. The peaks 140 and valleys 142 formed by milling create a milling pattern, which gives the surface a wavy profile. In general, these peaks 140 may be between approximately 300 μin and 500 μin above a mean plane 115, while the valleys 142 may be between approximately 100 μin and 300 μin below a mean plane 115. As discussed above, the surface roughness created by milling the strike face 101 surface is referred to as the milling band 132.

C. Blasting

Media blasting is another method to create a desired surface finish on a wedge-type golf club head strike face 101. Media blasting uses pressurized media blasting equipment to direct a selected blasting media onto the wedge-type golf club head target surface. The media blasting equipment comprises one or more nozzles or "guns," a pressurized air supply, a blast media supply, and a media return filter. The blasting operation occurs during a blasting cycle time.

i. Blasting Equipment

The media blasting equipment is generally contained within a cabinet to confine the pressurized media and protect the users of the equipment. The cabinet may have a feeding mechanism such as a turn table to move the wedge-type golf club heads into position during a continuous process or may be limited to a single wedge-type golf club head at a time for a discrete, non-continuous blasting process. The media blasting equipment is configured to position a wedge-type golf club head within a target area to be blasted with blast media guided by the one or more nozzles. The blast media is drawn from the blast media supply by means of the Bernoulli effect as the pressured air supply is directed through each nozzle, drawing the blast media into each nozzle by the differential in air pressure. The one or more nozzles are offset from the target wedge-type golf club head by a nozzle distance. The one or more nozzles oscillate during the blasting cycle, moving the center of the blast media effect across the strike face target surface. The one or more nozzles are positioned such that the stream of pressurized blast media impacts the wedge-type golf club head strike face surface at a blasting angle that varies throughout the oscillation. The air pressure is adjustable to control the velocity of the blast media as the blast media impacts the wedge-type golf club head strike face surface. The air pressure is engaged only during the controlled blasting cycle time.

The strike face 101 is blasted at a specified blasting pressure defined as the pressure exerted by the blast media against the strike face 101. The blasting pressure is dependent on the blasting media used, the nozzle distance, and the blasting angle. In some embodiments, the maximum blasting pressure can be less than or equal to 7.0 kg/cm2. If blasting pressure is too high, then Sa can exceed the USGA maximum value of 180 μin. A maximum blasting pressure of 7.0 kg/cm2 produces a Sa value within acceptable limits for wedge-type golf club heads comprising steel alloy materials (whether chrome plated, otherwise coated, or not coated). Lowering the blasting pressure reduces the Sa value in a generally linear manner, where the slope of linear relationship is determined by the strike face material. Club heads comprising other alloys and/or other coatings may require a different maximum blasting pressure. In some embodiments, the maximum blasting pressure can be less than 7.0 kg/cm2, less than 6.5 kg/cm2, less than 6.0 kg/cm2, less than 5.5 kg/cm2, less than 5.0 kg/cm2, less than 4.5 kg/cm2, less than 4.0 kg/cm2, less than 3.5 kg/cm2, less than 3.0 kg/cm2, less than 2.5 kg/cm2, less than 2.0 kg/cm2, less than 1.5 kg/cm2, or less than 1.0 kg/cm2.

Figure 10A:
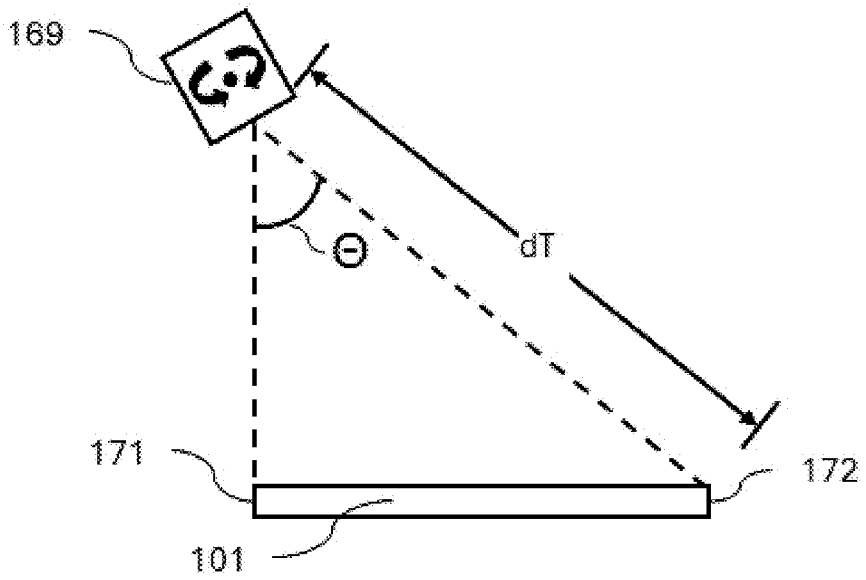
FIG. 10A illustrates a blasting setup used to create the surface band on a strike face.

As noted above, the one or more nozzles oscillate during the blasting cycle. A blasting angle Θ is measured as the interior angle between the orientation of the nozzle 169 and the strike face normal vector. A zero degree blasting angle Θ corresponds to a normal orientation between the nozzle 169 and the strike face 101, whereas the greater the blasting angle Θ, the more oblique the orientation between nozzle 169 and the strike face 101. In a first configuration, as illustrated in FIG. 10A, a strike face near edge 171 is positioned directly below the nozzle opening, wherein the nozzle opening is oriented perpendicular to the strike face 101. The blasting angle Θ is 0 degrees when the nozzle opening is directly oriented toward the strike face near edge 171. As the nozzle 169 oscillates, the blasting angle increases. The blasting angle Θ is approximately 35 degrees when the nozzle opening is directly oriented toward a strike face far edge 172, opposite the strike face near edge 171. The blasting angle influences the surface roughness produced by the media blasting. Specifically, when the angle is more oblique (i.e., moving from 0° to) 35°, the Sa and Sdq parameters increase, producing surfaces with shallower valleys (Bottom Ssk closer to 0). In an alternative configuration, illustrated in FIG. 10B, the strike face geometric center 110 is positioned directly below the nozzle opening, wherein the nozzle opening is oriented perpendicular to the strike face 101. In this arrangement, the blasting angle Θ varies between approximately −17.5 degrees and approximately +17.5 degrees throughout the blasting cycle. This is advantageous in that the blasting distance, discussed below, varies less during the blasting cycle.

A blasting distance dT is measured as the distance between the nozzle opening and the strike face 101 surface at any time during the blasting cycle. The blasting distance dT varies during the blasting cycle as the nozzle 169 oscillates (and the magnitude of the blasting angle Q increases). A larger blasting distance dT decreases the media impact force and density at the strike face surface, while increasing the media affected area. A smaller blasting distance increases the media impact force and density, while decreasing the media affected area. Thus, the resultant surface roughness can be partially controlled by increasing or decreasing the blasting distance dT. In some embodiments, the blasting distance varies between 10 cm and 13 cm during the blasting cycle to produce the desired surface roughness described above.

ii. Media Materials

Blasting media materials vary in composition. In some embodiments, the blasting media may be Emery™ media, Starblast™ media, Silicon Carbide, Aluminide Oxide, steel grit, steel shot, glass beads, or any other suitable blasting media. In some embodiments, the blasting media can comprise a Moh hardness between 3.0 to 10.0. In some embodiments, the blasting media can comprise an HRC hardness between 40 to 70 HRC. In some embodiments, any combination of one or more blasting media materials described above can be used. The blasting media can comprise a nominal size, representing the size of the blasting media prior to any blasting cycles. The blasting media nominal size may be between 60 mesh and 100 mesh or between 0.0130 inch diameter and 0.0025 inch diameter. In some embodiments, the blasting media nominal size may be between 60 mesh and 65 mesh, between 65 mesh and 70 mesh, between 70 mesh and 75 mesh, between 75 mesh and 80 mesh, between 80 mesh and 85 mesh, between 85 mesh and 90 mesh, between 90 mesh and 95 mesh, or between 95 mesh and 100 mesh. In other embodiments, the blasting media fractures in use and is reduced in size during use.

The blasting process can comprise one or more blasting cycles. In some embodiments, the blasting process can comprise one, two, three, four, five, or any suitable number of blasting cycles. Each blasting cycle can comprise a blasting cycle time defined as the duration of blast media striking the target surface. Longer blast cycle times will result in a more aggressive blasting. In some embodiments, the blasting cycle time can be between 5 seconds and 25 seconds. In other embodiments, the blasting cycle may be between 5 seconds and 7 seconds, between 7 seconds and 9 seconds, between 9 seconds and 11 seconds, between 11 seconds and 13 seconds, between 13 seconds and 15 seconds, between 15 seconds and 17 seconds, between 17 seconds and 19 seconds, between 19 seconds and 21 seconds, between 21 seconds and 23 seconds, or between 23 seconds and 25 seconds. More than one blasting media may be used during the blasting process. For instance, Emery™ media may be used for an initial blasting cycle and Aluminide Oxide may be used for a secondary blasting cycle. Any media may used in combination through more than one blasting cycle.

EXAMPLES

IV. Example 1: Exemplary Club Head Surface Spin Rate Vs. Control Club Head Surface Spin Rate Example 1 compares ball spin rates of wedge-type golf club heads with faces treated with two different types of blast media. An exemplary wedge-type golf club head was tested for ball spin performance against a control wedge-type golf club head. The exemplary club face and the control club face were milled to produce microgrooves at a roughness of 122 μin. The exemplary club face and the control club face then underwent a blasting treatment. The media used for the Control Club Head comprised an average particle size of ~10,000 μin, which produced a surface band roughness of 39 μin and an average composite roughness of 139 μin. The media used for the Exemplary Club Head comprised an average particle size of ~14,015 μin, and produced a surface band roughness of 50 μin and an average composite roughness of 144 μin. Therefore, the exemplary club head comprised a face with a surface band roughness higher than that of the control club head. All other dimensions and features were the same or similar throughout each club head.

Table 1 displays the spin rates experienced by the ball following contact with the golf club, in both wet and dry conditions, between the exemplary club head and the control club head. During testing, a cannon fired a golf ball against the surface of each golf club a number of times. The golf ball was fired at 85 MPH and both clubs were positioned at a 55 degree angle, to mimic conditions during regular play. The same test was carried out in both a dry setting and a wet setting. In the wet setting, the face was soaked with water five times prior to each impact and wiped clean following each impact. The golf ball spin rate was recorded following contact with the club surface and produced the results seen in Table 1.

TABLE 1

| | Exemplary Surface | Control Surface |
|---|---|---|
| Spin Rate (Dry) | 12,492 rpm | 12,408 rpm |
| Spin Rate (Wet) | 12,276 rpm | 8,571 rpm |

As illustrated in Table 1, in wet conditions, spin resulting from impact with the exemplary surface was much greater than spin resulting from impact with the control surface. In dry conditions, the exemplary surface exhibited maintenance or a slight increase in the high rate of spin shown by the control surface. Specifically, the exemplary surface produced 3,705 rpm more spin than the control surface in wet conditions, which is favorable to a golfer because it can increase control. Further, the difference between the spin rate in wet and dry conditions of the exemplary surface was only 216 rpm, meaning that the surface performed nearly identical in the changing conditions.

In conclusion, spin rates in wet conditions were found to be substantially greater in the Exemplary Club Head than in the Control Club Head. Therefore, the use of a greater media size resulted in an increase in spin rates in wet conditions, and overall more consistent spin rates between wet and dry conditions. This consistency in spin in both wet and dry conditions leads to increased predictability and allows the golfer to better gauge their shot. A similar feel and trajectory expectation means less room for error in either wet or dry playing conditions.

V. Example 2: Exemplary Club Head Spin Rate vs. Standard Club Head Spin Rate in Wet and Dry Conditions (Glide Forged)

Example 2 provides a comparison of ball spin rates and stat areas the same wedge-type golf club heads tested in Example 1. In this example, the golf clubs underwent player testing wherein golfers hit the ball and data was recorded. Table 2 displays the spin rates and stat areas for each of the exemplary and control golf clubs in wet and dry conditions.

Player testing was conducted to directly compare the performance of the exemplary club head and the control club head. Both clubs had a loft of 58 degrees, and the participants were directed to hit at a target 50 yards away. Shot data was collected using a Trackman launch monitor and both wet and dry conditions were tested. It was anticipated that the exemplary golf club would perform better in the wet conditions, with similar results in a dry environment.

TABLE 2

| | Exemplary Golf Club | Control Golf Club |
|---|---|---|
| Spin Rate (Dry) | 7,199 rpm | 6,682 rpm |
| Stat Area (Dry) | 108 $yd^2$ | 102 $yd^2$ |
| Spin Rate (Wet) | 5,465 rpm | 4,952 rpm |
| Stat Area (Wet) | 81 $yd^2$ | 110 $yd^2$ |

Illustrated in Table 2, the exemplary club head produced more spin in both the dry and wet conditions. As shown in the table, spin rates were found to be substantially less in both wet and dry conditions during player testing, when compared with those measured in air cannon testing as shown in Example 1. This is because the impact is occurring at a lower speed, and variation due to differences in golfer's abilities is expected. In dry testing, the exemplary club head produced an average spin of 7,199 rpm, while the control golf club spun 6,682 rpm on average. This difference of 517 rpm gives the golfer better control at stopping the golf ball nearer a target. In wet conditions, the exemplary golf club spun 5,465 rpm compared to 4,952 rpm for the control golf club, an increase of 513 rpm of spin. As stated above, increased spin allows for more control of golf shots. The statistical area (stat area) is a measure of accuracy and control, by quantifying the dispersion of the participants' shots. In the dry test, both the exemplary club and control club had relatively similar stat areas. A significant improvement was seen in the wet testing, wherein the exemplary club produced an 81 $yd^2$ stat area and the control club had a 110 $yd^2$ stat area. A nearly 30 $yd^2$ improvement is notable for shorter wedge shots, as accuracy with these shots is important for golfers.

In conclusion, spin rates in wet conditions were found to be substantially greater in the Exemplary Club Head than in the Control Club Head. Therefore, the use of a greater media size resulted in an increase in spin rates in wet conditions, and overall more consistent spin rates between wet and dry conditions. As a result, the Exemplary Club Heads shower improved predictability, reducing error and increasing control.

VI. Example 3: Comparison of Spin Retention of Five Exemplary Club Heads and Two Control Club Heads Example 3 provides a comparison of spin retention values (a difference of wet and dry spin rates) between wedge-type golf club heads treated with various blasting media. Example 3 illustrates comparative results between four exemplary golf club heads (hereafter referred to as "Exemplary Club Head 1, Exemplary Club Head 2, Exemplary Club Head 3, Exemplary Club Head 4, and Exemplary Club Head 5") and two control golf club heads (hereafter referred to as "Control Club Head 1" and "Control Club Head 2"). Each of the five exemplary club heads and the control club heads were constructed using the same materials and methods, and only varied in the strike face treatment. The face of each Exemplary Club Head received the same fly-cut milling, followed by groove engraving and chrome plating. The face portion of each club head was separated from the rest of the club head, so that physical properties of the constructed club head could be held constant. Only the face portions were used for testing. Each Exemplary Club Head was treated with a blasting step following chrome plating, the blasting media varying among the club heads. Exemplary Club Head 1 comprised a strike face that was blasted with a mineral-based media having a Mohs hardness of 7.5-8.5, an average grit size of 483 microns, a minimum grit size of 305 microns, and a maximum grit size of 762 microns. Exemplary Club Head 2 comprised a strike face that was blasted with a larger size of the same mineral-based media of Exemplary Club Head 1, having an average grit size of 356 microns, a minimum grit size of 241 microns, and a maximum grit size of 559 microns. Exemplary Club Head 3 comprised a strike face that was blasted with a mineral-based media having a Mohs hardness of 6.5-7.0, an average grit size of 145 microns, a minimum grit size of 89 microns, and a maximum grit size of 241 microns. Exemplary Club Head 4 comprised a strike face that was blasted with two media-a first media having an average grit size of 254 microns, a minimum grit size of 165 microns, and a maximum grit size of 406 microns, and the second media being that of Exemplary Club Head 3. Control Club Head 1 comprised a strike face that was identical to the strike faces of the Exemplary Club Heads, but did not include any blasting. Control Club Head 2 comprised a strike face that was identical to the strike faces of the Exemplary Club Heads, but did not include any milling. The surface profiles of Control Club Head 1 and Control Club Head 2 can be seen in FIGS. 19A-19B and 20A-20B, respectively.

Each face was struck at various plate angles with golf balls fired at 80 mph, in an air cannon, in both wet and dry conditions. In wet condition testing, the wedge-type golf club head and the ball were drenched with water prior to each impact. The plate angles measured ranged between 45 and 60 degrees, covering a range of loft angles that is common in wedge-type golf club heads. The spin rate of the golf ball was recorded following impact and can be seen in Table 3, below.

TABLE 3

| | | Spin Rates (rpm) | | | | | | |
|---|---|---|---|---|---|---|---|---|
| Plate Angle (degrees) | Conditions | Control Club Head 1 | Control Club Head 2 | Exemplary Club Head 1 | Exemplary Club Head 2 | Exemplary Club Head 3 | Exemplary Club Head 4 | Exemplary Club Head 5 |
| 45 | Dry | 9366 | 8591 | 8222 | 8421 | 8702 | 8429 | 8332 |
| | Wet | 5944 | 9989 | 9533 | 9649 | 9805 | 9639 | 9641 |
| 50 | Dry | 10567 | 9908 | 9620 | 9745 | 9550 | 9674 | 9674 |
| | Wet | 5352 | 11067 | 10962 | 10945 | 10946 | 10958 | 10823 |

TABLE 3-continued

| Plate Angle (degrees) | Conditions | Spin Rates (rpm) Control Club Head 1 | Control Club Head 2 | Exemplary Club Head 1 | Exemplary Club Head 2 | Exemplary Club Head 3 | Exemplary Club Head 4 | Exemplary Club Head 5 |
|---|---|---|---|---|---|---|---|---|
| 55 | Dry | 11464 | 10608 | 11266 | 11004 | 11145 | 10895 | 10643 |
| | Wet | 4729 | 11660 | 11910 | 11786 | 11565 | 11512 | 11487 |
| 60 | Dry | 12567 | 12072 | 12433 | 12461 | 12257 | 12408 | 12387 |
| | Wet | 4378 | 8975 | 11655 | 12000 | 11310 | 11467 | 11361 |

As summarized in the Table 3, spin rates in wet conditions of the Exemplary Club Heads showed significant improvement, especially at greater plate angles, over the Control Club Head. At a 45 degree plate angle in wet conditions, the Exemplary Club Head spin rates were between 60.4% and 65% greater than that of the Control Club Head. At a 50 degree plate angle in wet conditions, the Exemplary Club Head spin rates were between 102.2% and 104.8% greater than that of the Control Club Head. At a 55 degree plate angle in wet conditions, the Exemplary Club Head spin rates were between 142.9% and 151.9% greater than that of the Control Club Head. At a 60 degree plate angle in wet conditions, the Exemplary Club Head spin rates were between 158.3% and 174.1% greater than that of the Control Club Head.

The spin rates of the Exemplary Club Heads in dry conditions were substantially similar to the Control Club Head. Specifically, in dry conditions, all Exemplary Club Head spin rates remained within between 0.84% and 12.2% of the control, showing greater spin rates at higher loft angles, similar to the wet condition spin rates. At a 45 degree loft angle in dry conditions, the Exemplary Club Head spin rates were within 12.2% of that of the Control Club Head. At a 50 degree loft angle in dry conditions, the Exemplary Club Head spin rates were within 9.6% of that of the Control Club Head. At a 55 degree loft angle in dry conditions, the Exemplary Club Head spin rates were within 5.0% of that of the Control Club Head. At a 60 degree loft angle in dry conditions, the Exemplary Club Head spin rates were within 2.5% of that of the Control Club Head. The gaps defined by the differences in spin rate between wet and dry conditions are discussed in detail in Example 4, below.

In conclusion, the Exemplary Club Heads exhibited significantly increased spin rates in wet conditions. Therefore, the size and hardness of blasting media were found to greatly impact spin rates in wet conditions and.

VII. Example 4: Comparison of Spin Retention of Exemplary Golf Club Heads and a Control Golf Club Head Example 4 provides a comparison of spin retention values between wedge-type golf club heads treated with various blasting media. Spin retention is defined in this example as the quotient of the spin rate in wet conditions and the spin rate in dry conditions, displayed as a percentage. Example 4 illustrates comparative results between four exemplary golf club heads (hereafter referred to as "Exemplary Club Head 1, Exemplary Club Head 2, Exemplary Club Head 3, Exemplary Club Head 4, and Exemplary Club Head 5") and one control golf club head (hereafter referred to as "Control Club Head 1"). These golf club heads comprised the same properties as those of the same names in Example 3.

Each club head was struck at various angles with golf balls fired at 80 mph in an air cannon in both wet and dry conditions. In wet condition testing, the wedge-type golf club head and the ball were drenched with water prior to each impact. The spin retention was calculated by dividing the spin rate in wet conditions by the spin rate in dry conditions for each Exemplary Club Head and Control Club Head 1. These values are displayed in FIG. 21A. The spin retention for each Exemplary Club Head relative to Control Club Head 1 is depicted in FIG. 21B. These charts show substantial increases in spin retention for all of the Exemplary Club Heads, with respect to the Control Club Head.

Figure 21A:
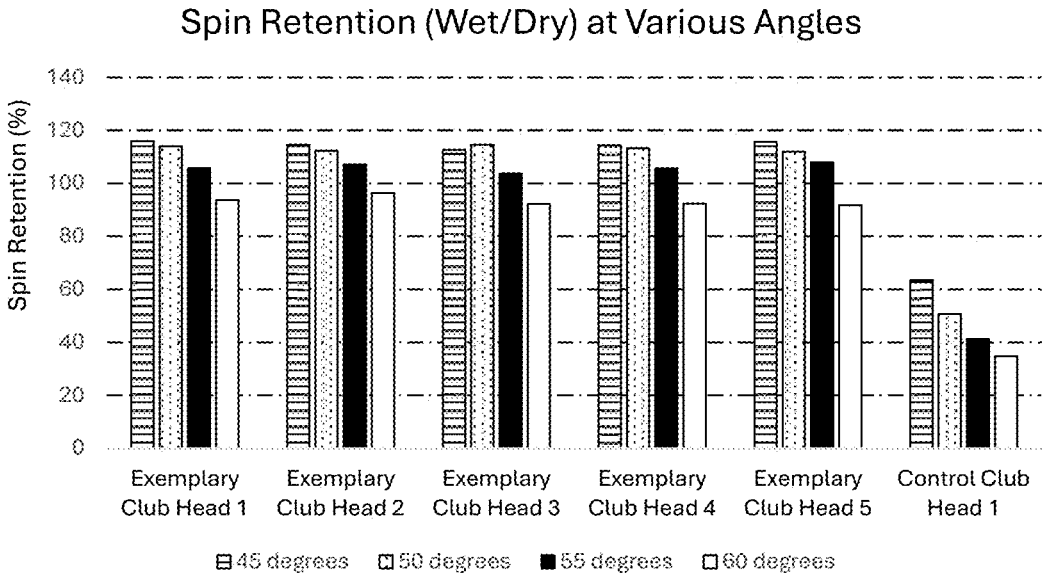
FIG. 21A illustrates wet/dry spin retention percentage for exemplary wedge-type golf club heads at various loft angles.
Figure 21B:
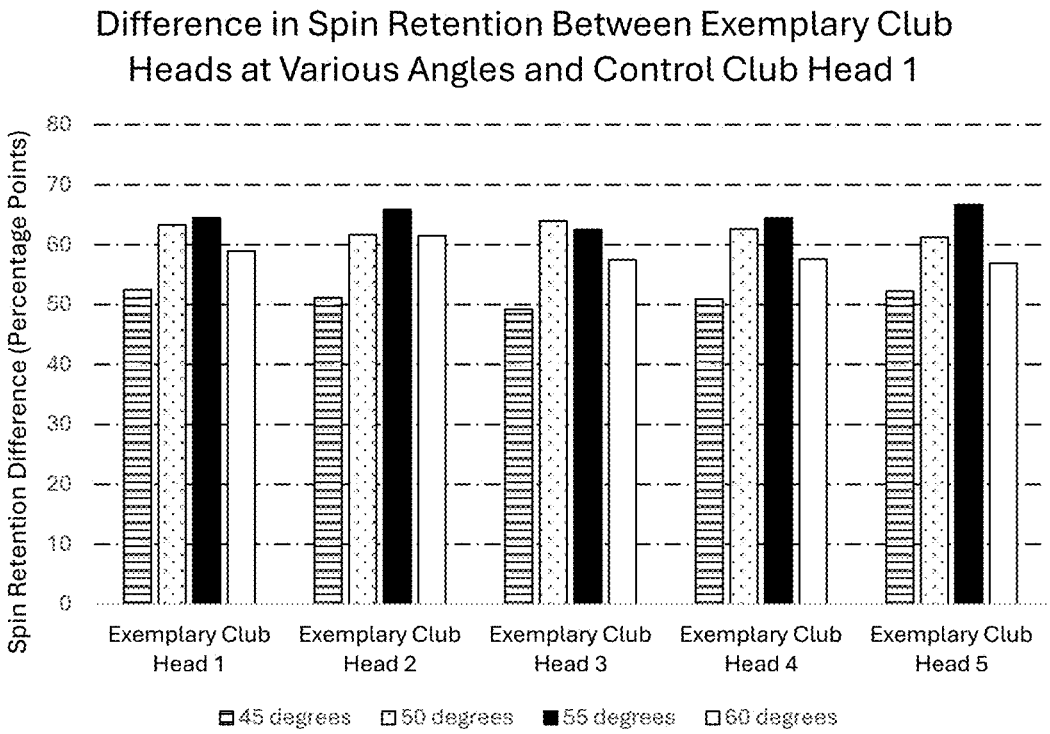
FIG. 21B illustrates the wet/dry spin retention difference for exemplary wedge-type golf club heads at various loft angles.

Referring to FIG. 21A, spin rates in wet conditions at most angles are greater than the spin rates in dry conditions for each of the Exemplary Club Heads (indicated by spin retention being above 100%). Specifically, at 45 degrees, 50 degrees, and 55 degrees, the spin retention is between 105.7% and 116% for Exemplary Club Head 1, between 107.1% and 114.6% for Exemplary Club Head 2, between 103.8% and 114.6% for Exemplary Club Head 3, between 105.7% and 114.4% for Exemplary Club Head 4, and between 107.9% and 115.7% for Exemplary Club Head 5. At 60 degrees, spin retention for all Exemplary Club Heads measured between 91.7% and 96.3%.

Control Club Head 1, however exhibited spin rates in wet conditions that were substantially lower than spin rates in dry conditions at each angle. At 45 degrees, spin retention of Control Club Head 1 was 63.5%, at 50 degrees, spin retention of Control Club Head 1 was 50.7%, at 55 degrees, spin retention of Control Club Head 1 was 41.25%, and at 60 degrees, spin retention of Control Club Head 1 was 34.8%. Therefore, for Control Club Head 1, spin rates in wet conditions were never more than 63.5% of spin rates in dry conditions.

The Exemplary Club Heads exhibited substantially greater consistency in spin rate between wet and dry conditions, thereby reducing differences in feel and performance due to environmental conditions, regardless of plate angle. Variation in spin retention based on plate angle for each Exemplary Club Head is reduced, relative to that of Control Club Head 1. The spin retention of all of the Exemplary Club Heads was found to be between 91.7% and 116% at any of the angles measured. Therefore, the spin rate in wet conditions of the Exemplary Club Heads remained within 16% of the spin rate in dry conditions, across all plate angles. In contrast, the spin retention of Control Club Head 1 was found to be between 34.8% and 63.5% at any of the angles measured. Therefore, the spin rate in wet conditions of Control Club Head 1 varied from the spin rate in dry conditions by up to 65.2% of the spin rate in dry conditions.

Referring to FIG. 21B, at each angle, every Exemplary Club Head exhibits a significant increase in spin retention over Control Club Head 1. Specifically, spin retention was increased by up to 67% when the blasting treatment methods and blasting media materials of the Exemplary Club Heads were applied to the face. This increase in spin retention indicates a substantial improvement in spin rate in wet conditions resulting directly from the blasting treatment used in accordance with the grooves and milling.

In conclusion, the Exemplary Club Heads showed significantly improved consistency between spin rates in wet and dry conditions. This consistency remained notable across all tested plate angles. The Exemplary Club Heads exhibit predictable spin rates in wet conditions that are comparable to those in dry conditions, in stark contrast to the results of the Control Club Head.

VIII. Example 5: Comparison of Spin Rate Difference in Wet and Dry Conditions of Exemplary Golf Club Heads and Control Golf Club Heads Example 5 provides a comparison of spin rate differences between wet and dry conditions of several wedge-type golf club heads treated with various blasting media. Spin rate difference describes the gap between spin rate in wet conditions and spin rate and dry conditions and is defined in this example as an absolute value of the difference of the spin rate in wet conditions and the spin rate in dry conditions. Example 5 illustrates comparative results between four exemplary golf club heads (hereafter referred to as "Exemplary Club Head 1, Exemplary Club Head 2, Exemplary Club Head 3, Exemplary Club Head 4, and Exemplary Club Head 5") and two control golf club head (hereafter referred to as "Control Club Head 1" and "Control Club Head 2"). These golf club heads comprised the same properties as those of the same names in Example 3.

Each club head was struck at various angles with golf balls fired at 80 mph in an air cannon in both wet and dry conditions. In wet condition testing, the face was drenched with water five times prior to each impact and wiped clean following each impact. The spin rate of the golf ball following impact with the face was recorded and calculations based on those recorded values are displayed in FIGS. 22A and 22B.

Figure 22A:
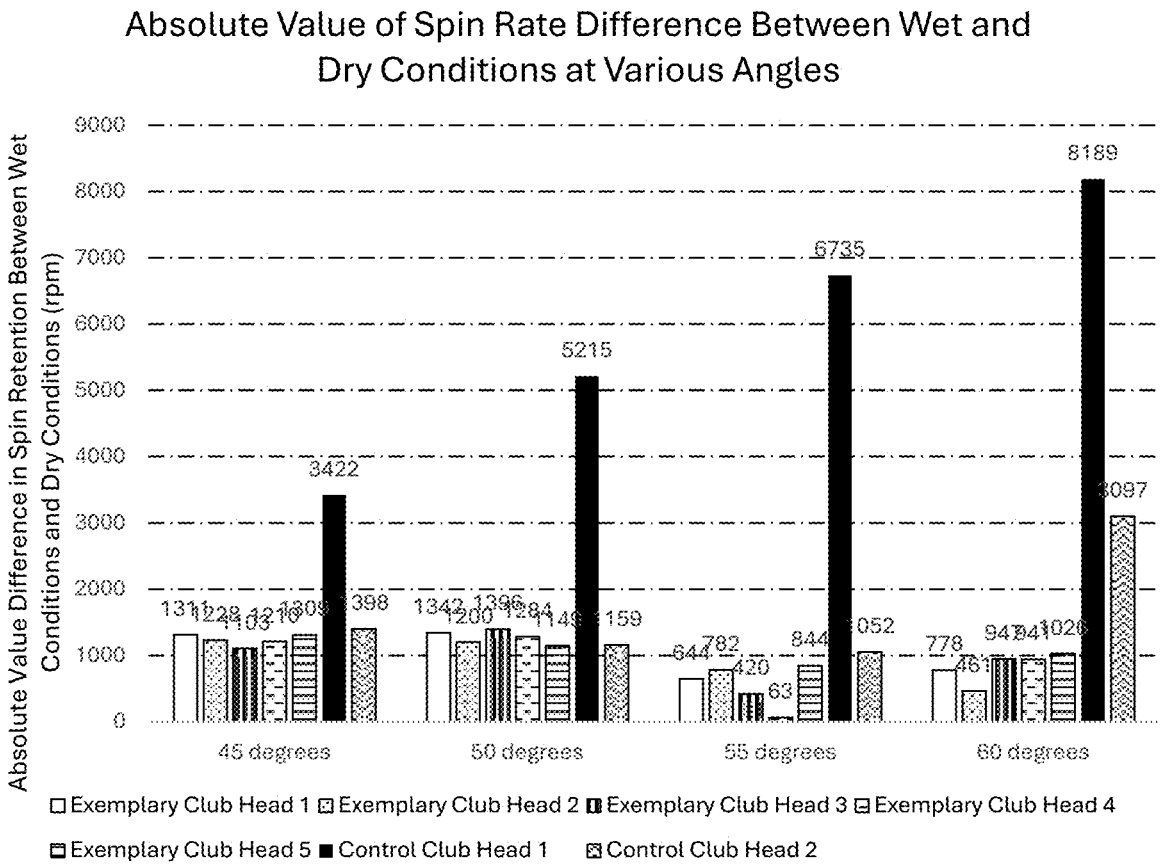
FIG. 22A illustrates the absolute value of spin rate difference between wet and dry conditions for exemplary wedge-type golf club heads at various loft angles.
Figure 22B:
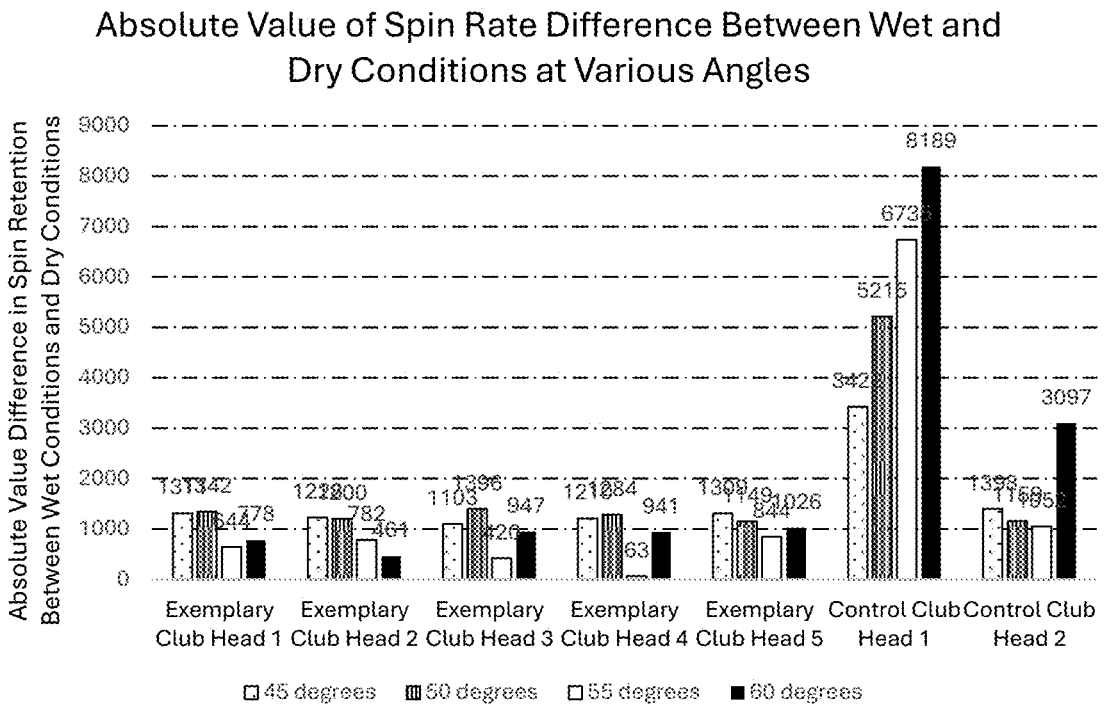
FIG. 22B illustrates an additional graph of the absolute value of spin rate difference between wet and dry conditions for exemplary wedge-type golf club heads at various loft angles

FIGS. 22A and 22B display the absolute value of the calculated differences between spin rate measurements recorded in wet conditions and spin rate measurements recorded in dry conditions. This chart visually depicts the extent that the spin rate in wet conditions varied from the spin rate in dry conditions. It is desirable to reduce this difference in order to create similar spin in both wet and dry conditions, thereby making the resulting shot more predictable, regardless of environmental conditions.

FIG. 22A categorizes results by angle of the plate relative to the direction which the ball was launched, showing variation in the spin rate gap across tested club heads, at each plate angle.FIG. 22B clusters results by wedge-type golf club head, showing variation in the spin rate gap across plate angles for each tested club head. Referring to FIG. 22A, the gap between spin rates in wet and dry conditions of the Exemplary Club Heads remained fairly consistent across all angles. As a result, the reduced variation in spin rates based on the environment was predictable regardless of loft angle. However, the gap was found to be significantly less predictable for the Control Club Heads.

The gaps between spin rates in wet and dry conditions of Exemplary Club Head 1 remained within 568 rpm of one another. The gaps between spin rates in wet and dry conditions of Exemplary Club Head 2 remained within 767 rpm of one another. The gaps between spin rates in wet and dry conditions of Exemplary Club Head 3 remained within 976 rpm of one another. The gaps between spin rates in wet and dry conditions of Exemplary Club Head 4 remained within 1221 rpm of one another. The variation in these gaps across angles was found to be substantially greater in the Control Club Heads. The gaps between spin rates in wet and dry conditions of Control Club Head 1 remained within 4767 rpm of one another. The gaps between spin rates in wet and dry conditions of Exemplary Club Head 2 remained within 2045 rpm of one another.

FIG. 22B shows that the difference in spin rates in wet and dry conditions is substantially smaller in each of the Exemplary Club Heads than in the Control Club Heads. The gaps remain below 1400 rpm for all Exemplary Club Heads, at all measured angles. The Control Club Heads, however, show gaps in spin rates that extend up to 8189 rpm for Control Club Head 1 and up to 3097 for Control Club Head 2. It can also be noted that the gaps are substantially greater in Control Club Head 1 than in Control Club Head 2, indicating that blasting has a much greater effect on improving spin retention than milling.

FIG. 22B further illustrates that media within the hardness and size ranges of Exemplary Club Heads 1-5, in combination with the coating and milling, result in somewhat similar spin rate gaps. There are only minor differences in the spin rate wet/dry gaps across the media sizes used in the Exemplary Club Heads. However, when surface conditions are moved outside of these ranges, as shown by Control Club Head 1 and Control Club Head 2, the gaps become substantially larger. Therefore, the Control Club Heads, which lacked the blasting treatment within the pre-specified ranges, became much less predictable in wet conditions.

In conclusion, the gaps in spin rate between wet and dry conditions were minimized when the blasting treatment as described herein was applied to the face. The Exemplary Club Heads show improved performance in wet conditions and improved predictability between wet and dry conditions when compared with Control Club Heads that did not comprise the same combination of blasting and milling.

IX. Example 6: Comparison of Ball Speed of Exemplary Golf Club Heads and Standard Golf Club Head Example 6 provides a comparison of ball speed in wet and dry conditions of several wedge-type golf club heads treated with various blasting media. Spin rate difference describes the gap between spin rate in wet conditions and spin rate and dry conditions and is defined in this example as an absolute value of the difference of the spin rate in wet conditions and the spin rate in dry conditions. Example 6 illustrates comparative results between four exemplary golf club heads (hereafter referred to as "Exemplary Club Head 1, Exemplary Club Head 2, Exemplary Club Head 3, Exemplary Club Head 4, and Exemplary Club Head 5") and two control golf club head (hereafter referred to as "Control Club Head 1" and "Control Club Head 2"). These golf club heads comprised the same properties as those of the same names in Example 3.

Each club head was struck at various angles with golf balls fired at 80 mph in an air cannon in both wet and dry conditions. In wet condition testing, the face was drenched with water five times prior to each impact and wiped clean following each impact. The ball speed of the golf ball immediately following impact with the strike face was recorded and can be seen in Table 4, below.

TABLE 4

| Plate Angle (degrees) | | Ball Speed (mph) | | | | | | |
|---|---|---|---|---|---|---|---|---|
| | | Control Club Head 1 | Control Club Head 2 | Exemplary Club Head 1 | Exemplary Club Head 2 | Exemplary Club Head 3 | Exemplary Club Head 4 | Exemplary Club Head 5 |
| 45 | Dry | 80.3 | 80.0 | 80.0 | 80.4 | 80.3 | 80.0 | 80.0 |
| | Wet | 80.3 | 80.4 | 80.3 | 80.1 | 80.3 | 79.9 | 80.1 |
| 50 | Dry | 79.9 | 79.8 | 80.1 | 80.2 | 80.2 | 80.3 | 80.3 |
| | Wet | 80.4 | 80.4 | 80.1 | 80.1 | 80.3 | 80.5 | 80.3 |
| 55 | Dry | 79.8 | 79.8 | 80.2 | 80.2 | 80.4 | 80.3 | 80.3 |
| | Wet | 79.8 | 79.9 | 80.2 | 80.1 | 79.8 | 80.3 | 80.5 |
| 60 | Dry | 80.0 | 80.0 | 80.2 | 80.1 | 79.9 | 80.3 | 80.3 |
| | Wet | 80.0 | 80.0 | 80.1 | 79.9 | 80.0 | 80.0 | 80.2 |

Referring to Table 4 above, ball speed in both wet and dry conditions is retained in all of the Exemplary Club Heads. At each loft angle, in wet conditions, the ball speed of any given Exemplary Club Head is within 0.87% of the ball speed of the Control Club Head. At each loft angle, in dry conditions, the ball speed of any given Exemplary Club Head is within 0.5% of the ball speed of the Control Club Head. These minor differences in ball speed are not statistically significant and can be attributed to expected testing variation. In conclusion, the strike face treatments of the Exemplary Club Head improved spin in wet conditions (see Example 3) while maintaining ball speed.

X. Example 7: Comparison of Surface Parameters of Exemplary Club Heads, Prior Art Club Heads, and a Control Club Head Example 7 provides a comparison of skewness values for wedge-type golf club heads that were blasted with various media. Example 7 illustrates comparative results between four exemplary wedge-type golf club heads (hereafter referred to as "Exemplary Club Head 1, Exemplary Club Head 2, Exemplary Club Head 3, Exemplary Club Head 4") and a control wedge-type golf club head (hereafter referred to as "Control Club Head"). Example 7 illustrates comparative results between four exemplary golf club heads (hereafter referred to as "Exemplary Club Head 1, Exemplary Club Head 2, Exemplary Club Head 3, Exemplary Club Head 4, and Exemplary Club Head 5"), one control golf club head (hereafter referred to as "Control Club Head 3"), and four prior art golf club head (hereafter referred to as "Prior Art Club Head 1", "Prior Art Club Head 2", "Prior Art Club Head 3", and "Prior Art Club Head 4"). These golf club heads comprised the same properties as those of the same names in Example 3.

Control Club Head 3 comprised a face identical to that of Exemplary Club Heads 1-5 in many ways, but was blasted with a media having a Mohs hardness of around 9, an average grit size of 50 microns, a minimum grit size of 25 microns, and a maximum grit size of 85 microns.

Figure 11A:
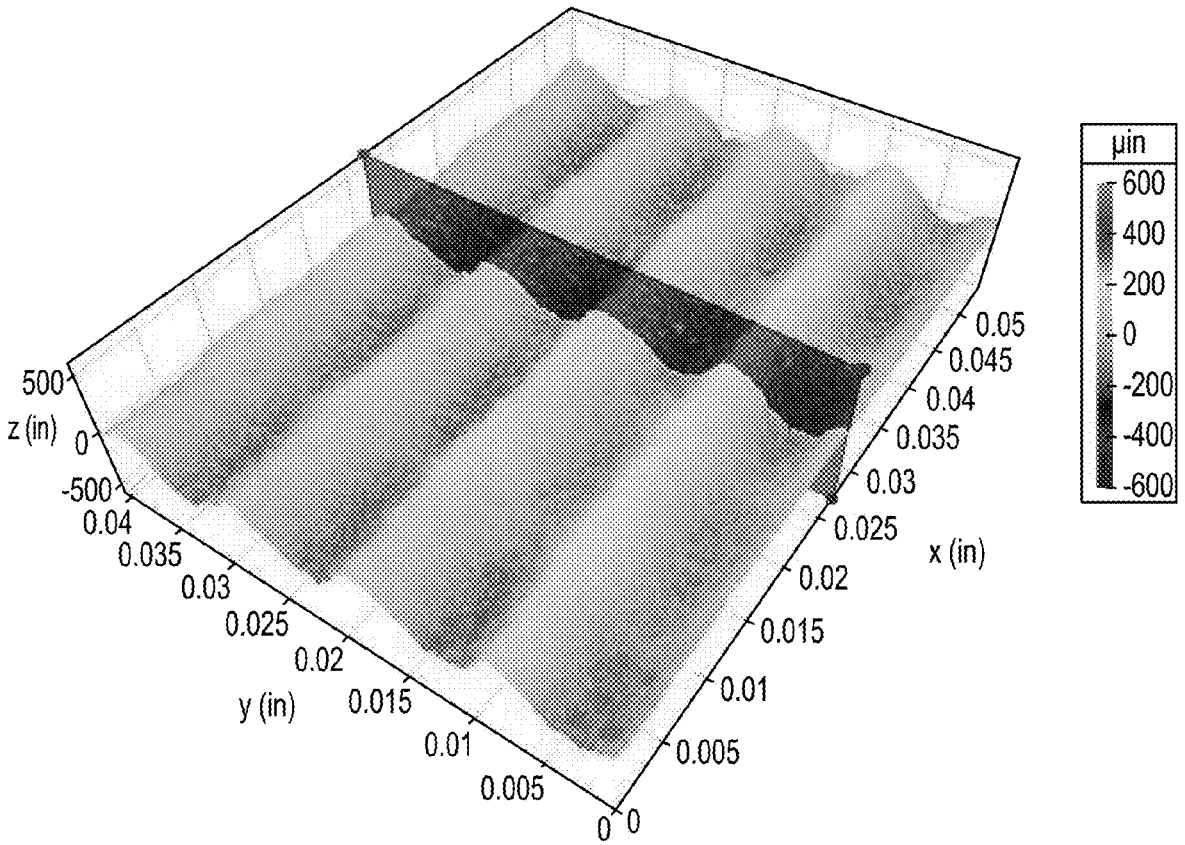
FIG. 11A illustrates a color 3D surface scan of the composite band of prior art club 1.
Figure 11B:
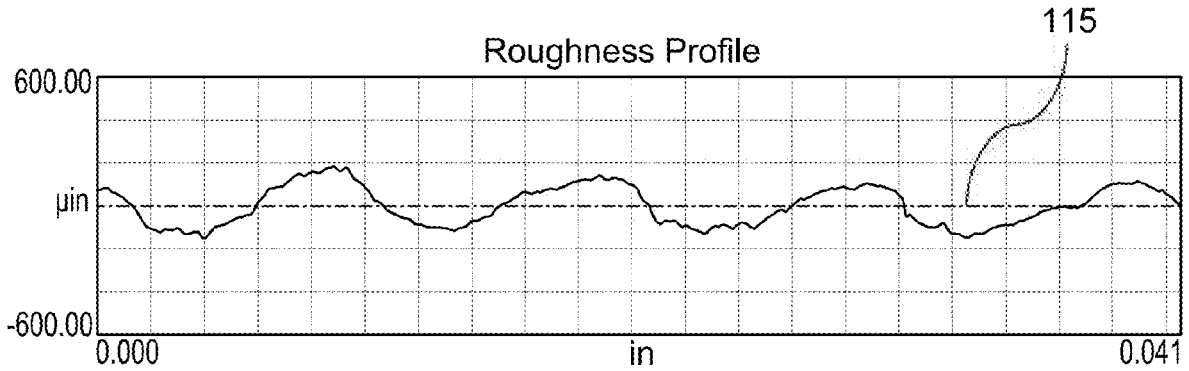
FIG. 11B illustrates a 2D cross-section of the composite band, via the surface scan of FIG. 11A.
Figure 12A:
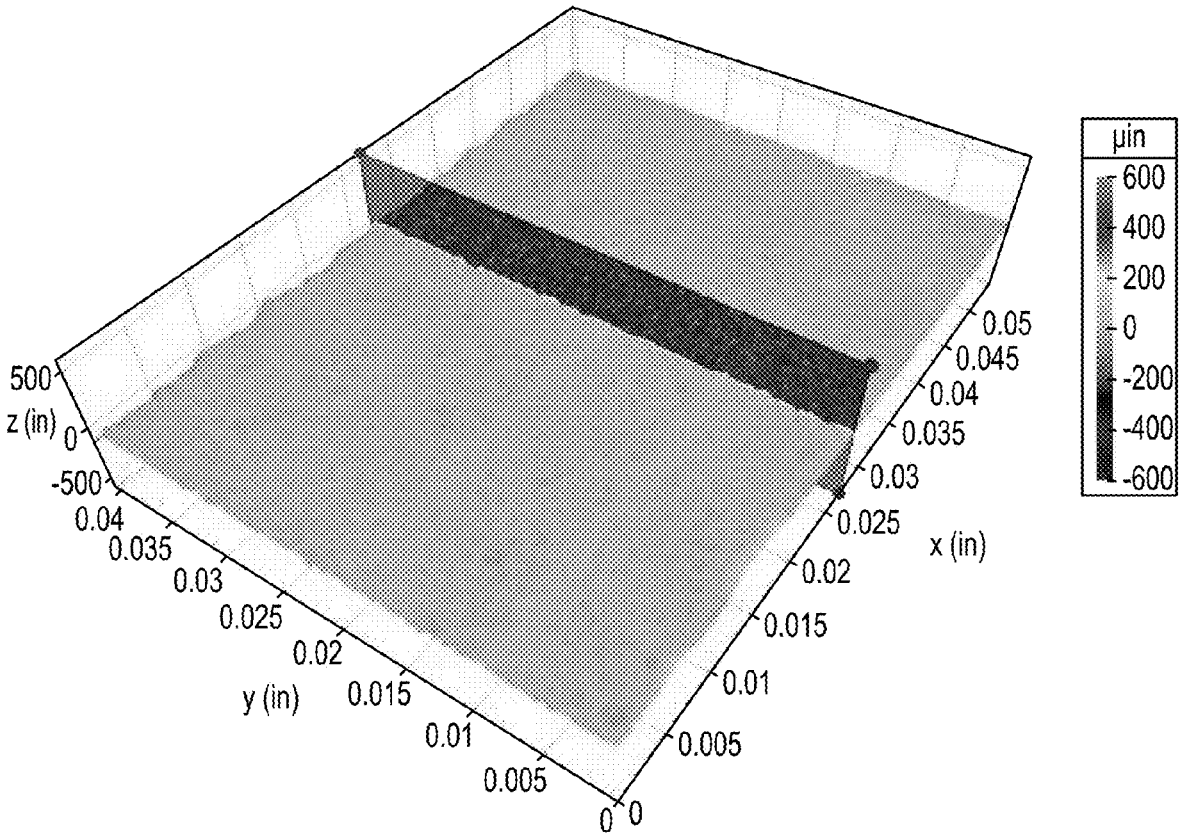
FIG. 12A illustrates a color 3D model of the surface band after filtering out the milling band from FIG. 11A.
Figure 12B:
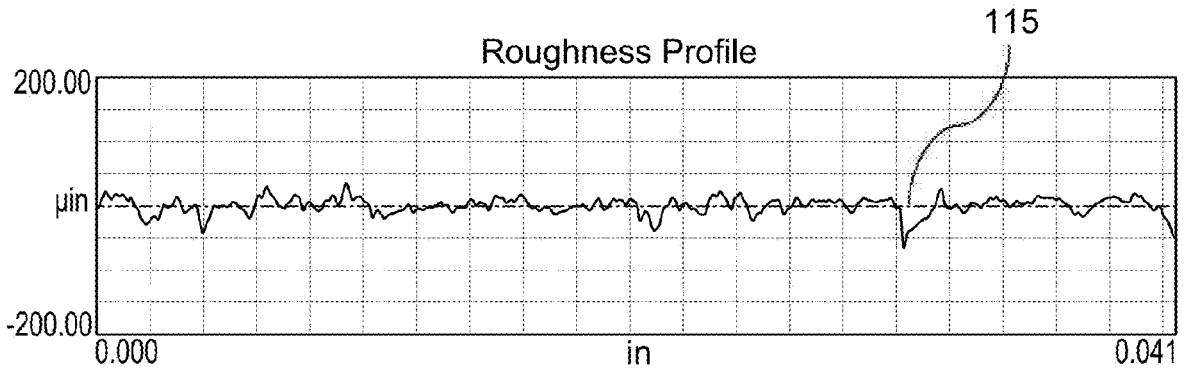
FIG. 12B illustrates a 2D cross-section of the surface band in FIG. 12A.
Figure 13A:
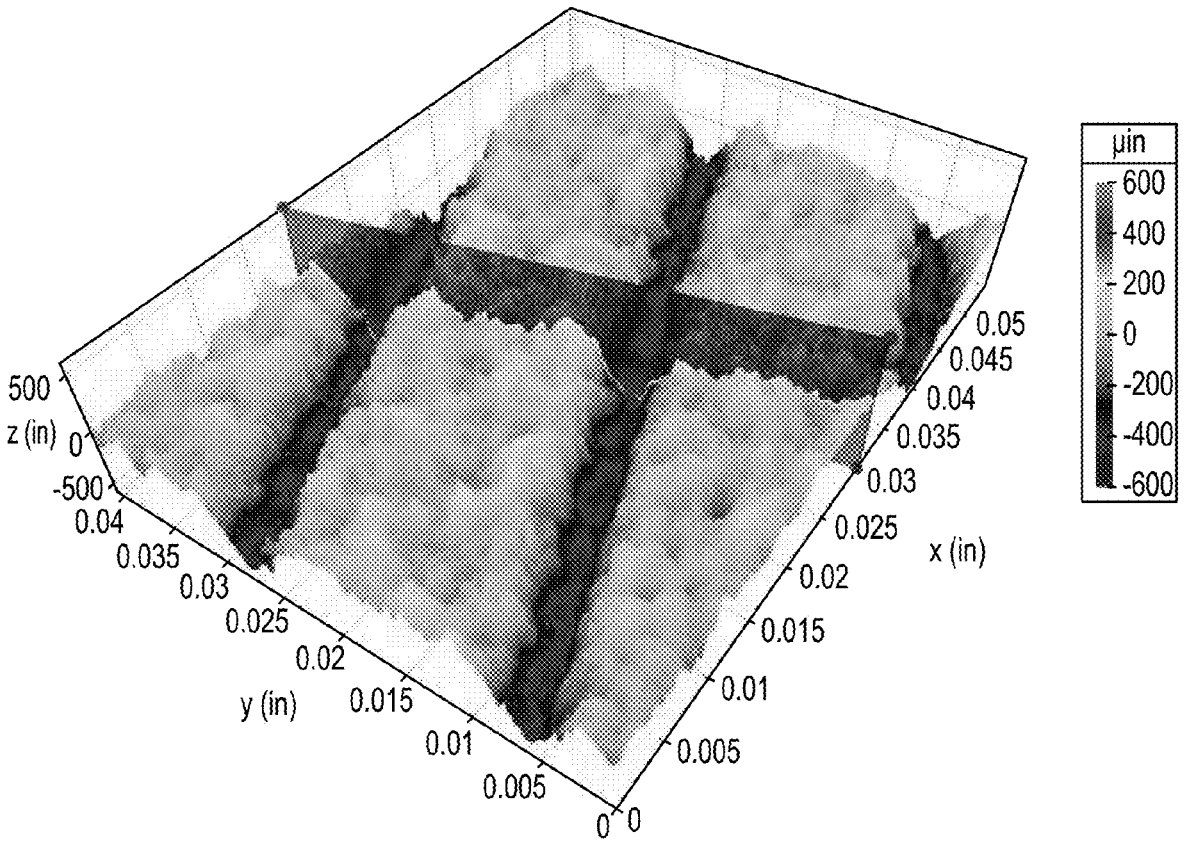
FIG. 13A illustrates a color 3D surface scan of the composite band of prior art club 2.
Figure 13B:
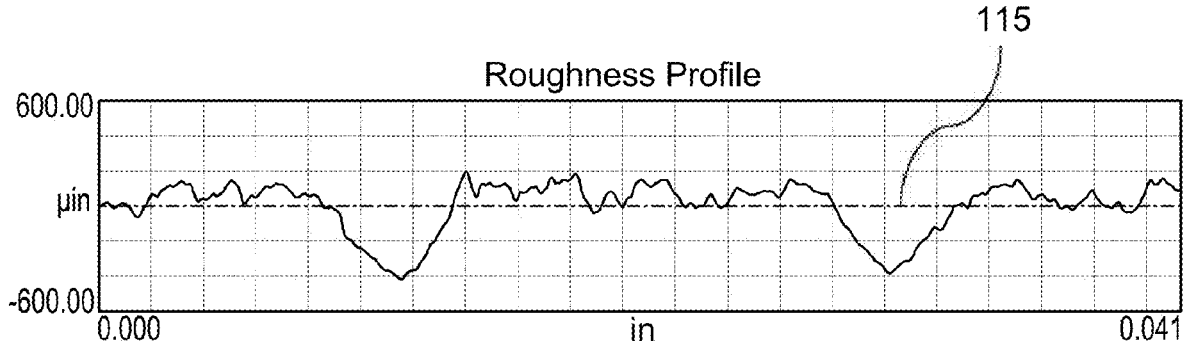
FIG. 13B illustrates a 2D cross-section of the composite band, via the surface scan of FIG. 13A.
Figure 14A:
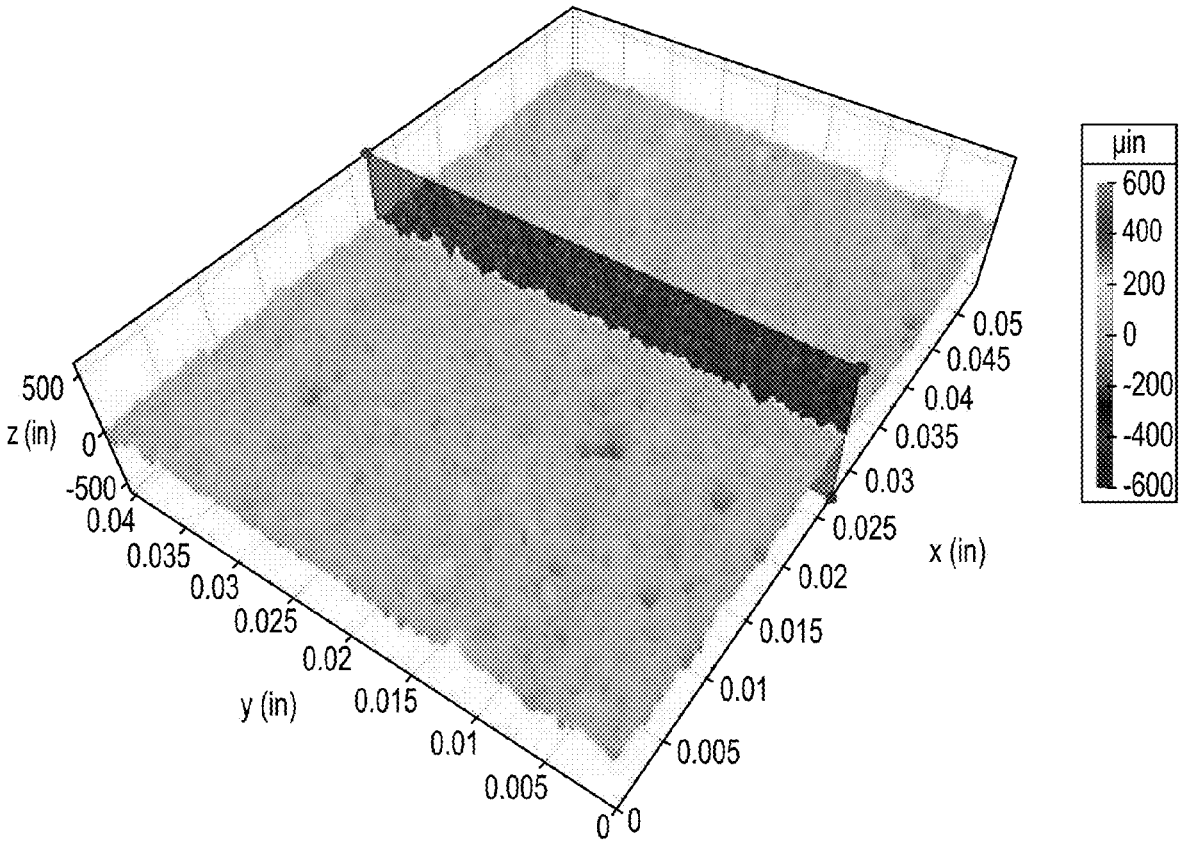
FIG. 14A illustrates a color 3D model of the surface band after filtering out the milling band from FIG. 13A.
Figure 14B:
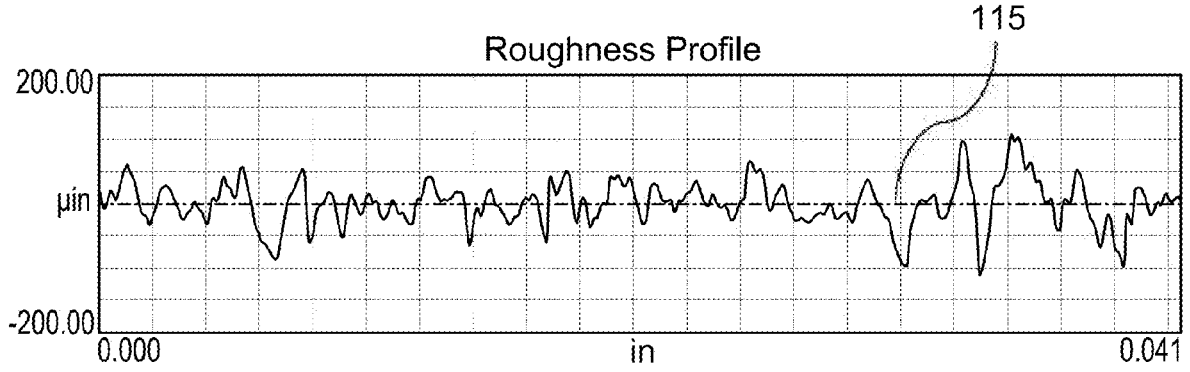
FIG. 14B illustrates a 2D cross-section of the surface band in FIG. 14A.
Figure 15A:
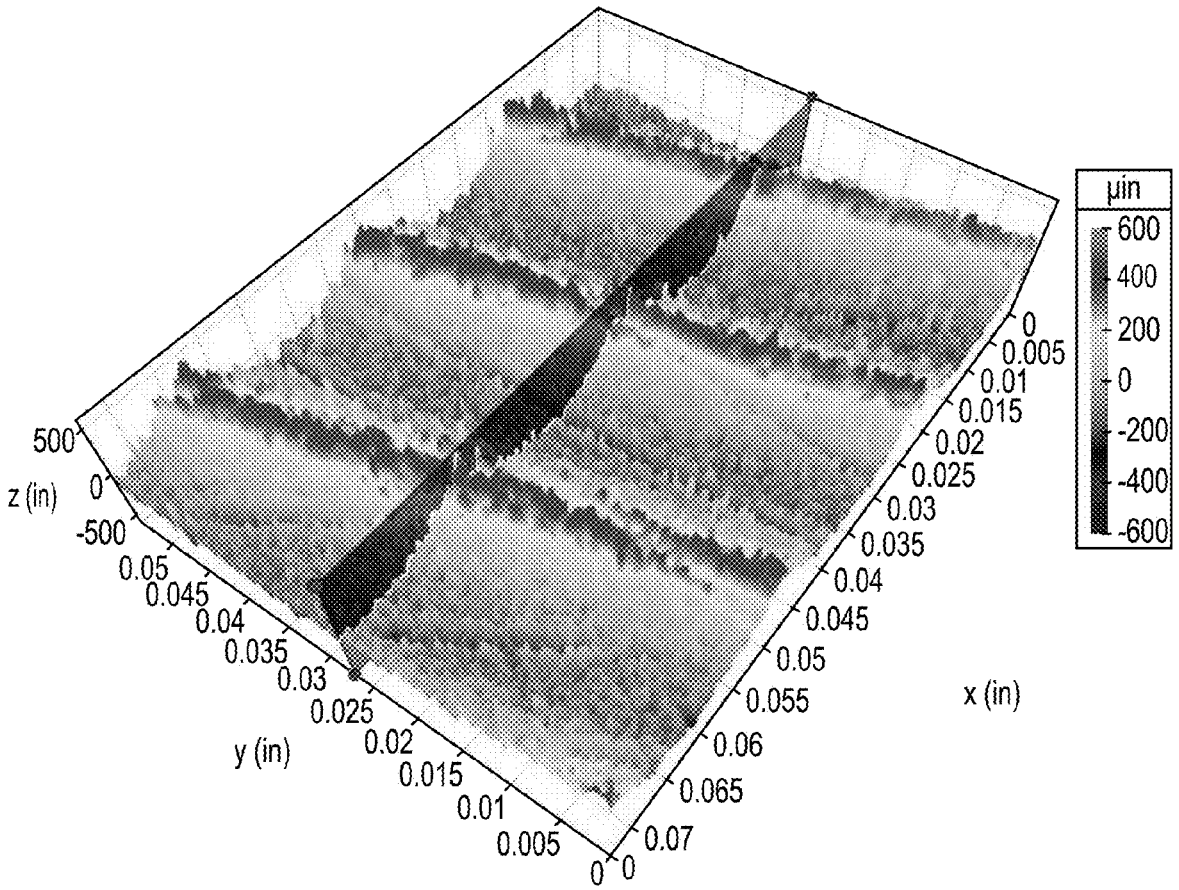
FIG. 15A illustrates a color 3D surface scan of the composite band of prior art club 3.
Figure 15B:
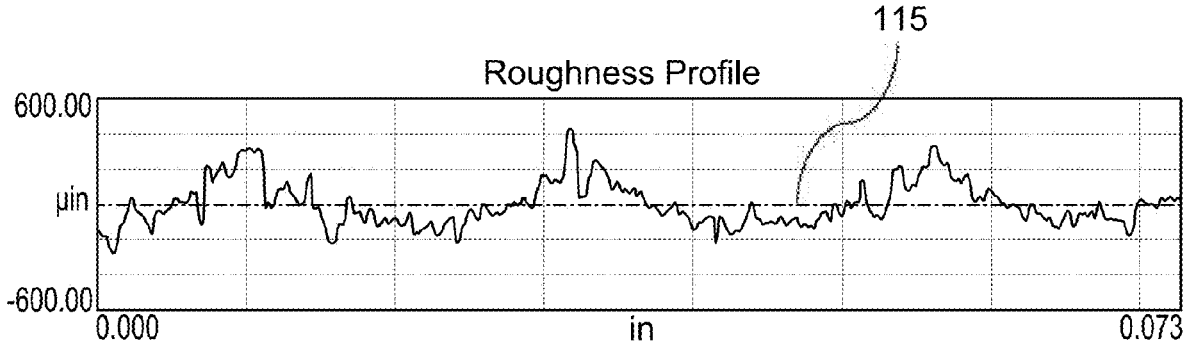
FIG. 15B illustrates a 2D cross-section of the composite band, via the surface scan of FIG. 15A.
Figure 16A:
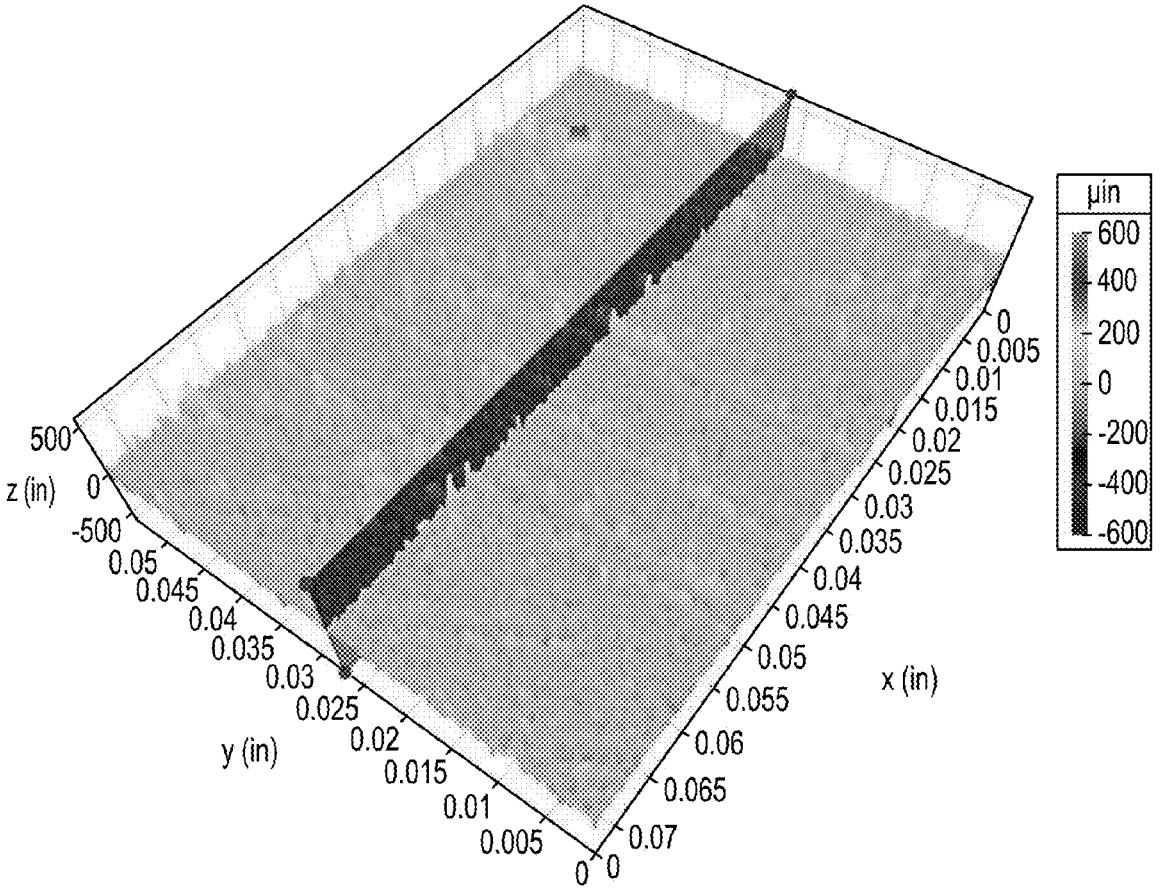
FIG. 16A illustrates a color 3D model of the surface band after filtering out the milling band from FIG. 15A.
Figure 16B:
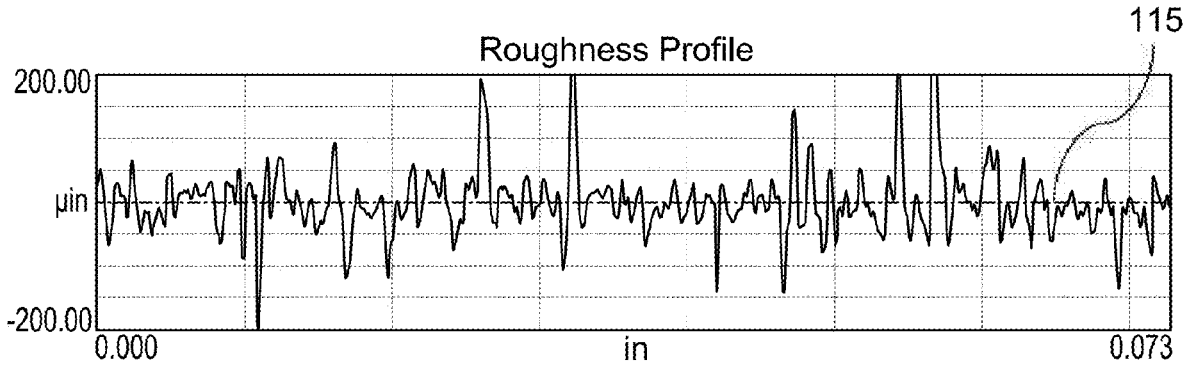
FIG. 16B illustrates a 2D cross-section of the surface band in FIG. 16A.
Figure 17A:
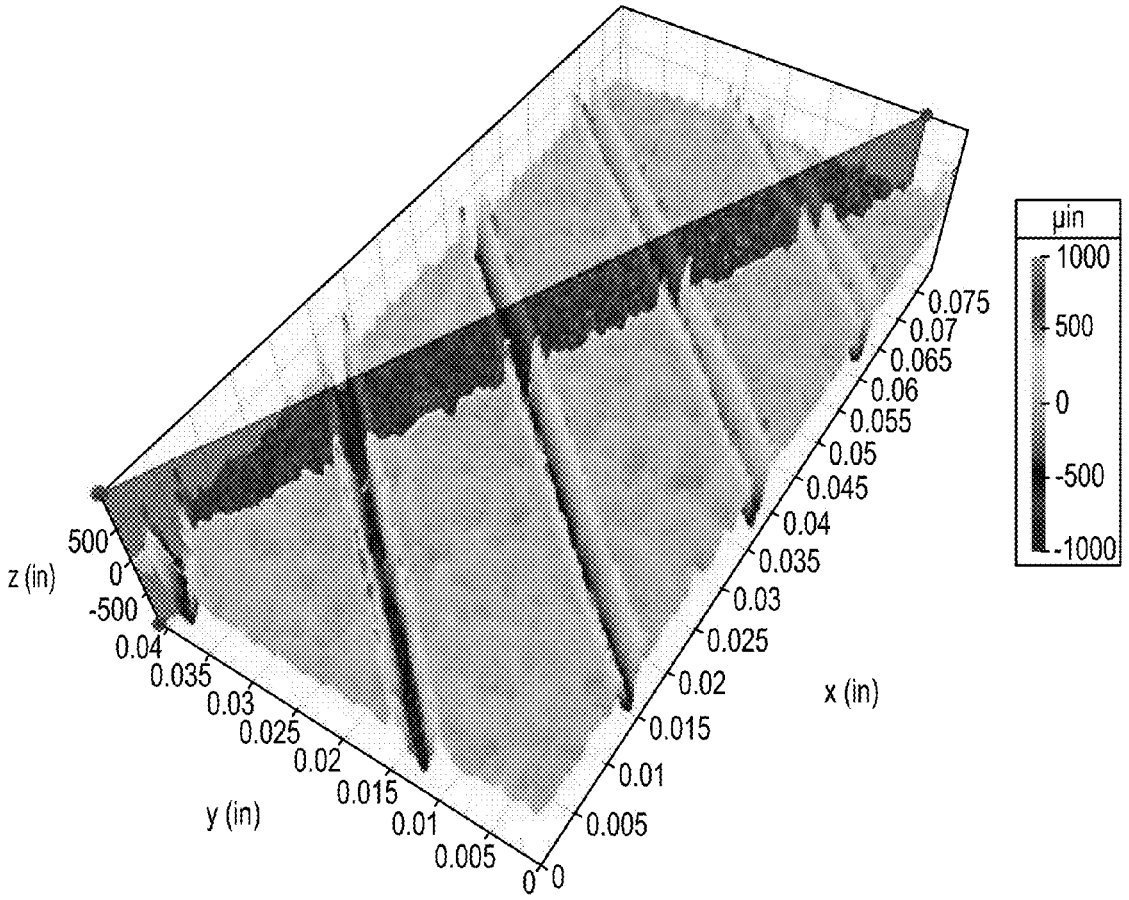
FIG. 17A illustrates a color 3D surface scan of the composite band of prior art club 4.
Figure 17B:
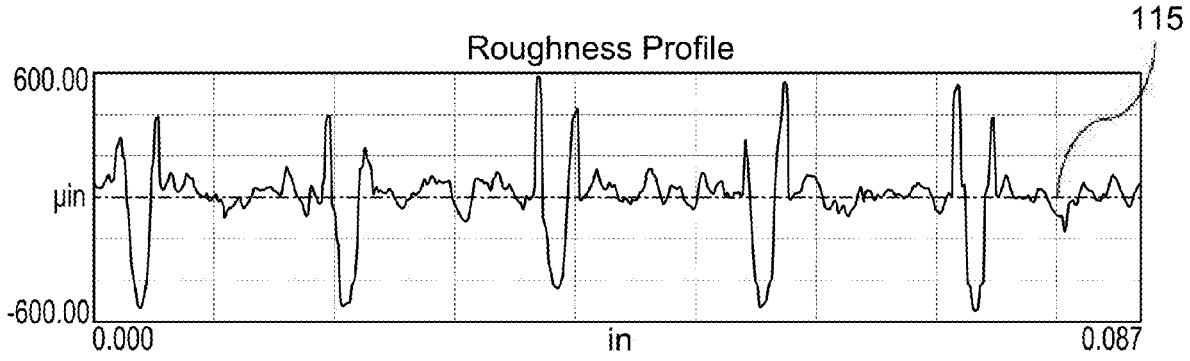
FIG. 17B illustrates a 2D cross-section of the composite band, via the surface scan of FIG. 17A.
Figure 18A:
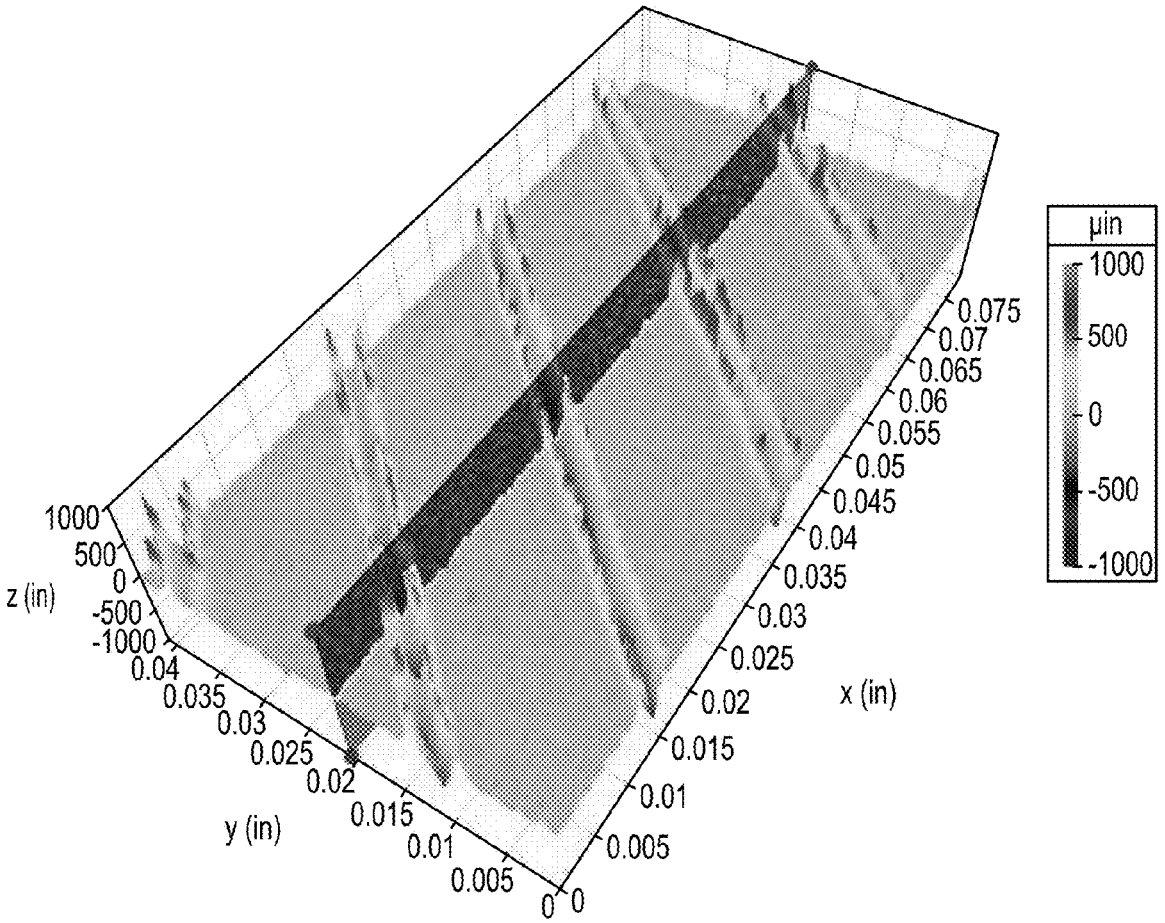
FIG. 18A illustrates a color 3D model of the surface band after filtering out the milling band from FIG. 17A.
Figure 18B:
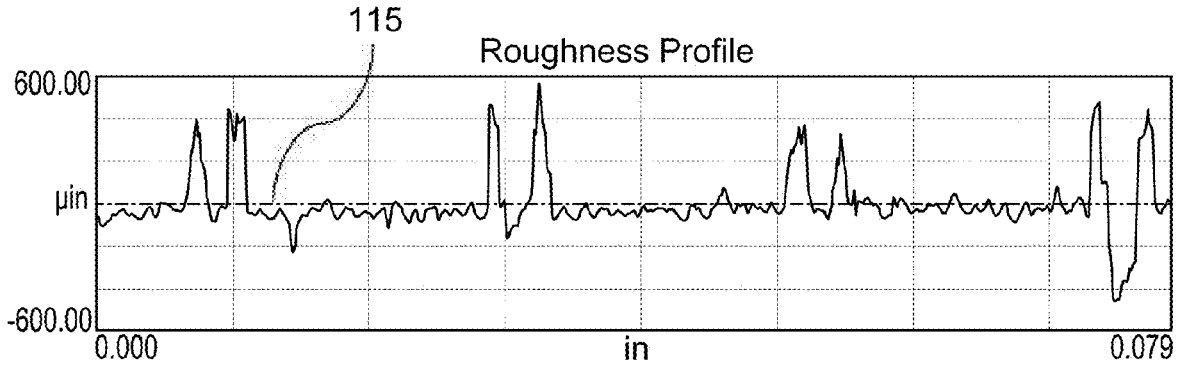
FIG. 18B illustrates a 2D cross-section of the surface band in FIG. 18A.
Figure 19A:
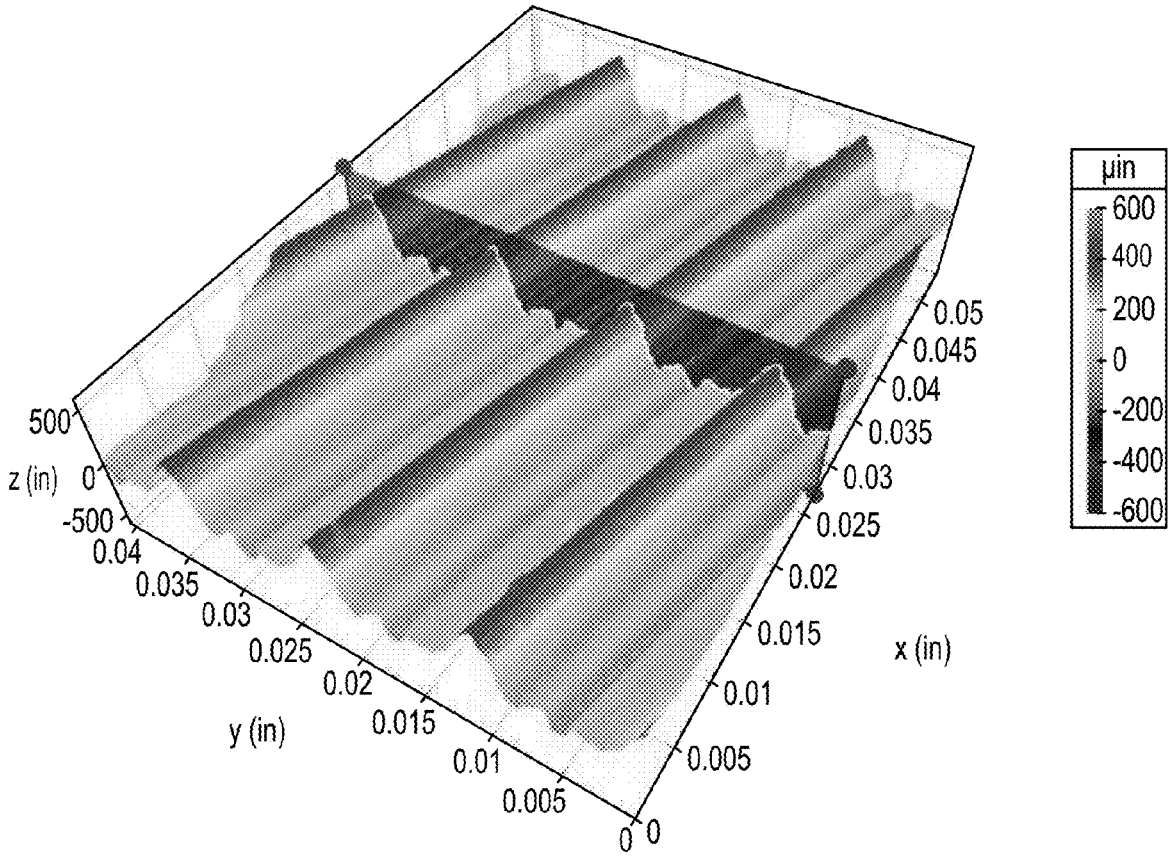
FIG. 19A illustrates a color 3D surface scan of the composite band of control club 1.
Figure 19B:
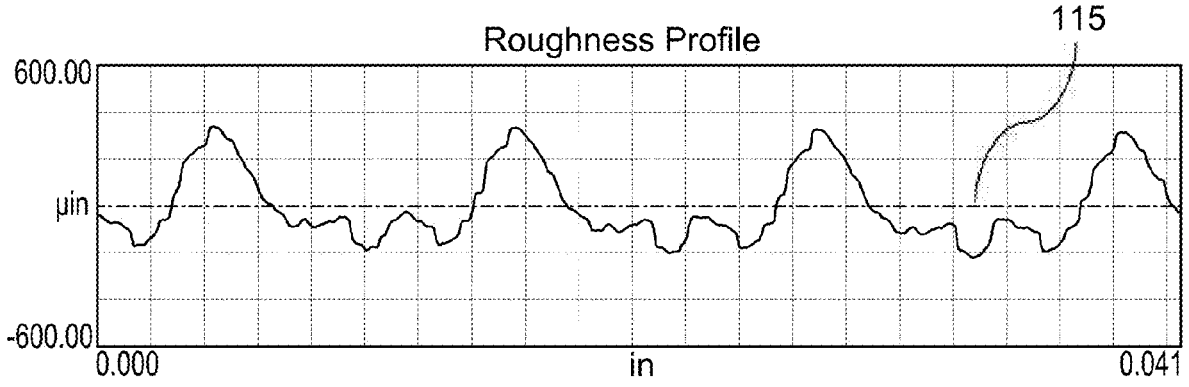
FIG. 19B illustrates a 2D cross-section of the composite band of FIG. 19A.
Figure 20A:
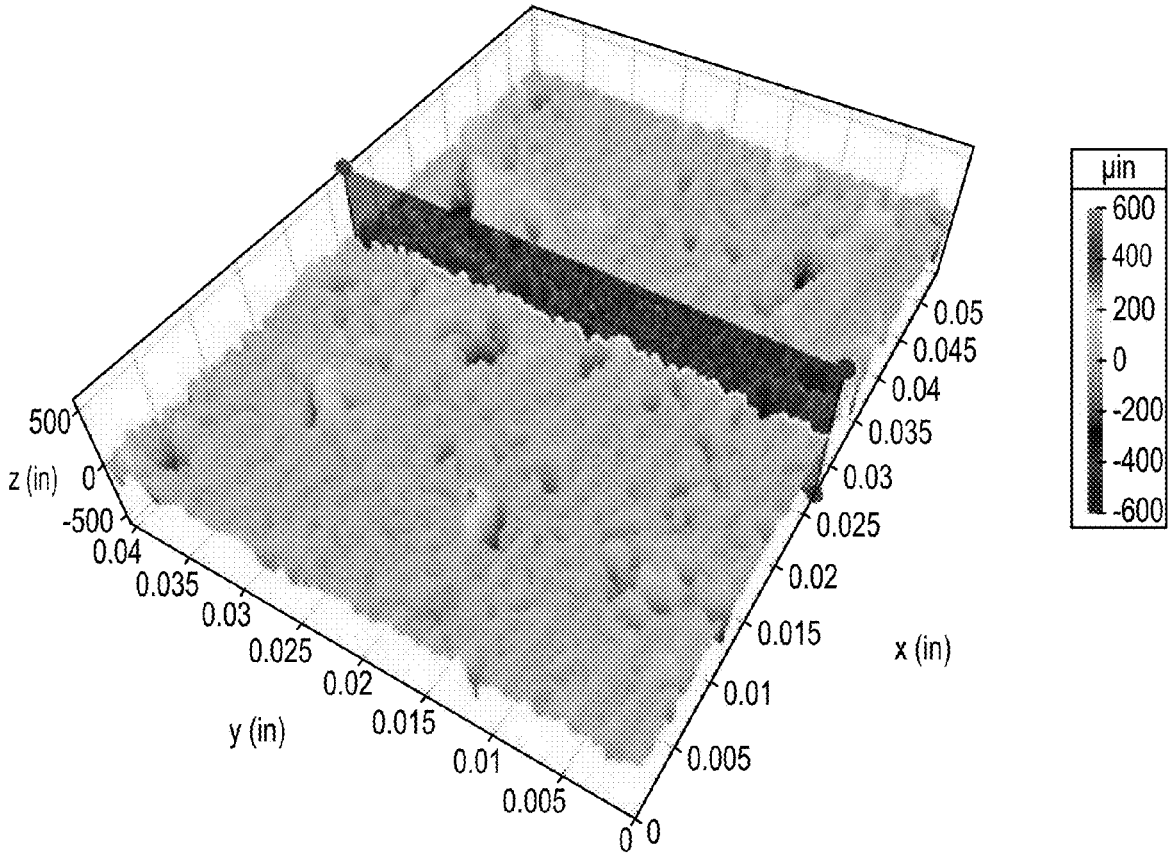
FIG. 20A illustrates a color 3D surface scan of the composite band of control club 2.
Figure 20B:
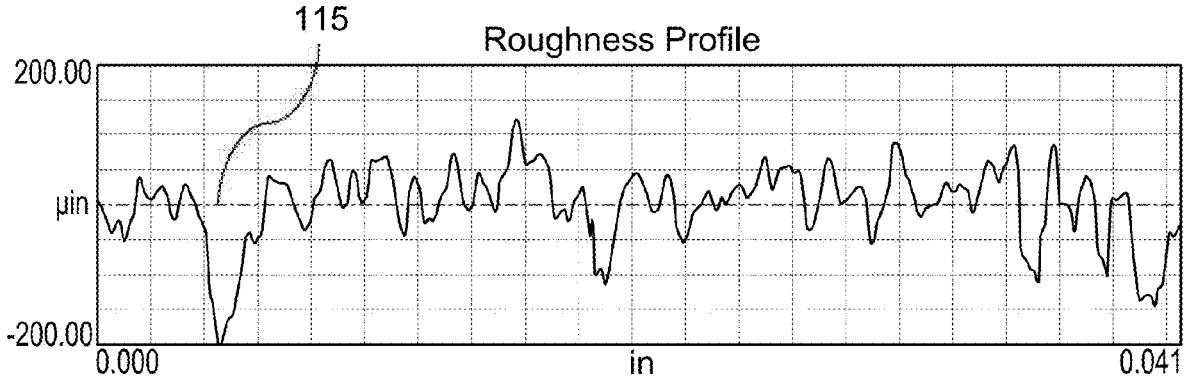
FIG. 20B illustrates a 2D cross-section of the composite band of FIG. 20A.

Prior Art Club Head 1 is a wedge-type golf club head with a surface profile as depicted in FIG. 11A-11B and a surface band profile as depicted in FIG. 12A-12B. Its overall average surface roughness, Sa, is 83.84 μin. Prior Art Club Head 2 is a wedge-type golf club head with a surface profile as depicted in FIG. 13A-13B and a surface band profile as depicted in FIG. 14A-14B. Its overall average surface roughness, Sa, is 113.8 μin. Prior Art Club Head 3 is a wedge-type golf club head with a surface profile as depicted in FIG. 15A-15B and a surface band profile as depicted in FIG. 16A-16B. Its overall average surface roughness, Sa, is 135 μin. Prior Art Club Head 4 is a wedge-type golf club head with a surface profile as depicted in FIG. 17A-17B and a surface band profile as depicted in FIG. 18A-18B. Its overall average surface roughness, Sa, is 100 μin.

Alterations in the face surface caused by the blasting treatments described herein can be described by various parameters. Surface analyses of the Exemplary Club Heads, Control Club Head, and Prior Art Club Heads were conducted using an optical profiler. Parameters that were recorded include: skewness (Ssk), root mean square gradient (Sdq), surface roughness (Sa), and developed interface area (Sdr). Skewness of each club head in the milling band and the surface band, as well as the overall Ssk are depicted in FIG. 17. Results for Sdq, Sa, and Sdr are discussed in Examples 8, 9, and 10, respectively.

Figure 23:
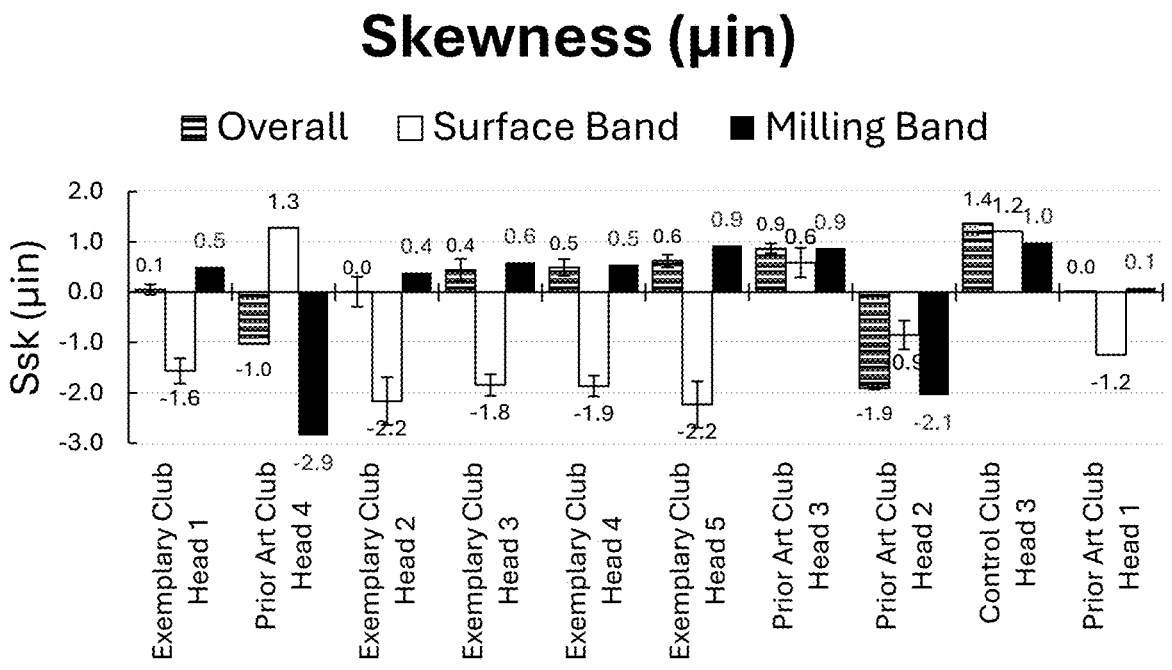
FIG. 23 illustrates the skewness values in different bands for varying wedge-type golf club heads.

As can be seen in FIG. 23, the Exemplary Club Heads all show a combination of a milling band having a positive Ssk between 0.4 μin and 0.6 μin and a surface band having a substantially negative Ssk between −1.6 μin and −2.4 μin. The combination of these treatments results in all of the Exemplary Club Heads having a positive overall Ssk between 0 μin and 0.8 μin.

The Prior Art Club Heads show a wide variety of skewness combinations. However, none of them comprise a combination of a positive milling band skewness between 0.4 μin and 0.6 μin and a negative surface band skewness between −2.4 μin and −1.6 μin. Prior Art Club Head 1 has a moderately negative surface band skewness of −1.2 μin, a low, positive milling band skewness of 0.1 μin, and a composite skewness of 0. Prior Art Club Head 2 had a milling band skewness of −2.1 μin, a surface band skewness of −0.9 μin, and a composite skewness of −1.9 μin. Prior Art Club Head 3 had a positive surface band skewness of 0.6 μin, a positive milling band skewness of 0.9 μin, and a composite skewness of 0.9. Prior Art Club Head 4 had a positive surface band skewness of 1.3 μin, a negative milling band skewness of −2.9 μin, and a composite skewness of −1.0 μin. Control Club Head 3 had a positive surface band skewness of 1.2 μin, a positive milling band skewness of 1.0 μin, and a composite skewness of 1.4 μin.

By combining the surface treatments of milling and blasting, as described herein, the strike faces of the Exemplary Club Heads exhibited benefits of the negative Ssk in the surface band while balanced with a positive milling band Ssk, maintaining a generally overall positive Ssk. The negative Ssk of the surface band indicates the presence of an abundance of valleys that result in the mitigation of water sitting between the ball and strike face during impact. The positive Ssk of the milling band and the surface as a whole indicates the existence of peaks at the contact surface, creating roughness that increases friction between the ball and the strike face during impact, increasing spin. That surface roughness is able to function desirably by creating spin in wet conditions, as it does in dry conditions, by utilizing the surface band valleys to remove water from the contact surface of the strike face, thereby resulting in an impact that is very consistent regardless of wetness.

Prior Art Club Heads did not show the same combination of the Exemplary Club Heads, as described above. While the Prior Art Club Heads varied widely, they tended to focus on a single aspect of the surface, rather than separating out the milling and surface bands, as described herein, and creating desirable physical characteristics in each. For example, Prior Art Club Head 1 emphasized abundant milling, while Prior Art Club Head 4 emphasized steep peaks and wells. All of the Prior Art Club Heads fail to combine physical properties that, together, result in a combination of skewness, surface roughness, root meant square gradient, and developed interface area that leads to the greatest degree of spin retention. The Exemplary Club Heads overcome these deficiencies by combining milling and blasting within the disclosed ranges, thereby greatly enhancing the removal of water from the face.

XI. Example 8: Comparison of Surface Parameters of Exemplary Club Heads, Prior Art Club Heads, and Control Club Heads Example 8 provides a comparison of root mean square gradient (Sdq) values for wedge-type golf club heads that were blasted with various media. Sdq relates to the sharpness of the peaks and valleys formed in the face surface. Example 8 illustrates comparative results between four exemplary wedge-type golf club heads (hereafter referred to as "Exemplary Club Head 1, Exemplary Club Head 2, Exemplary Club Head 3, Exemplary Club Head 4") and a control wedge-type golf club head (hereafter referred to as "Control Club Head"). Example 7 illustrates comparative results between four exemplary golf club heads (hereafter referred to as "Exemplary Club Head 1, Exemplary Club Head 2, Exemplary Club Head 3, Exemplary Club Head 4, and Exemplary Club Head 5"), one control golf club head (hereafter referred to as "Control Club Head 3"), and four prior art golf club head (hereafter referred to as "Prior Art Club Head 1", "Prior Art Club Head 2", "Prior Art Club Head 3", and "Prior Art Club Head 4"). These golf club heads comprised the same properties as those of the same names in Example 3 and Example 7.

Surface analyses of the Exemplary Club Heads, Control Club Head, and Prior Art Club Heads were conducted using an optical profiler. Parameters that were recorded include: skewness (Ssk), root mean square gradient (Sdq), and developed interface area and roughness (Sa). Root Mean Square Gradient (Sdq) of each club head in the surface band and overall are depicted in FIG. 24.

The Sdq of a surface can affect the amount of space available for water to be distributed. A higher Sdq indicates that peaks are more narrow or sharp, oftentimes leaving valleys of greater depth. Sdq values of the Exemplary Club Heads were found to range from 17.9 μin to 26.7 μin. Sdq values of the Prior Art Club Heads were found to range from 6.9 μin to 22.2 μin, with most of the measured Prior Art Club Heads having a Sdq below 17.9 μin.

Figure 24:
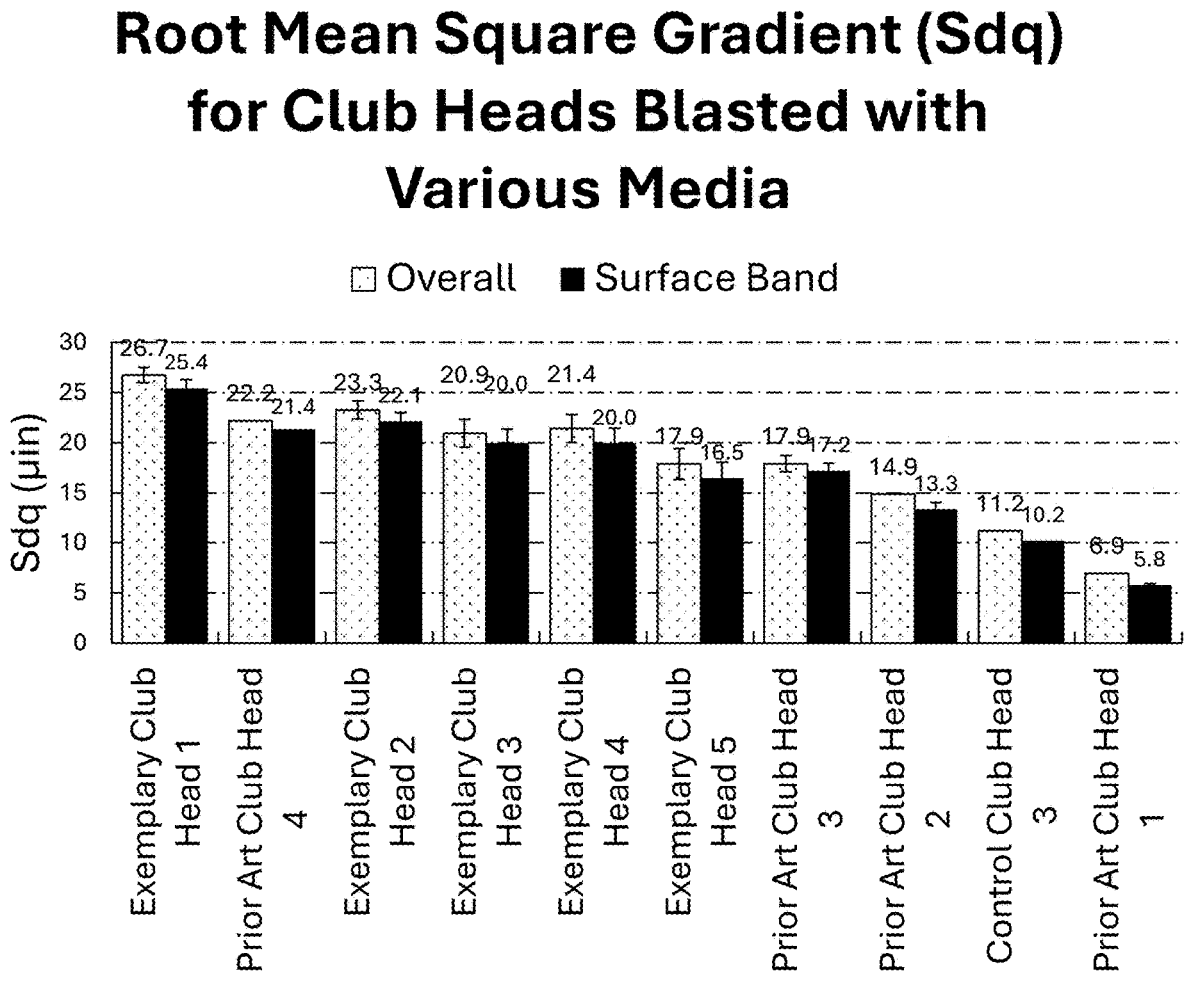
FIG. 24 illustrates 23 illustrates the root mean square gradient values in different bands for varying wedge-type golf club heads blasted with different media.

As seen in FIG. 24, the Exemplary Club Heads exhibited generally higher Sdq values that most of the Prior Art and Control Club Heads. This means that the peaks created by blasting in the Exemplary Club Heads are generally sharper than those of the Prior Art and Control Club Heads. On surfaces with low Sdq values, the valleys become shallower and wider, thereby failing to prevent the ball from entering the valleys as it deforms during impact. Surfaces with very high Sdq values are subject to issues with durability as the vertical peaks are weaker and vulnerable to breaking off at impact. Visuals of this occurrence are discussed in more detail in Example 11, below.

In conclusion, the Exemplary Club Heads exhibited higher Sdq values than those of the Control Club Head and the Prior Art Club Heads. Referencing FIGS. 24 and 23, the combination of a high Sdq and a negative Ssk, (as shown by Example 7) resulted in deeper valleys that increase the space in which water can move away from the impact surface while preventing the golf ball from entering. This improves spin retention by effectively removing water from the impact surface, thereby creating a surface interaction between the face and the ball that is very similar to interaction in dry conditions.

XII. Example 9: Comparison of Average Surface Roughness of Exemplary Club Heads Milled at Various Depths Surface analyses of 15 Exemplary Club Heads were conducted using an optical profiler. Average roughness, Sa, of each Exemplary Club Head was recorded from the surface analyses. Each Exemplary Club Head consisted of the same material and chrome plating, and each was blasted with a mineral-based media having a Mohs hardness of 7.5-8.5, an average grit size of 483 microns, a minimum grit size of 305 microns, and a maximum grit size of 762 microns. Before blasting, each Exemplary Club Head was milled using the same method, but different milling depths. Exemplary Club Head 6 was milled at a milling depth of 0.0012". Exemplary Club Head 7 was milled at a milling depth of 0.0012". Exemplary Club Head 8 was milled at a milling depth of 0.0012". Exemplary Club Head 9 was milled at a milling depth of 0.00098". Exemplary Club Head 10 was milled at a milling depth of 0.00098". Exemplary Club Head 11 was milled at a milling depth of 0.00098". Exemplary Club Head 12 was milled at a milling depth of 0.00081". Exemplary Club Head 13 was milled at a milling depth of 0.00081". Exemplary Club Head 14 was milled at a milling depth of 0.00081". Exemplary Club Head 15 was milled at a milling depth of 0.0006". Exemplary Club Head 16 was milled at a milling depth of 0.0006". Exemplary Club Head 17 was milled at a milling depth of 0.0006". Exemplary Club Head 18 was milled at a milling depth of 0.0002". Exemplary Club Head 19 was milled at a milling depth of 0.0002". Exemplary Club Head 20 was milled at a milling depth of 0.0002".

Figure 25:
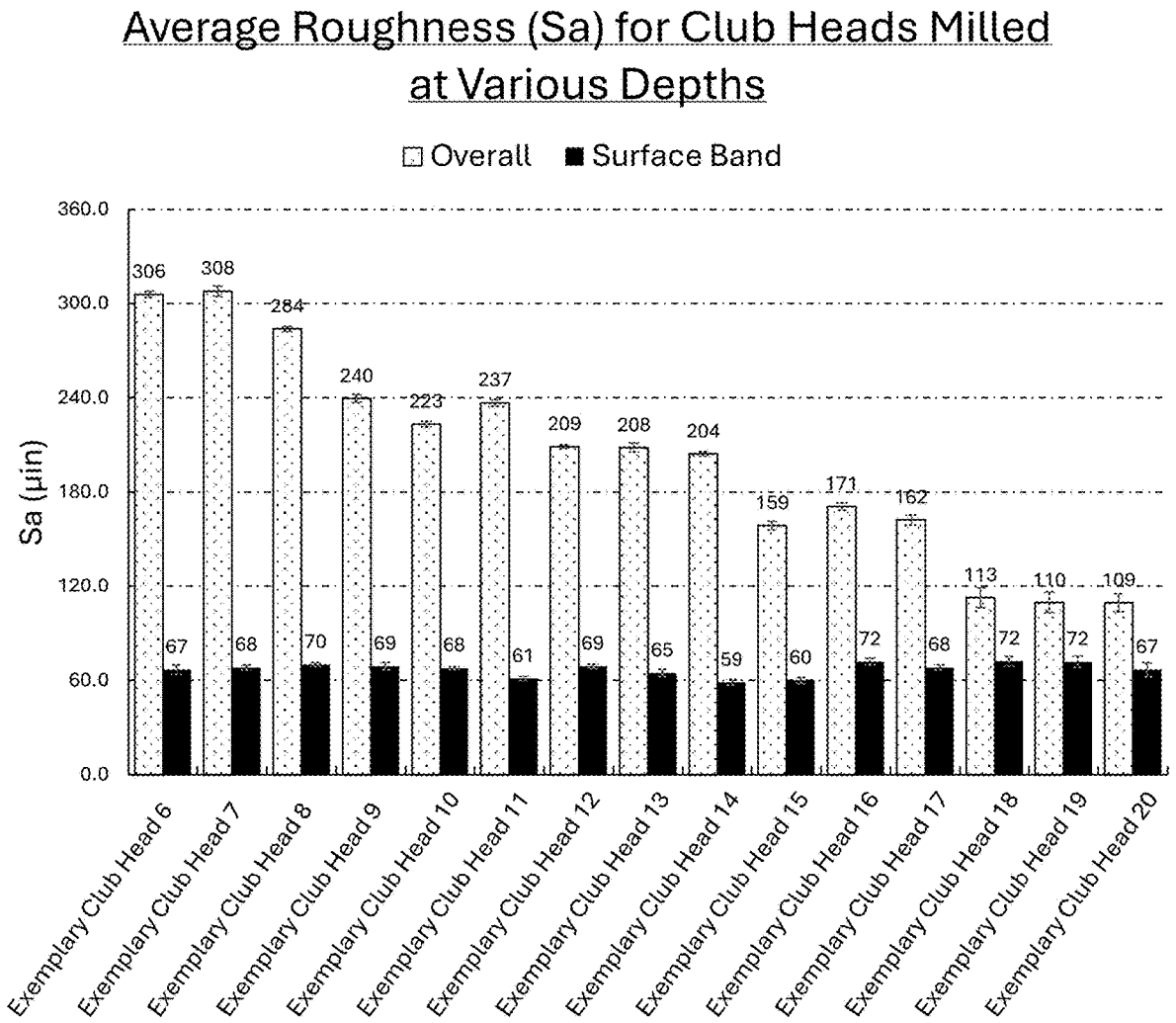
FIG. 25 illustrates 23 illustrates the average surface roughness values in different bands for varying wedge-type golf club heads having different milling depths.

Roughness measurements showed that the milling depth has little to no effect on the surface band roughness. Referring to FIG. 25, the surface band roughness remains generally constant across all samples, despite variations in milling depth. Specifically, the surface band roughness varied between only 59 μin and 72 μin across all tested milling depths.

Figure 26:
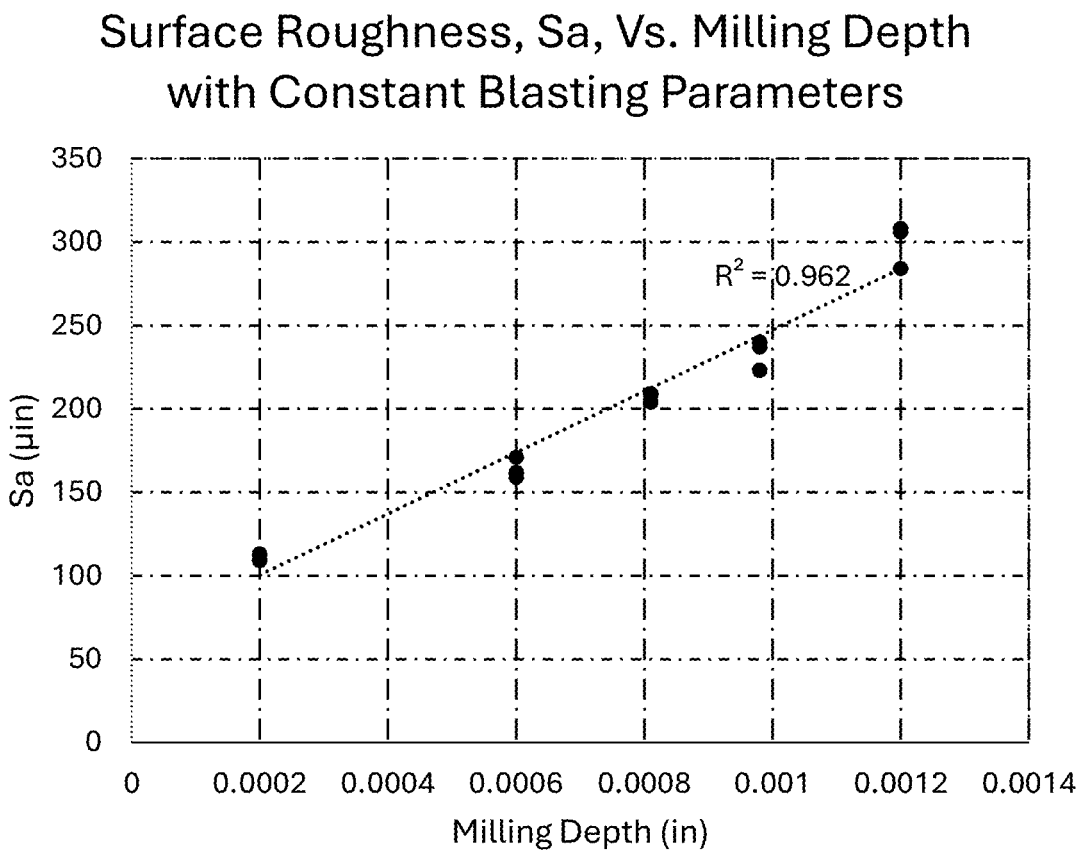
FIG. 26 illustrates a plot of average surface roughness against milling depth.

FIG. 25 further demonstrates that the surface band roughness has little to no effect on the overall/composite roughness. while the overall Sa varied between 308 μin and 109 μin. However, the overall Sa varied between 109 μin and 308 μin across the milling depths. Overall Sa follows a generally linear relationship with milling depth when blasting is held constant. The line of best fit on the scatterplot of FIG. 26 shows that the milling depth describes 96.2% of the overall Sa. Therefore, roughness from milling was found to be directly correlated with overall surface roughness, while roughness from blasting was found to have a negligible effect on overall surface roughness.

In conclusion, these results indicate that desirable high surface band roughness can be attained while the milling band roughness can be greatly reduced, thereby reducing the overall surface roughness. Because milling was found to have little effect on spin retention, it is apparent that surface roughness could be selectively modified by altering properties of the milling band, while performance in wet conditions could be simultaneously improved by altering properties of the surface band.

XIII. Example 10: Developed Interface Area (Sdr)

Figure 27:
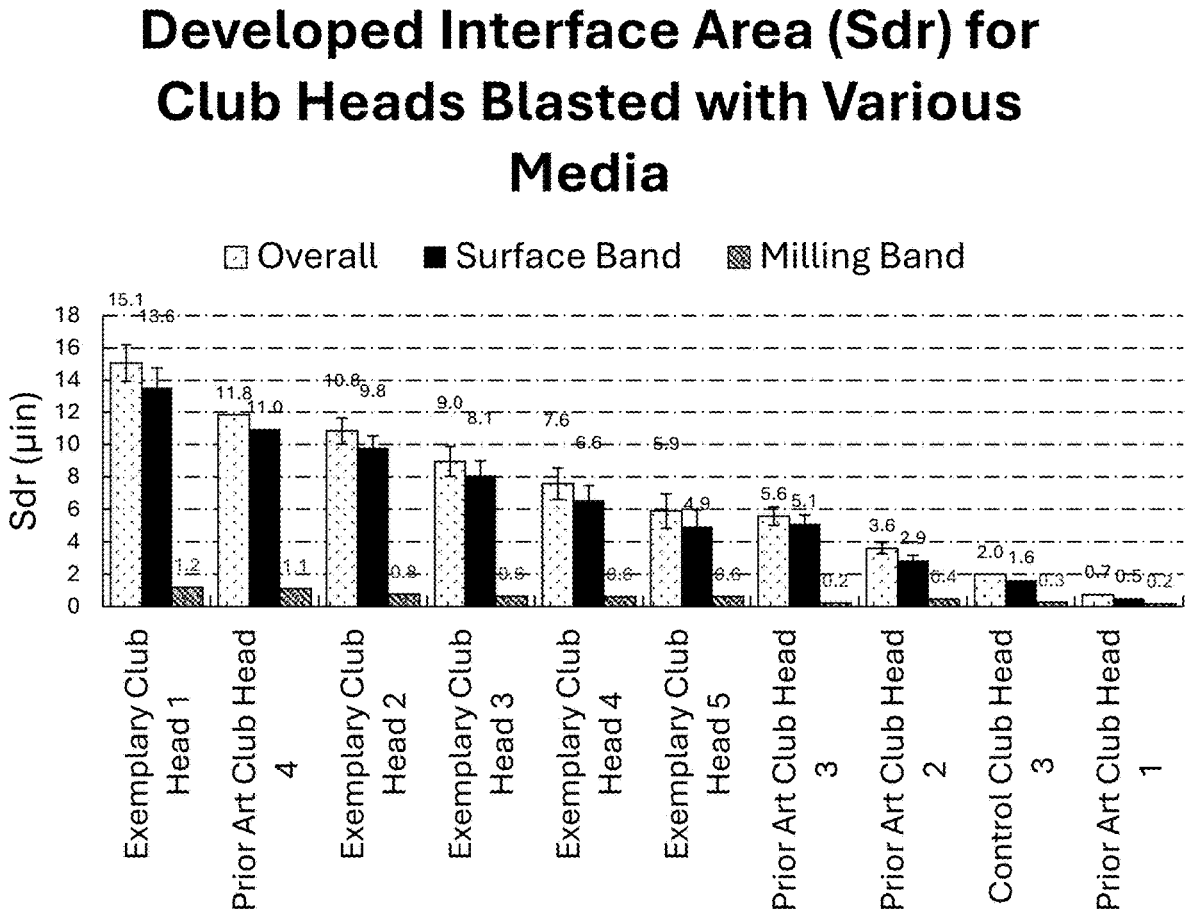
FIG. 27 illustrates the developed interface area values in different bands for varying wedge-type golf club heads blasted with different media.

Using an optical profiler, surface analyses of five Exemplary Club Heads, a Control Club Head, and four Prior Art Club Heads were conducted. Exemplary Club Head 1, Exemplary Club Head 2, Exemplary Club Head 3, Exemplary Club Head 4, Exemplary Club Head 5, Prior Art Club Head 1, Prior Art Club Head 2, Prior Art Club Head 3, Prior Art Club Head 4, and Control Club Head 3 are as described in Example 8. Developed Interface Area (Sdr) measurements were recorded for each club head and shown in the graph of FIG. 27. Sdr describes the amount of surface area created by increasing the roughness of the surface.

When compared with the average roughness values for the same wedge-type golf club heads, shown in FIG. 25, it can be noted that the Sdr generally followed the same pattern as the Sa, and was correlated as such. As Sa increased, the surface comprised greater roughness in the form of more frequent and larger peaks and valleys, thereby increasing the surface area. Therefore, Sdr generally increased with Sa.

The Exemplary Club Heads generally exhibited a greater Sdr than most of the Prior Art and Control Club Heads when measured in both the surface band and overall. Specifically, the Sdr values of the Exemplary Club Heads remained between 5.9 μin and 15.1 μin overall and between 4.9 μin and 13.6 μin in the surface band. Sdr values of the Prior Art Club Heads ranged between 0.7 μin and 11.8 μin overall and between 0.5 μin and 11.0 μin in the surface band. On average, the overall Sdr of the Exemplary Club Heads was 78.4% greater than that of the Prior Art Club Heads.

The Exemplary Club Heads' increased Sdr values further indicate the presence of additional space for water to move while maintaining sufficient area for contact between the golf ball and the face. Increased contact area between the face and the ball during impact is known to be a factor in increasing spin rates. The combination of a high Sdr with a negative surface band Ssk and high Sdq contributes to the ability of the surface to impart greater spin rates upon the ball following impact.

XIV. Example 11: Comparison of Surface Profiles of an Exemplary Club Head, Prior Art Club Heads, and Control Club Heads Surface profiles of an Exemplary Club Head, two Control Club Head, and four Prior Art Club Heads were collected using an optical profiler. Exemplary Club Head 1, Prior Art Club Head 1, Prior Art Club Head 2, Prior Art Club Head 3, Prior Art Club Head 4, Control Club Head 1, and Control Club Head 2 are as described in previous examples, by the same names. This example references surface profiles depicted in FIGS. 5A-7A and 11A-20A and measurements for Ssk, Sdq, Sa, and Sdr disclosed in Examples 8-10.

Prior Art Club Head 1 was found to exhibit a moderately negative surface band Ssk of −1.2, a neutral overall Ssk of 0, a low Sdq of 6.9, a low Sa of 88, and a very low Sdr of 0.7. Considering these parameters in view of the surface profile visuals of FIG. 11A-12B, it can be concluded that the surface of Prior Art Club Head 1 can be described best in the milling band, with little to note in the surface band (see FIGS. 12A and 12B). Referring to FIGS. 11A and 11B, Prior Art Club Head 1 lacks a high volume and frequency of space below the contact surface for water to move. As a result, water is likely to remain between the golf ball and the face surface during impact, leading to a major reduction in spin rate in wet conditions.

Prior Art Club Head 2 was found to exhibit a moderately negative surface band Ssk of −0.9, a strongly negative overall Ssk of −1.9 μin, a moderate Sdq of 14.9, a low/moderate Sa of 113, and a low Sdr of 3.6 μin. Considering these parameters in view of the surface profile visuals of FIG. 13A-14B, it can be concluded that the surface of Prior Art Club Head 2 shows greater surface roughness than Prior Art Club Head 1 (best shown in FIGS. 14A and 14B), as well as deep, narrow trenches (best shown in FIGS. 13A and 13B). Therefore, Prior Art Club Head 2 comprises a greater frequency of valleys for water to escape, but not in volume. The shallow depth of the valleys (described by the low Sa and Sdr values) and the flatter peaks (described by the Sdq) result in a lack of sufficient volume to house the water during impact. Similar to Prior Art Club Head 1, Prior Art Club Head 2 also results in water remaining between the golf ball and the face surface during impact, thereby greatly reducing spin rate in wet conditions.

Prior Art Club Head 3 was found to exhibit a moderately positive surface band Ssk of 0.6, a positive overall Ssk of 0.9, a higher Sdq of 17.9, a moderate Sa of 137, and a moderate Sdr of 5.6. Considering these parameters in view of the surface profile visuals of FIG. 15A-16B, and in comparison with the Exemplary Club Head profile in FIGS. 5A and 5B, it can be concluded that Prior Art Club Head 3 comprises wider trenches and a smaller peak to valley spread than those of Exemplary Club Head 1. The moderate Sa and Sdr values help describe the lack of very deep valleys and very high peaks. Specifically, the profile of Prior Art Club Head 3 fails to show deep valleys cutting into the blue range like the surface profile of Exemplary Club Head 1 does. Furthermore, the profile of Prior Art Club Head 3 fails to show a high density of peaks extending into the red range like the surface profile of Exemplary Club Head 1. Therefore, the surface of Prior Art Club Head 3 fails to provide both the high friction surface for increasing spin in both wet and dry conditions, and the volume of valleys available to house water during impact. As a result, water will still remain between the golf ball and the face surface during impact, reducing spin rate in wet conditions.

Prior Art Club Head 4 was found to exhibit a high surface band Ssk of 1.3, a moderately negative overall Ssk of −1.0, a high Sdq of 22.2, a low Sa of 103, and a high Sdr of 11.8. Considering these parameters in view of the surface profile visuals of FIG. 17A-18B, it can be seen that Prior Art Club Head 4 comprises narrow trenches, peaks that are oriented vertically (as described by the high Sdq) and a low volume of valleys (as described by the low Sa). However, referring to FIG. 18C, a second profile collected following 400 shots from the air cannon in testing showed that that nearly all of the peaks and most of the surface roughness between the trenches were decimated by contact with the golf ball, leaving a smooth surface with low friction and a lack of space for water away from the contact surface. Durability of the surface of Prior Art Club Head 4 was compromised by its sharp peaks (high Sdq) and lack of frequency of peaks and valleys (low Sa). Therefore, the surface of Prior Art Club Head 4, which already lacked a sufficient volume of valleys present for housing water prior to testing, would fail to prevent water from being sandwiched between the golf ball and the face surface during impact. As a result, spin would be greatly reduced in wet conditions.

Control Club Head 1 was found to exhibit a high overall Ssk of 1.82, a low Sdq of 11.8 and a low Sa of 112. Considering these parameters in view of the surface profile visuals of FIG. 19A-19B, it can be seen that Control Club Head 1 comprises a high volume of wide trenches, but completely lacks narrow valleys. The golf ball conforms into the wide trenches, thereby contacting water that is sitting in the trenches, and failing to remove water from the impact surface, thereby resulting in a substantial reduction in spin rate in wet conditions.

Control Club Head 2 was found to exhibit a negative overall Ssk of −2.62, a very high Sdq of 14.42 and a very low Sa of 45.7. Considering these parameters in view of the surface profile visuals of FIG. 20A-20B, it can be seen that Control Club Head 2 comprises a surface roughness, but lacks trenches that can extend the surface roughness to higher peaks and lower valleys. Therefore, Control Club Head 1 lacks sufficient volume to house water away from the contact surface, thereby resulting in a substantial reduction in spin rate in wet conditions. Furthermore, the high Sdq value makes Control Club Head 2 likely to lack durability, leading to even lower spin rates in wet conditions over time.

In conclusion, Exemplary Club Head 1 exclusively exhibited the desirable combination of a negative skewness, a high Sdq, a high Sdr, and a high surface band roughness. All of the Prior Art Club Heads failed to show a similar combination, thereby lacking one or more of the following features: deep valleys in the surface band (low Ssk), flatter peaks (high Sdq), and frequent and spacious regions below the impact surface for the water to escape (high Sdr and moderate to high Sa).

XV. Example 12: Comparison of Surface Roughness of Exemplary Club Heads Blasted at Various Pressures Example 12 provides a comparison of surface roughness of club heads blasted with a constant media at various pressures. Surface profiles of 12 exemplary club heads were collected using an optical profiler. Exemplary Club Heads 16-27 were similar in many ways to Exemplary Club Heads 1-5, as described in the Examples above. However, Exemplary Club Heads 16-21 did not comprise a coating or finish atop the metal surface. Exemplary Club Heads 22-27 comprised a chrome coating. Exemplary Club Heads 16-27 were all blasted with the same media hardness and size, and varied only in coating and blasting pressure. The media had a Mohs hardness of 6.5-7.0, an average grit size of 145 microns, a minimum grit size of 89 microns, and a maximum grit size of 241 microns.

Exemplary Club Head 16 (no coating) and Exemplary Club Head 22 (chrome coating) received a blasting treatment at a pressure of 2.5 kg/cm2. Exemplary Club Head 17 (no coating) and Exemplary Club Head 23 (chrome coating) received a blasting treatment at a pressure of 3.0 kg/cm2. Exemplary Club Head 18 (no coating) and Exemplary Club Head 24 (chrome coating) received a blasting treatment at a pressure of 3.5 kg/cm2. Exemplary Club Head 19 (no coating) and Exemplary Club Head 25 (chrome coating) received a blasting treatment at a pressure of 4.0 kg/cm2. Exemplary Club Head 20 (no coating) and Exemplary Club Head 26 (chrome coating) received a blasting treatment at a pressure of 4.5 kg/cm2. Exemplary Club Head 21 (no coating) and Exemplary Club Head 27 (chrome coating) received a blasting treatment at a pressure of 5.0 kg/cm2.

Figure 28:
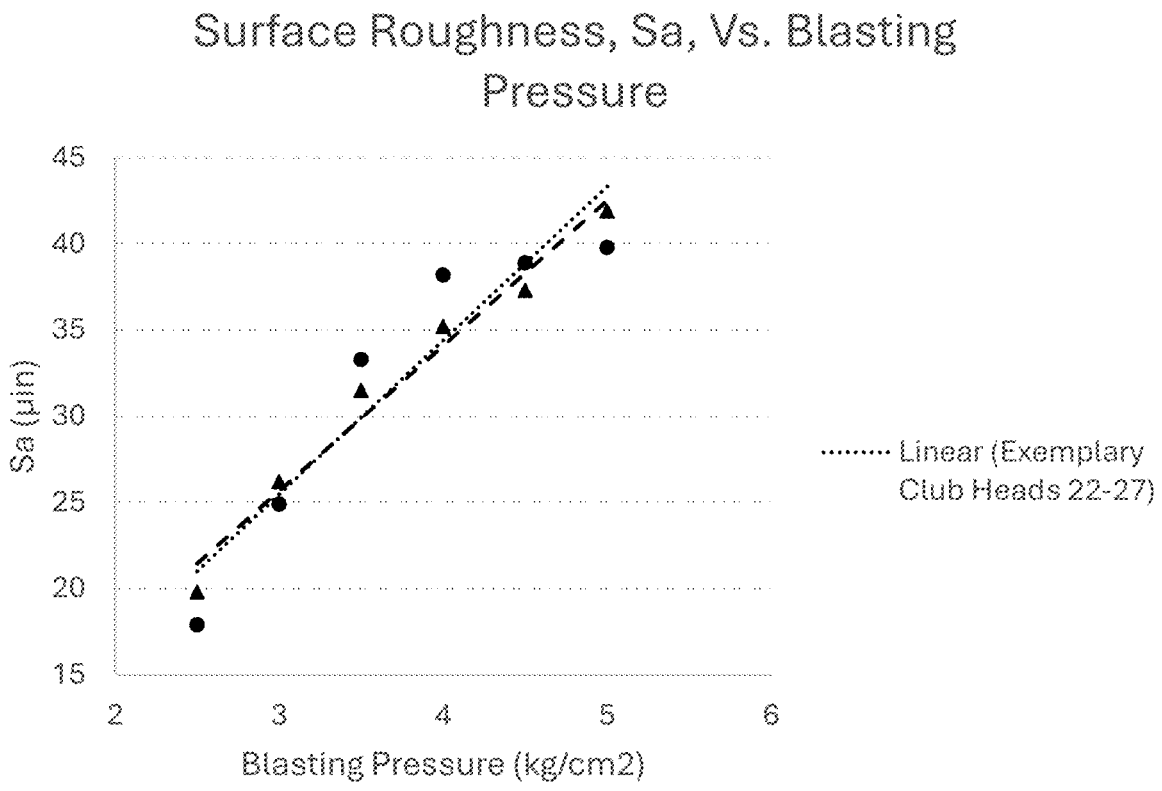
FIG. 28 illustrates a plot showing how average surface roughness changes with blasting pressure for an exemplary wedge-type golf club head.

The relationship between blasting pressure and surface roughness is shown in FIG. 28. This graph shows that, in general, surface roughness increases with an increase in blasting pressure, regardless of the coating. A line of best fit would show that 97% of the surface roughness measurements of Exemplary Club Heads 16-21 were linearly described by blasting pressure and 88% of the surface roughness measurements of Exemplary Club Head 22-27 were linearly described by blasting pressure. Data from the "no coating" group of exemplary club heads (16-21) and the "chrome coating" group (22-27) resulted in substantially similar lines of best fit, as shown in FIG. 28, with slopes remaining within 6% of one another, indicating that blasting pressure has a greater impact on average surface roughness than coating, for faces comprising the same materials otherwise.

In conclusion, changes in blasting pressure correlate generally linearly to changes in surface roughness. However, increases in blasting pressure at lower blasting pressures appear to result in a higher rate of change on surface roughness than increases in blasting pressure at higher blasting pressures. Therefore, it is possible that surface roughness would taper off at a maximum value when blasting pressure continues to be increased.

XVI. Example 13: Comparison of Surface Parameters of Exemplary Club Heads Blasted at Various Angles Surface profiles of 4 exemplary club heads were collected using an optical profiler. Exemplary Club Heads 28-31 were similar in many ways to Exemplary Club Heads 1-5, as described in the Examples above, including in material and geometry. Exemplary Club Heads 28-31 are four samples of the same club head, all without grooves or milling, and all blasted with a mineral-based media having a Mohs hardness of 6.5-7.0, an average grit size of 145 microns, a minimum grit size of 89 microns, and a maximum grit size of 241 microns.

Figure 10B:
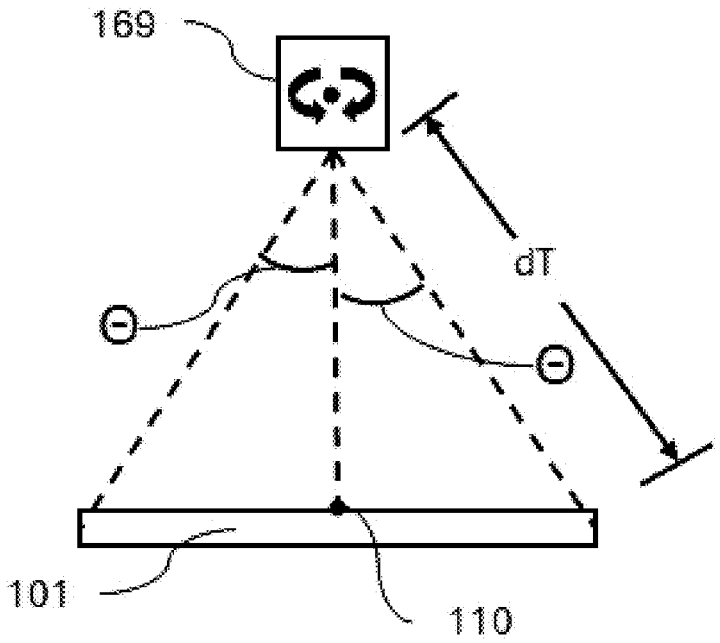
FIG. 10B illustrates an alternative blasting setup to create the surface band on a strike face.

The blasting setup can be seen in FIGS. 10A and 10B. For this example, the vertical distance of the blasting nozzle relative to the club head was about 4 inches. The blasting pressure was held constant at 50 bar. The longest distance from the nozzle to the club head was about 4.8 inches. The top of the club head was nearest to the nozzle, therefore being positioned about 4 inches vertically from the nozzle, and at the smallest blasting angle. The center of the club head was blasted at an angle of about 19 degrees. The bottom of the club head was positioned furthest from the nozzle at about 4.8 inches and at an angle of about 35 degrees. The blasting nozzle swiveled from side to side to direct its stream directly at all parts of the face. A 0 degree blasting angle was directed to a point off of the club head, such that the portion of the face nearest the nozzle is not at a 0 degree angle, but instead at a small positive angle.

The collected surface profiles were gathered following blasting and were used to determine particular surface parameters for each Exemplary Club Head, including Surface Roughness (Sa), Skewness (Ssk), and Root Mean Square Gradient (Sdq). Measurements were taken at three locations on the face, all aligned along a heel-toe central plane: (1) near the top rail (hereafter referred to as the "top" position), (2) face center (hereafter referred to as the "center" position), and (3) near the sole (hereafter referred to as the "bottom" position).

Figure 29A:
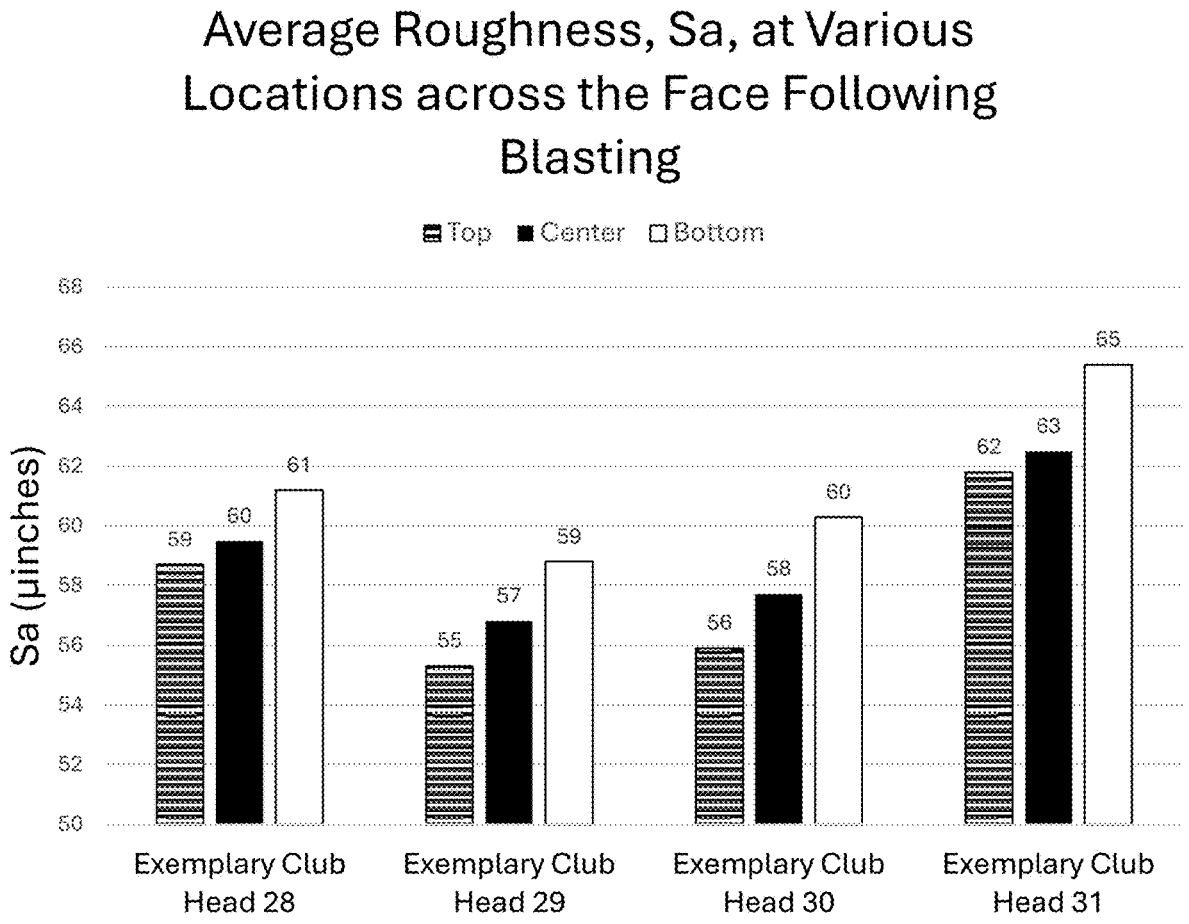
FIG. 29A illustrates a graph of how average roughness varies at different strike face locations following blasting.

The Sa values for each Exemplary Club Head, at each measurement location, are shown in FIG. 29A. All Exemplary Club Heads show a trend wherein greater blasting angles result in greater Sa values. Specifically, measurements taken at the bottom position, which was located at the greatest angle relative the nozzle, showed greater Sa in those four Exemplary Club Heads than measurements taken at the top and center positions. In Exemplary Club Heads 2-5, the bottom Sa was found to be 3% greater than the center Sa and 5.6% greater than the top Sa. Therefore, the blasting angle was found to have an impact on surface roughness and, in general, the surface roughness is greater at higher blasting angles.

Figure 29B:
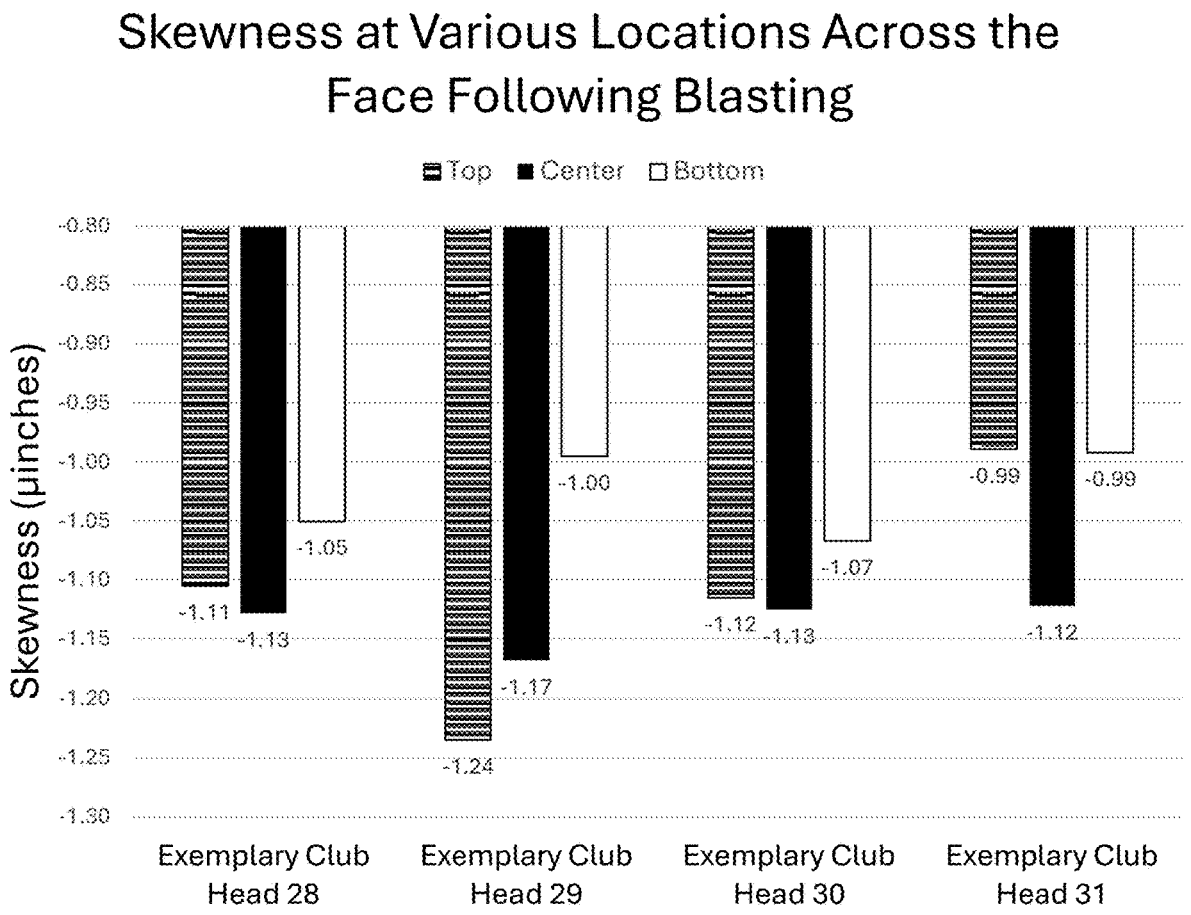
FIG. 29B illustrates a graph of how skewness changes varies at different strike face locations following blasting.

The skewness values for each Exemplary Club Head, at each measurement location, are shown in FIG. 29B. As can be seen in the graph, all Exemplary Club Heads showed a trend wherein the least skewness (Ssk is nearest to 0) was found where the blasting angle is greatest. Specifically, the bottom measurement location (where blasting angle is greatest) was found to generally have the smallest skewness magnitude. However, because overall skewness was found not to be majorly affected by blasting angle, blasting angle can be selected for optimization of parameters other than skewness, and the reduction in Sa could be overcome by other means.

Figure 29C:
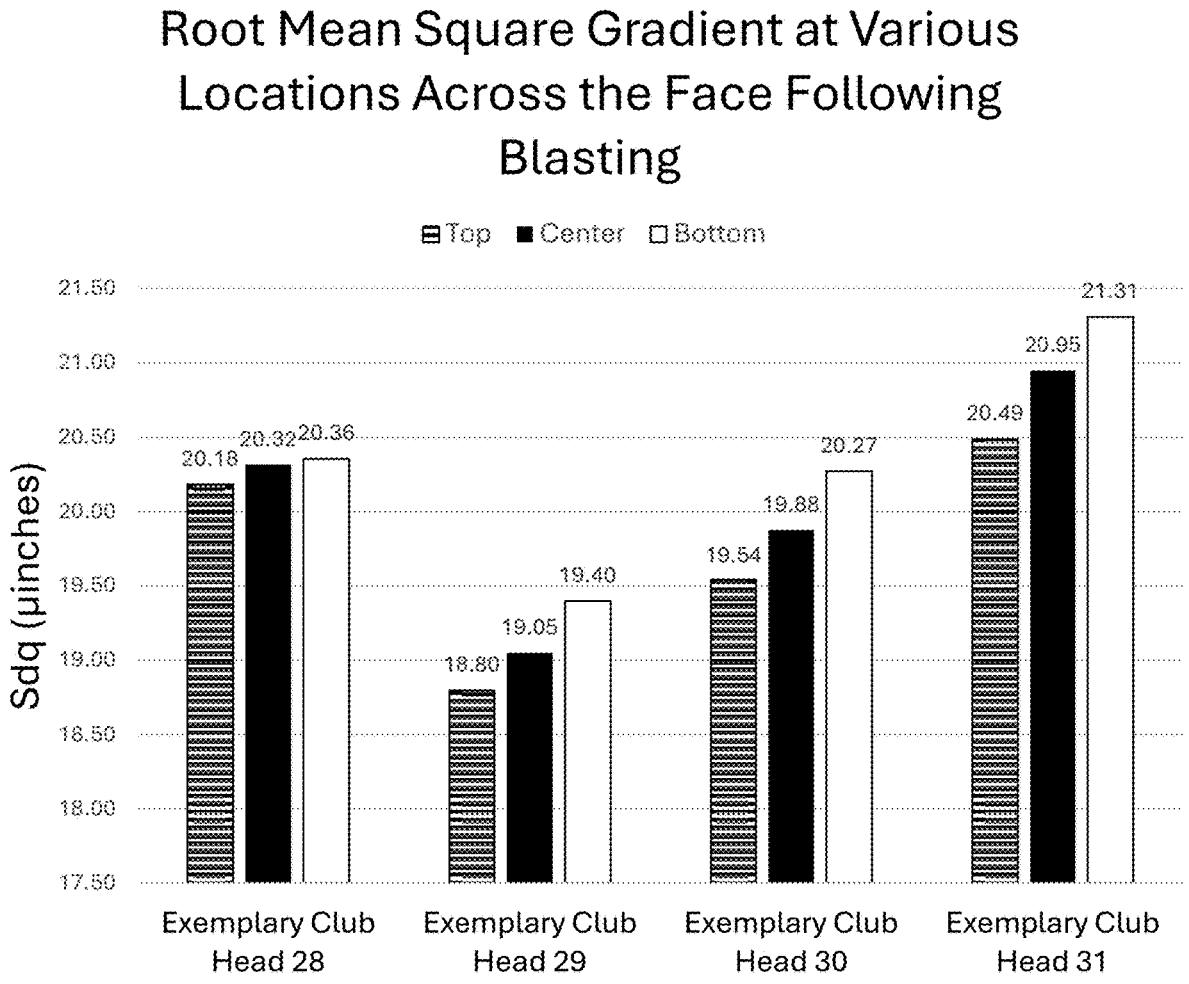
FIG. 29C illustrates a graph of how root mean square gradient varies at different strike face locations following blasting.

The root mean square gradient (Sdq) values for each Exemplary Club Head, at each measurement location, are shown in FIG. 29C. As can be seen in the graph, Sdq appears to be generally greater at greater blasting angles. Specifically, in all Exemplary Club Heads, Sdq is greatest at the bottom position and lowest at the top position. On average, the bottom position Sdq is 1.3% greater than the center position Sdq. On average, the bottom position Sdq is 2.9% greater than the top position Sdq.

In conclusion, a greater blasting angle results in a greater Sa, a smaller magnitude of Ssk, and a greater Sdq. Reducing the blasting angle necessary to reach all edges of the face can reduce variation in Sa, Ssk, and Sdq across the face. This is desirable, as it results in more consistent spin rates when the ball is hit at any point across the face, thereby resulting in more predictable shots.

XVII. Example 14: Comparison of Spin Rate of Exemplary Club Heads Blasted with Various Media Example 14 provides a comparison of spin rate difference between wet and dry conditions of several wedge-type golf club heads treated with layered blast media (one or two treatments). Spin rate difference describes the gap between spin rate in wet conditions and spin rate in dry conditions and is defined in this example as an absolute value of the difference of the spin rate in wet conditions and the spin rate in dry conditions. Example 14 illustrates comparative results between five exemplary golf club heads (hereafter referred to as "Exemplary Club Head 25, Exemplary Club Head 26, Exemplary Club Head 27, Exemplary Club Head 28, and Exemplary Club Head 29"). Exemplary Club Head 25 comprised a strike face that was blasted with two media: a first media having a Mohs hardness of about 9, an average grit size of 559 microns, a minimum grit size of 356 microns, and a maximum grit size of 813 microns, and a second media having a Mohs hardness of about 9, an average grit size of 50 microns, a minimum grit size of 25 microns, and a maximum grit size of 85 microns. Exemplary Club Head 26 comprised a strike face that was blasted with a mineral-based media having a Mohs hardness of about 9, an average grit size of 356 microns, a minimum grit size of 241 microns, and a maximum grit size of 559 microns. Exemplary Club Head 27 comprised a strike face that was blasted with two media: a first media having a Mohs hardness of about 9, an average grit size of 356 microns, a minimum grit size of 241 microns, and a maximum grit size of 559 microns, and a second media having a Mohs hardness of about 9, an average grit size of 50 microns, a minimum grit size of 25 microns, and a maximum grit size of 85 microns. Exemplary Club Head 28 comprised a strike face that was blasted with a mineral-based media having a Mohs hardness of about 3-3.5, an average grit size of 203 microns, a minimum grit size of 127 microns, and a maximum grit size of 330 microns. Exemplary Club Head 29 comprised a strike face that was blasted with a mineral-based media having a Mohs hardness of 6.5-7.0, an average grit size of 145 microns, a minimum grit size of 89 microns, and a maximum grit size of 241 microns.

Each club head was struck at various angles with golf balls fired at 80 mph in an air cannon in both wet and dry conditions. In wet condition testing, the face was drenched with water five times prior to each impact and wiped clean following each impact. The spin rate of the golf ball following impact with the face was recorded and calculations based on those recorded values are displayed in FIG. 30A.

Figure 30A:
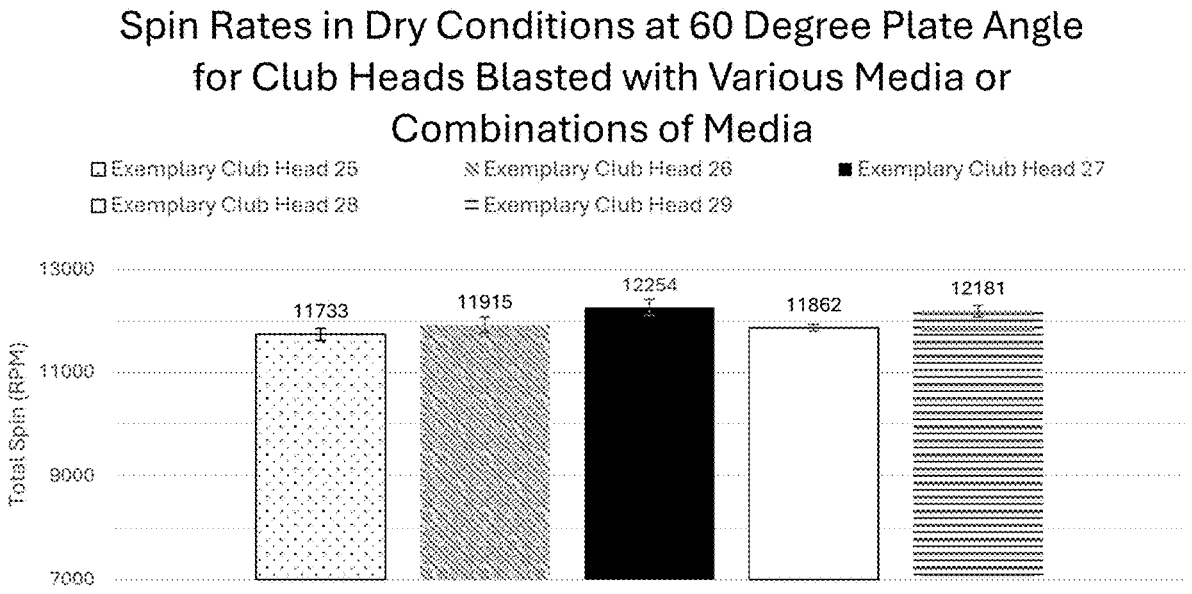
FIG. 30A illustrates a graph depicting spin rates in dry conditions for exemplary wedge-type golf club heads blasted with various media or a combination of media.
Figure 30B:
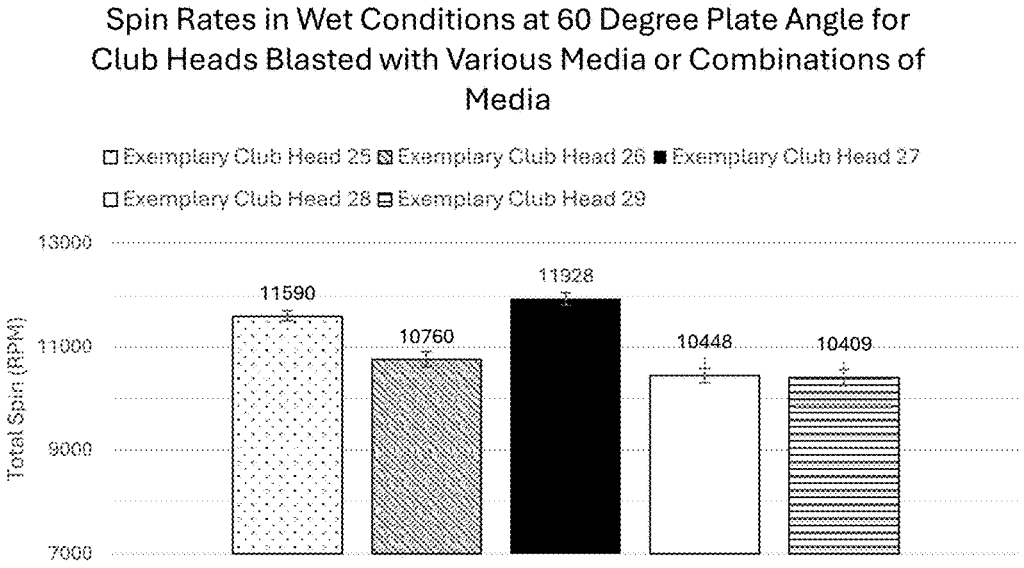
FIG. 30B illustrates a graph depicting spin rates in wet conditions for exemplary wedge-type golf club heads blasted with various media or a combination of media.

FIG. 30A displays the spin rate measurements recorded in wet conditions and spin rate measurements recorded in dry conditions on a 60-degree plate angle. This chart visually depicts the extent that the spin rate in wet conditions varied from the spin rate in dry conditions. It is desirable to reduce this difference in order to create similar spin in both wet and dry conditions, thereby making the resulting shot more predictable, regardless of environmental conditions.

The spin rate in dry for the exemplary clubs were all similar at a 60-degree plate angle as showcased in FIG. 30A. However, the difference from dry to wet showcases the superiority of the mixture of media's when creating spin in wet conditions. FIG. 30A shows that Exemplary Club Heads 25 and 27 had a much smaller spread of spin rate compared to the other Club Heads when changing from dry to wet conditions. Exemplary Club Heads 25 and 27 total spin only decreased by 326 RPM, in comparison to Exemplary Club Head 5, which decreased by 1,772 RPM when changing from dry to wet conditions.

In conclusion, the gaps in spin rate between wet and dry conditions were minimized when two different blasting media were used (Exemplary Club Heads 25 and 27). Exemplary Club Heads 25 and 27 showed improved performance in wet conditions and improved predictability in spin rate between wet and dry conditions when compared with the other Control Club Heads that did not comprise the same combination of blasting media.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CLAUSES

Clause 1. A wedge-type golf club head comprising: a strike face having a strike face surface; the strike face surface further comprising a surface roughness characterized by: a composite band evaluated over the entirety of the strike face surface, at a composite band surface roughness wavelength range of 300 μin to 100,000 μin; wherein an average surface roughness (Sa) of the strike face surface in the composite band is less than 180 μin, a skewness (Ssk) of the strike face surface in the composite band is between 0 and −0.5, a root mean square gradient (Sdq) of the strike face surface in the composite band is between 14 degrees and 30 degrees, and a developed interface area (Sdr) of the strike face surface in the composite band is between 5% and 15%; a milling band evaluated over the entirety of the strike face surface, at a milling band surface roughness wavelength range of 2,000 μin to 100,000 μin; wherein the Sa of the strike face surface in the milling band is between 60 μin and 180 μin, the Ssk of the strike face surface in the milling band is between 0.2 and 0.7, the Sdq of the strike face surface in the milling band is between 5 degrees and 9 degrees, and the Sdr of the strike face surface in the milling band is between 0.5% and 1.5%; a surface band evaluated over the entirety of the strike face surface, at a surface band surface roughness wavelength range of 300 μin to 2,000 μin; wherein the Sa of the strike face surface in the surface band is between 35 μin and 120 μin, the Ssk of the strike face surface in the surface band is between −5.0 and −1.0, the Sdq of the strike face surface in the surface band is between 14 degrees and 30 degrees, and the Sdr of the strike face surface in the surface band is between 5% and 15%.

Clause 2. The wedge-type golf club head of claim 1, wherein the golf club head has a loft that is 40 degrees or greater.

Clause 3. The wedge-type golf club head of claim 1, wherein the golf club head is made out of 8620 alloy steel.

Clause 4. The wedge-type golf club head of claim 1, wherein the strike face further comprises grooves.

Clause 5. The wedge-type golf club head of claim 1, wherein the ratio of Sdq of the strike face surface in the surface band to the Ssk of the strike face surface in the surface band is between −10 degrees and −12 degrees.

Clause 6. The wedge-type golf club head of claim 1, wherein the Ssk of the strike face surface in the surface band is between −1.6 and −1.8.

Clause 7. The wedge-type golf club head of claim 1, wherein the Sa of the strike face surface in the surface band is between 40 μin and 45 μin.

Clause 8. A wedge-type golf club head comprising: a strike face having a strike face surface; the strike face surface further comprising a surface roughness characterized by: a composite band evaluated over the entirety of the strike face surface, at a composite band surface roughness wavelength range of 300 μin to 100,000 μin wherein an average surface roughness (Sa) of the strike face surface in the composite band is less than 180 μin, and a skewness (Ssk) of the strike face surface in the composite band is between 0 and 0.5; a surface band evaluated over the entirety of the strike face surface, at a surface band surface roughness wavelength range of 300 μin to 2,000 μin; wherein the Sa of the strike face surface in the surface band is between 35 μin and 120 μin, and the Ssk of the strike face surface in the surface band is between −5.0 and −1.0.

Clause 9. The wedge-type golf club head of claim 8, wherein the golf club head has a loft that is 40 degrees or greater.

Clause 10. The wedge-type golf club head of claim 8, wherein the golf club head is made out of 8620 alloy steel.

Clause 11. The wedge-type golf club head of claim 8, wherein the strike face further comprises grooves.

Clause 12. The wedge-type golf club head of claim 8, wherein the Ssk of the strike face surface in the surface band is between −1.6 and −1.8.

Clause 13. The wedge-type golf club head of claim 8, wherein the Sa of the strike face surface in the surface band is between 40 μin and 45 μin.

Clause 14. A wedge-type golf club head comprising: a strike face having a strike face surface; the strike face surface further comprising a surface roughness characterized by: a milling band evaluated over the entirety of the strike face surface, at a milling band surface roughness wavelength range of 2,000 μin to 100,000 μin; wherein an average surface roughness (Sa) of the strike face surface in the milling band is between 60 μin and 180 μin, a skewness (Ssk) of the strike face surface in the milling band is between 0.2 and 0.7, a root mean square gradient (Sdq) of the strike face surface in the milling band is between 5 degrees and 9 degrees, and a developed interface area (Sdr) of the strike face surface in the milling band is between 0.5% and 1.5%; a surface band evaluated over the entirety of the strike face surface, at a surface band surface roughness wavelength range of 300 μin to 2,000 μin; wherein the Sa of the strike face surface in the surface band is between 35 μin and 120 μin, the Ssk of the strike face surface in the surface band is between −5.0 and −1.0, the Sdq of the strike face surface in the surface band is between 14 degrees and 30 degrees, and the Sdr of the strike face surface in the surface band is between 5% and 15%.

Clause 15. The wedge-type golf club head of claim 14, wherein the golf club head has a loft that is 40 degrees or greater.

Clause 16. The wedge-type golf club head of claim 14, wherein the golf club head is made out of 8620 alloy steel.

Clause 17. The wedge-type golf club head of claim 14, wherein the strike face further comprises grooves.

Clause 18. The wedge-type golf club head of claim 14, wherein the ratio of Sdq of the strike face surface in the surface band to the Ssk of the strike face surface in the surface band is between −12 degrees and −10 degrees.

Clause 19. The wedge-type golf club head of claim 14, wherein the Ssk of the strike face surface in the surface band is between −1.6 and −1.8.

Clause 20. The wedge-type golf club head of claim 14, wherein the Sa of the strike face surface in the surface band is between 40 μin and 45 μin.

What is claimed is:

1. A wedge-type golf club head comprising:

a strike face having a strike face surface;

the strike face surface further comprising a surface roughness characterized by:

a composite band evaluated over an entirety of the strike face surface, at a composite band surface roughness wavelength range of 300 μin to 100,000 μin;

wherein an average surface roughness (Sa) of the strike face surface in the composite band is less than 180 μin, a skewness (Ssk) of the strike face surface in the composite band is between 0 and −0.5, a root mean square gradient (Sdq) of the strike face surface in the composite band is between 14 degrees and 30 degrees, and a developed interface area (Sdr) of the strike face surface in the composite band is between 5% and 15%;

a milling band evaluated over the entirety of the strike face surface, at a milling band surface roughness wavelength range of 2,000 μin to 100,000 μin;

wherein the average surface roughness (Sa) of the strike face surface in the milling band is between 60 μin and 180 μin, the skewness (Ssk) of the strike face surface in the milling band is between 0.2 and 0.7, the root mean square gradient (Sdq) of the strike face surface in the milling band is between 5 degrees and 9 degrees, and the developed interface area (Sdr) of the strike face surface in the milling band is between 0.5% and 1.5%; and a surface band evaluated over the entirety of the strike face surface, at a surface band surface roughness wavelength range of 300 μin to 2,000 μin;

wherein the average surface roughness (Sa) of the strike face surface in the surface band is between 35 μin and 120 μin, the skewness (Ssk) of the strike face surface in the surface band is between −5.0 and −1.0, the root mean square gradient (Sdq) of the strike face surface in the surface band is between 14 degrees and 30 degrees, and the developed interface area (Sdr) of the strike face surface in the surface band is between 5% and 15%.

2. The wedge-type golf club head of claim 1, wherein the golf club head has a loft that is 40 degrees or greater.

3. The wedge-type golf club head of claim 1, wherein the golf club head is made out of 8620 alloy steel.

4. The wedge-type golf club head of claim 1, wherein the strike face further comprises grooves.

5. The wedge-type golf club head of claim 1, wherein a ratio of the root mean square gradient (Sdq) of the strike face surface in the surface band to the skewness (Ssk) of the strike face surface in the surface band is between −10 degrees and −12 degrees.

6. The wedge-type golf club head of claim 1, wherein the skewness (Ssk) of the strike face surface in the surface band is between −1.6 and −1.8.

7. The wedge-type golf club head of claim 1, wherein the average surface roughness (Sa) of the strike face surface in the surface band is between 40 μin and 45 μin.

8. A wedge-type golf club head comprising:

a strike face having a strike face surface;

the strike face surface further comprising a surface roughness characterized by:

a composite band evaluated over an entirety of the strike face surface, at a composite band surface roughness wavelength range of 300 μin to 100,000 μin wherein an average surface roughness (Sa) of the strike face surface in the composite band is less than 180 μin, and a skewness (Ssk) of the strike face surface in the composite band is between 0 and 0.5; and a surface band evaluated over the entirety of the strike face surface, at a surface band surface roughness wavelength range of 300 μin to 2,000 μin;

wherein the average surface roughness (Sa) of the strike face surface in the surface band is between 35 μin and 120 μin, and the skewness (Ssk) of the strike face surface in the surface band is between −5.0 and −1.0.

9. The wedge-type golf club head of claim 8, wherein the golf club head has a loft that is 40 degrees or greater.

10. The wedge-type golf club head of claim 8, wherein the golf club head is made out of 8620 alloy steel.

11. The wedge-type golf club head of claim 8, wherein the strike face further comprises grooves.

12. The wedge-type golf club head of claim 8, wherein the skewness (Ssk) of the strike face surface in the surface band is between −1.6 and −1.8.

13. The wedge-type golf club head of claim 8, wherein the average surface roughness (Sa) of the strike face surface in the surface band is between 40 μin and 45 μin.

14. A wedge-type golf club head comprising:

a strike face having a strike face surface;

the strike face surface further comprising a surface roughness characterized by:

a milling band evaluated over an entirety of the strike face surface, at a milling band surface roughness wavelength range of 2,000 μin to 100,000 μin;

wherein an average surface roughness (Sa) of the strike face surface in the milling band is between 60 μin and 180 μin, a skewness (Ssk) of the strike face surface in the milling band is between 0.2 and 0.7, a root mean square gradient (Sdq) of the strike face surface in the milling band is between 5 degrees and 9 degrees, and a developed interface area (Sdr) of the strike face surface in the milling band is between 0.5% and 1.5%; and a surface band evaluated over the entirety of the strike face surface, at a surface band surface roughness wavelength range of 300 μin to 2,000 μin;

wherein the average surface roughness (Sa) of the strike face surface in the surface band is between 35 μin and 120 μin, the skewness (Ssk) of the strike face surface in the surface band is between −5.0 and −1.0, the root mean square gradient (Sdq) of the strike face surface in the surface band is between 14 degrees and 30 degrees, and the developed interface area (Sdr) of the strike face surface in the surface band is between 5% and 15%.

15. The wedge-type golf club head of claim 14, wherein the golf club head has a loft that is 40 degrees or greater.

16. The wedge-type golf club head of claim 14, wherein the golf club head is made out of 8620 alloy steel.

17. The wedge-type golf club head of claim 14, wherein the strike face further comprises grooves.

18. The wedge-type golf club head of claim 14, wherein a ratio of the root mean square gradient (Sdq) of the strike face surface in the surface band to the skewness (Ssk) of the strike face surface in the surface band is between −12 degrees and −10 degrees.

19. The wedge-type golf club head of claim 14, wherein the skewness (Ssk) of the strike face surface in the surface band is between −1.6 and −1.8.

20. The wedge-type golf club head of claim 14, wherein the average surface roughness (Sa) of the strike face surface in the surface band is between 40 μin and 45 μin.

* * * * *